US012680420B2

(12) United States Patent
Gilliam

(10) Patent No.: US 12,680,420 B2
(45) Date of Patent: Jul. 14, 2026

(54) PROCESSES AND SYSTEMS TO CAPTURE CARBON DIOXIDE

(71) Applicant: Arelac, Inc., San Jose, CA (US)

(72) Inventor: Ryan J. Gilliam, San Jose, CA (US)

(73) Assignee: Arelac, Inc., San Jose, CA (US)

( * ) Notice: Subject to any disclaimer, the term of this patent is extended or adjusted under 35 U.S.C. 154(b) by 0 days.

(21) Appl. No.: 18/505,801

(22) Filed: Nov. 9, 2023

(65) Prior Publication Data

US 2024/0159128 A1 May 16, 2024

Related U.S. Application Data

(60) Provisional application No. 63/424,251, filed on Nov. 10, 2022.

(51) Int. Cl.
*E21B 41/00* (2006.01)

(52) U.S. Cl.
CPC ..... *E21B 41/0064* (2013.01)

(58) Field of Classification Search
CPC ..... E21B 41/0064
See application file for complete search history.

(56) References Cited

U.S. PATENT DOCUMENTS 7,887,694 B2 * 2/2011 Constantz ..... B01D 53/1425 423/220
7,976,628 B2 7/2011 Blount et al.
8,333,944 B2 * 12/2012 Constantz ..... B01D 53/1493 423/220

(Continued)

FOREIGN PATENT DOCUMENTS

AU 2018214626 A1 * 8/2019 ..... C12P 21/00
CN 120187514 6/2025

(Continued)

OTHER PUBLICATIONS

"International Application Serial No. PCT US2023 079258, Invitation to Pay Additional Fees mailed Feb. 5, 2024", 2 pgs.

(Continued)

*Primary Examiner* — Frederick L Lagman
(74) *Attorney, Agent, or Firm* — Schwegman Lundberg & Woessner, P.A.

(57) ABSTRACT

Provided herein are processes and systems related to a carbon dioxide sequestration process, comprising a) calcining limestone using a fossil fuel alternative input to form a mixture comprising lime and a gaseous stream comprising more than about 30 vol % carbon dioxide; and b) treating the mixture comprising lime with atmospheric air and allowing carbon dioxide from the atmospheric air to react with the mixture and form a composition comprising calcium carbonate, calcium bicarbonate, or combination thereof. Provided also herein are processes and systems related to a carbon dioxide sequestration process, comprising a) calcining limestone using a fossil fuel alternative input to form a mixture comprising lime and a gaseous stream comprising more than about 30 vol % carbon dioxide; and b) treating the mixture comprising lime with natural water and allowing dissolved carbon dioxide in the natural water to react with the mixture to form a composition comprising calcium carbonate, calcium bicarbonate, or combination thereof.

16 Claims, 5 Drawing Sheets

(56) References Cited

U.S. PATENT DOCUMENTS

| | | | | |
|---|---|---|---|---|
| 9,260,314 | B2 * | 2/2016 | Constantz | C04B 14/28 |
| 2011/0035154 | A1 * | 2/2011 | Kendall | C04B 28/10 422/111 |
| 2016/0258263 | A1 * | 9/2016 | Hagen | C01D 1/02 |
| 2017/0341942 | A1 * | 11/2017 | Harper, Jr. | F01K 7/16 |
| 2021/0187437 | A1 * | 6/2021 | Gran | B01D 53/62 |

FOREIGN PATENT DOCUMENTS

| | | | | |
|---|---|---|---|---|
| ES | 2911204 | T3 * | 5/2022 | C04B 2/106 |
| WO | 2009086460 | | 7/2009 | |
| WO | 2022130233 | | 6/2022 | |
| WO | 2022187336 | | 9/2022 | |
| WO | 2024102926 | | 5/2024 | |

OTHER PUBLICATIONS

"International Application Serial No. PCT US2023 079258, International Search Report mailed Apr. 26, 2024", 4 pgs.

"International Application Serial No. PCT US2023 079258, Written Opinion mailed Apr. 26, 2024", 7 pgs.

Ruiz, D., "Real-time refinery energy management: An online model installed at Repsol Cartagena refinery enables optimal balance between internal energy production and demand", Industry white paper (online). Yokogawa Corporation of America, Retrieved from the Internet on Feb. 29, 2024, (2009), 4 pgs.

"International Application Serial No. PCT US2023 079258, International Preliminary Report on Patentability mailed May 22, 2025", 9 pgs.

"European Application Serial No. 23889721.9, Response to Communication pursuant to Rules 1612 and 162 EPC filed Nov. 24, 2025", w claims, 5 pgs.

* cited by examiner

PROCESSES AND SYSTEMS TO CAPTURE CARBON DIOXIDE

CROSS-REFERENCE TO RELATED APPLICATION

This application claims the benefit of priority to U.S. Provisional Patent Application Ser. No. 63/424,251 entitled "PROCESSES AND SYSTEMS TO CAPTURE CARBON DIOXIDE," filed Nov. 10, 2022, the disclosure of which is incorporated herein in its entirety by reference.

BACKGROUND

Carbon dioxide ($CO_2$) emissions have been identified as a major contributor to the phenomenon of global warming. $CO_2$ is a by-product of combustion, and it creates operational, economic, and environmental problems. It is known that elevated atmospheric concentrations of $CO_2$ and other greenhouse gases facilitate greater storage of heat within the atmosphere leading to enhanced surface temperatures and rapid climate change. In addition, elevated levels of $CO_2$ in the atmosphere may also further acidify the world's oceans due to the dissolution of $CO_2$ and formation of carbonic acid. The impact of climate change and ocean acidification may likely be economically expensive and environmentally hazardous if not timely handled. Reducing potential risks of climate change requires sequestration and avoidance of $CO_2$ from various anthropogenic processes.

SUMMARY

Various embodiments relate to the development of robust, energy efficient, and low-cost strategies for removal of carbon dioxide from air and water, such as, e.g., ocean water and other natural waters.

In one aspect, there is provided a carbon dioxide sequestration process, comprising:

a) calcining limestone using a fossil fuel alternative input to form a mixture comprising lime and a gaseous stream comprising more than about 30 vol % carbon dioxide; and b) treating the mixture comprising lime with atmospheric air and allowing carbon dioxide from the atmospheric air to react with the mixture and form a composition comprising calcium carbonate, calcium bicarbonate, or combination thereof.

In one aspect, there is provided a carbon dioxide sequestration process, comprising:

a) calcining limestone using a fossil fuel alternative input to form a mixture comprising lime and a gaseous stream comprising more than about 30 vol % carbon dioxide; and b) treating the mixture comprising lime with natural water and allowing dissolved carbon dioxide in the natural water to react with the mixture to form a composition comprising calcium carbonate, calcium bicarbonate, or combination thereof.

In some embodiments of the foregoing aspects, the process further comprises disposing the gaseous stream comprising more than about 30 vol % carbon dioxide wherein the disposing comprises cooling, compressing, and/or storing. In some embodiments of the foregoing aspects and embodiments, the storing comprises geologically sequestering the gaseous stream comprising more than about 30 vol % carbon dioxide.

In some embodiments of the foregoing aspects and embodiments, the gaseous stream comprising more than about 30 vol % carbon dioxide, comprises no gaseous or non-gaseous components from combustion of the fossil fuel.

In some embodiments of the foregoing aspects and embodiments, the gaseous stream comprises more than about 90 vol % carbon dioxide. In some embodiments of the foregoing aspects and embodiments, the gaseous stream comprises between about 90-100 vol % carbon dioxide. In some embodiments of the foregoing aspects and embodiments, the gaseous stream comprises about 99 vol % carbon dioxide.

In some embodiments of the foregoing aspects and embodiments, the fossil fuel alternative input comprises electric kiln, renewable electricity, hydrogen gas, biofuel, indirect heating, or combination thereof. In some embodiments of the foregoing aspects and embodiments, the renewable electricity comprises solar energy, wind energy, geothermal energy, and/or hydro energy. In some embodiments of the foregoing aspects and embodiments, the biofuel comprises biomass. In some embodiments of the foregoing aspects and embodiments, the biomass comprises torrefied biomass, lignin, and/or pulverized biomass. In some embodiments of the foregoing aspects and embodiments, the indirect heating comprises calcining limestone using a heat input wherein gaseous stream from the heat input is separate from the gaseous stream comprising more than about 30 vol % carbon dioxide.

In some embodiments of the foregoing aspects and embodiments, the mixture comprising lime comprises underburnt lime. In some embodiments of the foregoing aspects and embodiments, the mixture comprising lime comprises soft burnt lime. In some embodiments of the foregoing aspects and embodiments, the mixture comprising lime comprises dead burnt lime.

In some embodiments of the foregoing aspects and embodiments, the process further comprises c) treating a slip stream of the mixture comprising lime with N-containing salt solution to produce an aqueous solution comprising calcium salt; and contacting the aqueous solution comprising calcium salt with the gaseous stream comprising more than about 30 vol % carbon dioxide to produce a precipitate comprising calcium carbonate.

In some embodiments of the foregoing aspects and embodiments, the process further comprises c) treating a slip stream of the mixture comprising lime with N-containing salt solution to produce an aqueous solution comprising calcium salt; and contacting the aqueous solution comprising calcium salt with a gaseous stream comprising less than about 25 vol % carbon dioxide to produce a precipitate comprising calcium carbonate. In some embodiments of the foregoing aspects and embodiments, the gaseous stream comprising less than about 25 vol % carbon dioxide is obtained from limestone calcination using fossil fuel.

In some embodiments of the foregoing aspects and embodiments, the treating the mixture comprising lime with the atmospheric air comprises spreading the mixture on land and allowing the carbon dioxide from the atmospheric air to react with the mixture and form the composition comprising calcium carbonate, calcium bicarbonate, or combination thereof.

In some embodiments of the foregoing aspects and embodiments, the treating the mixture comprising lime in the natural water comprises sequestering the mixture directly in natural water. In some embodiments of the foregoing aspects and embodiments, the treating the mixture comprising lime in the natural water comprises mixing the mixture comprising lime with cooling natural water at power plant and sequestering the mix back in the natural water. In some embodiments of the foregoing aspects and embodiments, the natural water is ocean water and treating the mixture comprising lime in the ocean water comprises mixing the mixture comprising lime with concentrated salt ocean water at desalination plant and sequestering the mix back in the ocean water.

In some embodiments of the foregoing aspects and embodiments, the gaseous stream comprising more than about 30 vol % carbon dioxide comprises less than about 20% of at least one component selected from the group consisting of SOx; thermal NOx; carbon monoxide; metal; volatile organic matter; particulate matter; and combination thereof. In some embodiments of the foregoing aspects and embodiments, the gaseous stream comprising more than about 90 vol % carbon dioxide comprises less than about 1% of at least one component selected from the group consisting of SOx; thermal NOx; carbon monoxide; metal; volatile organic matter; particulate matter; and combination thereof. In some embodiments of the foregoing aspects and embodiments, the gaseous stream comprising more than about 99 vol % carbon dioxide comprises less than about 1% of at least one component selected from the group consisting of SOx; thermal NOx; carbon monoxide; metal; volatile organic matter; particulate matter; and combination thereof In some embodiments of the foregoing aspects and embodiments, the composition comprising calcium carbonate, calcium bicarbonate, or combination thereof, formed in the ocean water is pH neutral. In some embodiments of the foregoing aspects and embodiments, the process further comprises settling the composition comprising calcium carbonate, calcium bicarbonate, or combination thereof, on floor of the ocean. In some embodiments of the foregoing aspects and embodiments, the process further comprises forming coral reefs on the composition comprising calcium carbonate, calcium bicarbonate, or combination thereof.

In one aspect, there is provided a carbon dioxide sequestration process, comprising:

a) burning a heat input to generate heat and a first gaseous stream; and b) indirectly heating and calcining limestone using the heat from the heat input to form a mixture comprising lime and a second gaseous stream comprising more than about 90 vol % carbon dioxide, wherein the first gaseous stream from the heat input is separate from the second gaseous stream comprising more than about 90 vol % carbon dioxide.

In some embodiments of the foregoing aspect, the heat input is fossil fuel input or fossil fuel alternative input. In some embodiments of the foregoing aspect and embodiments, the fossil fuel input or fossil fuel alternative input may be switched for grid load balancing and/or economics. In some embodiments of the foregoing aspect and embodiments, the fossil fuel alternative input comprises biomass and/or hydrogen gas. In some embodiments of the foregoing aspect and embodiments, the first gaseous stream comprises less than about 25 vol % carbon dioxide. In some embodiments of the foregoing aspect and embodiments, the first gaseous stream comprises more than about 20% of at least one component selected from the group consisting of SOx; thermal NOx; carbon monoxide; metal; volatile organic matter; particulate matter; and combination thereof.

In some embodiments of the foregoing aspect and embodiments, the process further comprises treating a slipstream or whole of the mixture comprising lime with atmospheric air and allowing carbon dioxide from the atmospheric air to react with the mixture and form a composition comprising calcium carbonate, calcium bicarbonate, or combination thereof.

In some embodiments of the foregoing aspect and embodiments, the process further comprises treating a slipstream or whole of the mixture comprising lime with natural water and allowing dissolved carbon dioxide in the natural water to react with the mixture to form a composition comprising calcium carbonate, calcium bicarbonate, or combination thereof.

In some embodiments of the foregoing aspect and embodiments, the process further comprises treating a slipstream or whole of the mixture comprising lime with N-containing salt solution to produce an aqueous solution comprising calcium salt; and contacting the aqueous solution comprising calcium salt with the first gaseous stream comprising less than about 25 vol % carbon dioxide to produce a precipitate comprising calcium carbonate.

In some embodiments of the foregoing aspect and embodiments, the process further comprises disposing the second gaseous stream comprising more than about 90 vol % carbon dioxide wherein the disposing comprises cooling, compressing, and/or storing. In some embodiments of the foregoing aspect and embodiments, the storing comprises geologically sequestering the second gaseous stream comprising more than about 90 vol % carbon dioxide.

In some embodiments of the foregoing aspect and embodiments, the second gaseous stream comprising more than about 90 vol % carbon dioxide, comprises no gaseous or non-gaseous components from combustion of fossil fuel. In some embodiments of the foregoing aspect and embodiments, the second gaseous stream comprises between about 90-100 vol % carbon dioxide. In some embodiments of the foregoing aspect and embodiments, the gaseous stream comprises about 99 vol % carbon dioxide.

In one aspect, there is provided a system for carbon dioxide sequestration, comprising:

a first calcining system configured to calcine limestone feed using a fossil fuel alternative input to form a mixture comprising lime and a gaseous stream comprising more than about 30 vol % carbon dioxide; and a sequestration system operably connected to the first calcining system and configured to treat the mixture comprising lime with atmospheric air and allow carbon dioxide from the atmospheric air to react with the mixture and form a composition comprising calcium carbonate, calcium bicarbonate, or combination thereof.

In one aspect, there is provided a system for carbon dioxide sequestration, comprising:

a first calcining system configured to calcine limestone feed using a fossil fuel alternative input to form a mixture comprising lime and a gaseous stream comprising more than about 30 vol % carbon dioxide; and a sequestration system operably connected to the first calcining system and configured to treat the mixture comprising lime with natural water and allow dissolved carbon dioxide in the natural water to react with the mixture to form a composition comprising calcium carbonate, calcium bicarbonate, or combination thereof.

In some embodiments of the foregoing aspect and embodiments, the sequestration system is a conveyer belt and/or means of transportation.

In some embodiments of the foregoing aspect and embodiments, the system further comprises a disposal system operably connected to the first calcining system and configured to dispose the gaseous stream comprising more than about 30 vol % carbon dioxide. In some embodiments of the foregoing aspect and embodiments, the disposal system comprises cooler, compressor, and/or geological injector.

In some embodiments of the foregoing aspect and embodiments, the gaseous stream comprises more than about 90 vol % carbon dioxide.

In some embodiments of the foregoing aspect and embodiments, the system further comprises a treatment reactor operably connected to the first calcining system configured for receiving a slipstream of the mixture comprising lime and configured for dissolving the mixture comprising lime in a N-containing salt solution to produce an aqueous solution comprising calcium salt; and a contacting reactor operably connected to the treatment reactor and the first calcining system and configured for receiving the aqueous solution comprising calcium salt and a slipstream of the gaseous stream comprising more than about 30 vol % carbon dioxide and configured for treating the aqueous solution comprising calcium salt with the gaseous stream to form a precipitate comprising calcium carbonate.

In some embodiments of the foregoing aspect and embodiments, the system further comprises a second calcining system configured to calcine limestone feed using fossil fuel and generate a gaseous stream comprising less than about 25 vol % carbon dioxide;

a treatment reactor operably connected to the first calcining system configured for receiving a slipstream of the mixture comprising lime and configured for dissolving the mixture comprising lime in a N-containing salt solution to produce an aqueous solution comprising calcium salt; and a contacting reactor operably connected to the treatment reactor and the second calcining system and configured for receiving the aqueous solution comprising calcium salt from the treatment reactor and the gaseous stream comprising less than about 25 vol % carbon dioxide from the second calcining system and configured for treating the aqueous solution comprising calcium salt with the gaseous stream to form a precipitate comprising calcium carbonate.

DRAWINGS

The features of the invention are set forth with particularity in the appended claims. A better understanding of the features and advantages of the invention will be obtained by reference to the following detailed description that sets forth illustrative embodiments, in which the principles of the invention are utilized, and the accompanying drawings of which:

DESCRIPTION

Figure 1A:
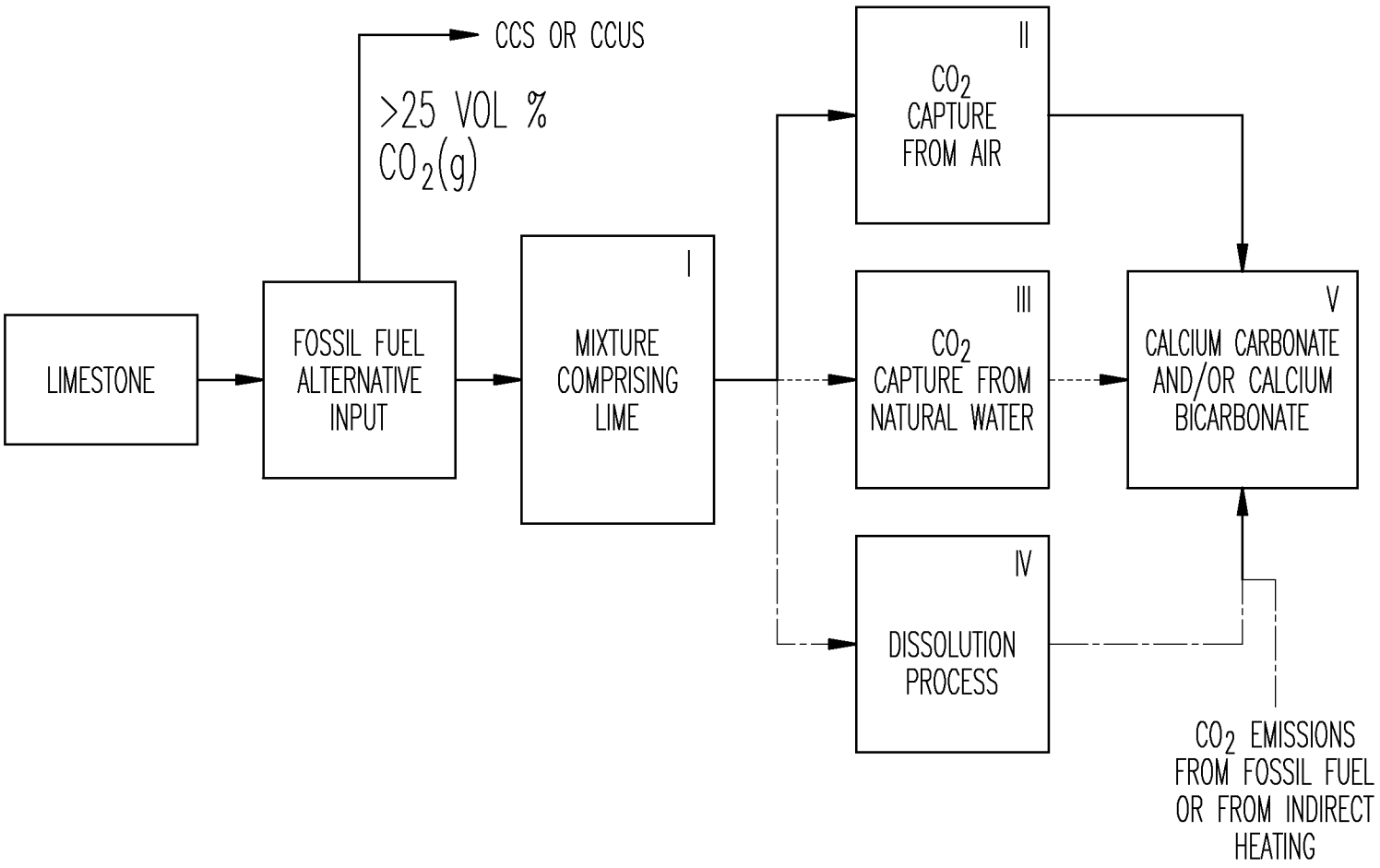
FIG. 1A illustrates some process and system embodiments provided herein.

To reduce global warming, actively removing $CO_2$ from the atmosphere may become a necessity. The oceans cover 70% of earth's surface, influences weather and climate by absorbing solar radiation, distributing that heat and moisture throughout the ocean and around the globe, and driving global weather systems. The oceans have also absorb about 30% of all anthropogenic $CO_2$ emissions and trap more than about 90% of the excess heat in the biosphere caused by $CO_2$ pollution. Cement is a significant contributor to global carbon dioxide emissions with over 1.5 billion metric tons emitted per year, corresponding to about 8% of total emissions. Over 50% of the cement emissions may result from the release of carbon dioxide from the decomposition of the limestone feedstock ($CaCO_3$-->$CaO+CO_2$) in conventional kilns. Another 40% of cement emissions may result from the combustion of fuel in a high temperature conventional kiln, a unit which may not be required, or may be replaced by the fossil fuel alternatives according to some of the present embodiments. An example of a conventional kiln is a kiln such as rotary kiln, vertical kiln, etc. Various embodiments address refining the emitted $CO_2$ (i.e. increasing the purity and concentration of the $CO_2$), recapturing the $CO_2$ back in the process or sequestering and storing or disposing underground (which may be more than 20% or more than 25% or more than 60% or close to 100% captive), avoiding the use of conventional kilns burning coal, reducing the capex by reducing absorber size and vent systems, capturing $CO_2$ from the air and/or natural water, and improving the kinetics of the calcium carbonate formation, such as vaterite form etc. The present embodiments eliminate more than 50% or more than 80% or close to 100% of cement carbon dioxide emissions.

Various embodiments are provided that capture high concentration or purer $CO_2$ from the limestone calcination, capture $CO_2$ from the air (e.g., Direct Air Capture or DAC) and/or capture $CO_2$ from the natural water (e.g., Direct Ocean Capture or DOC) in cost effective, robust, and economically viable techniques.

In one aspect, there is provided a carbon dioxide sequestration process, comprising: calcining limestone using a fossil fuel alternative input to form a mixture comprising lime and a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and a) treating a slip stream or whole of the mixture comprising lime with atmospheric air and allowing carbon dioxide from the atmospheric air to react with the mixture and form a composition comprising calcium carbonate, calcium bicarbonate, or combination thereof.

In one aspect, there is provided a carbon dioxide sequestration process, comprising:

a) calcining limestone using a fossil fuel alternative input to form a mixture comprising lime and a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and b) treating a slip stream or whole of the mixture comprising lime with natural water and allowing dissolved carbon dioxide in the natural water to react with the mixture to form a composition comprising calcium carbonate, calcium bicarbonate, or combination thereof.

In one aspect, there is provided a carbon dioxide sequestration process, comprising:

a) calcining limestone using a fossil fuel alternative input to form a mixture comprising lime and a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and b) treating a slip stream or whole of the mixture comprising lime with N-containing salt solution to produce an aqueous solution comprising calcium salt; and contacting the aqueous solution comprising calcium salt with the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein) to produce a precipitate comprising calcium carbonate.

In one aspect, there is provided a carbon dioxide sequestration process, comprising:

a) calcining limestone using a fossil fuel alternative input to form a mixture comprising lime and a first gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and treating a slip stream or whole of the mixture comprising lime with an N-containing salt solution to produce an aqueous solution comprising calcium salt; and contacting the aqueous solution comprising calcium salt with a second gaseous stream comprising less than 25 vol % carbon dioxide or less than 20 vol % carbon dioxide to produce a precipitate comprising calcium carbonate.

In some embodiments of the aforementioned aspect, the gaseous stream or the second gaseous stream comprising less than 25 vol % carbon dioxide is obtained from limestone calcination in a cement plant using fossil fuel.

In one aspect, there is provided a carbon dioxide sequestration process, comprising:

a) calcining limestone using a fossil fuel alternative input to form a mixture comprising lime and a first gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and b) treating a slip stream or whole of the mixture comprising lime with atmospheric air and allowing carbon dioxide from the atmospheric air to react with the mixture and form a composition comprising calcium carbonate, calcium bicarbonate, or combination thereof, and/or c) treating a slip stream or whole of the mixture comprising lime with natural water and allowing dissolved carbon dioxide in the natural water to react with the mixture to form a composition comprising calcium carbonate, calcium bicarbonate, or combination thereof, and/or d) treating a slip stream or whole of the mixture comprising lime with N-containing salt solution to produce an aqueous solution comprising calcium salt; and contacting the aqueous solution comprising calcium salt with the first gaseous stream comprising more than 25 vol % or more carbon dioxide than 30 vol % carbon dioxide or more than 50 vol % carbon dioxide or more than 80 vol % carbon dioxide or more than 90 vol % carbon dioxide (or higher concentrations as provided herein) to produce a precipitate comprising calcium carbonate, and/or e) treating a slip stream or whole of the mixture comprising lime with N-containing salt solution to produce an aqueous solution comprising calcium salt; and contacting the aqueous solution comprising calcium salt with a second gaseous stream comprising less than 25 vol % carbon dioxide or less than 20 vol % carbon dioxide to produce a precipitate comprising calcium carbonate.

In some embodiments of the aforementioned aspect, the second gaseous stream comprising less than 25 vol % carbon dioxide is obtained from the limestone calcination in the cement plant using fossil fuel.

In one aspect, there is provided a system for carbon dioxide sequestration, comprising:

a first calcining system configured to calcine limestone feed using a fossil fuel alternative input to form a mixture comprising lime and a gaseous stream comprising more than 25 vol % or more carbon dioxide than 30 vol % carbon dioxide or more than 50 vol % carbon dioxide or more than 80 vol % carbon dioxide or more than 90 vol % carbon dioxide (or higher concentrations as provided herein); and a sequestration system operably connected to the first calcining system and configured to treat a slip stream or whole of the mixture comprising lime with atmospheric air and allow carbon dioxide from the atmospheric air to react with the mixture and form a composition comprising calcium carbonate, calcium bicarbonate, or combination thereof.

In one aspect, there is provided a system for carbon dioxide sequestration, comprising:

a first calcining system configured to calcine limestone feed using a fossil fuel alternative input to form a mixture comprising lime and a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein); and a sequestration system operably connected to the first calcining system and configured to treat a slip stream or whole of the mixture comprising lime with natural water and allow dissolved carbon dioxide in the natural water to react with the mixture to form a composition comprising calcium carbonate, calcium bicarbonate, or combination thereof.

In one aspect, there is provided a system for carbon dioxide sequestration, comprising:

a first calcining system configured to calcine limestone feed using a fossil fuel alternative input to form a mixture comprising lime and a first gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein);

a treatment reactor operably connected to the first calcining system configured for receiving a slip stream or whole of the mixture comprising lime and configured for dissolving the mixture comprising lime in an N-containing salt solution to produce an aqueous solution comprising calcium salt; and a contacting reactor operably connected to the treatment reactor and the first calcining system and configured for receiving the aqueous solution comprising calcium salt and the first gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein) and configured for treating the aqueous solution comprising calcium salt with the gaseous stream to form a precipitate comprising calcium carbonate.

In one aspect, there is provided a system for carbon dioxide sequestration, comprising:

a first calcining system configured to calcine a limestone feed using a fossil fuel alternative input to form a mixture comprising lime and a first gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein);

a second calcining system configured to calcine limestone feed using fossil fuel and generate a second gaseous stream comprising less than 25 vol % carbon dioxide or less than 20 vol % carbon dioxide;

a treatment reactor operably connected to the first calcining system and configured for receiving a slip stream or whole of the mixture comprising lime and further configured for dissolving the mixture comprising lime in an N-containing salt solution to produce an aqueous solution comprising calcium salt; and a contacting reactor operably connected to the treatment reactor and the second calcining system and configured for receiving the aqueous solution comprising calcium salt from the treatment reactor and the second gaseous stream comprising less than 25 vol % carbon dioxide or less than 20 vol % carbon dioxide from the second calcining system and configured for treating the aqueous solution comprising calcium salt with the gaseous stream to form a precipitate comprising calcium carbonate.

In some embodiments of the above noted aspects, the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentrations as provided herein) or a slipstream thereof, obtained from the calcination of the limestone using the fossil fuel alternative input, is subjected to disposal as described further herein.

Some embodiments of the above noted aspects have been illustrated in figures and described further herein in detail. It is to be understood that the steps illustrated in the figures may be modified or the order of the steps may be changed or more steps may be added or deleted depending on the desired outcome. It is also to be understood that some of the steps described in the specification may not be illustrated in the figures.

Calcination of the Limestone Using Fossil Fuel Alternative Input

Figure 1B:
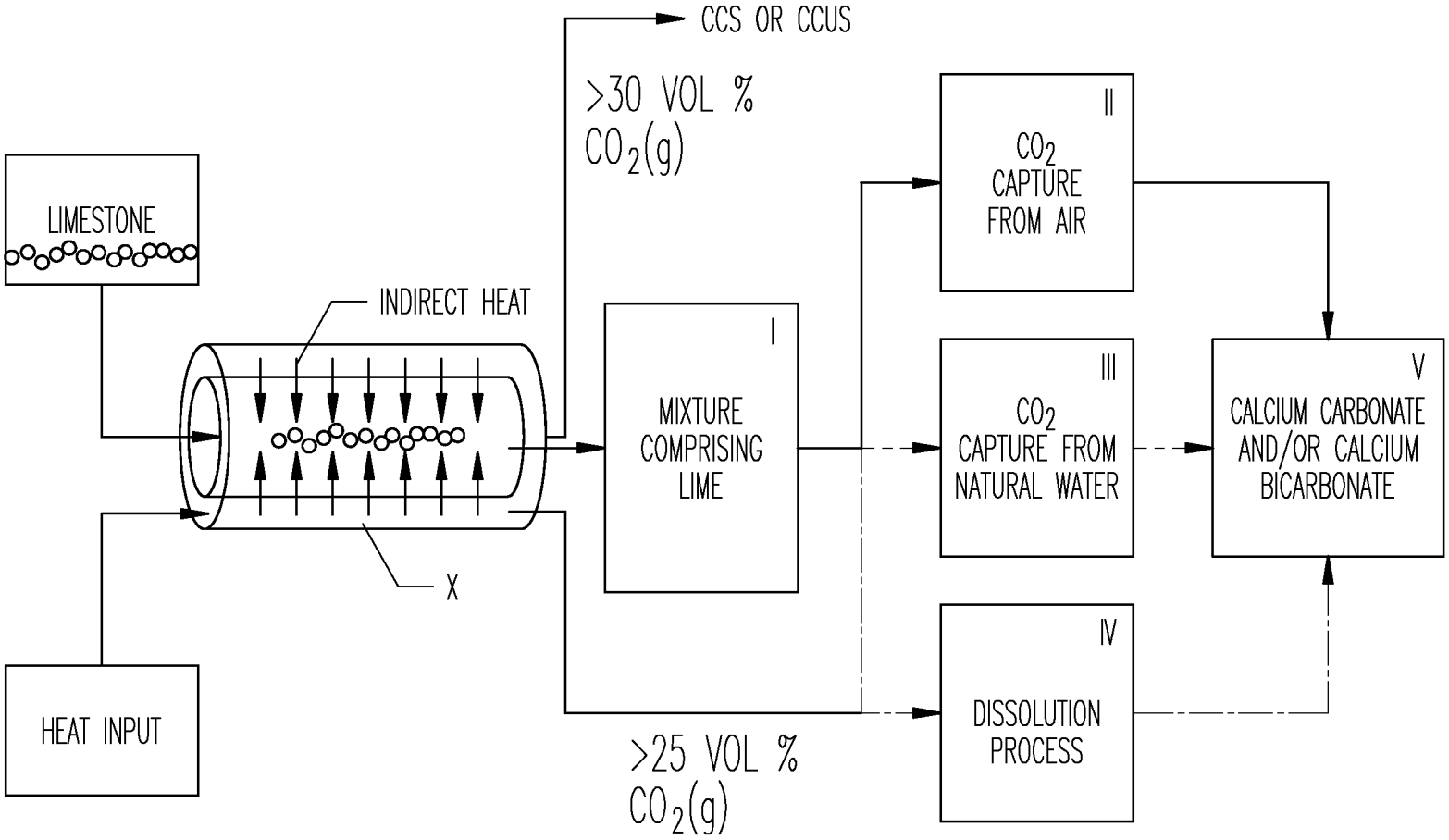
FIG. 1B illustrates some process and system embodiments provided herein related to the indirect heating of the limestone.

The process and system for calcination of the limestone using fossil fuel alternative input to form a mixture comprising lime is illustrated as step I in FIGS. 1A and 1B. FIG. 1B illustrates an embodiment where the fossil fuel alternative input is indirect heating, as will be further described. FIG. 1A is an illustration of some embodiments and it includes feeding limestone 110 for calcining using fossil fuel alternative 120 to form mixture 130 that contains lime. The mixture is then used for $CO_2$ capture from air 152, or $CO_2$ capture from natural water 154, or dissolution process 156. These processes may in turn produce calcium carbonate and/or calcium bicarbonate 160. Referring to FIG. 1B, in some embodiments, limestone 162 is directed into kiln 170 and subjected to indirect heat 164 to form mixture 172 that contains lime. The mixture is then used for $CO_2$ capture from air 182, or $CO_2$ capture from natural water 184, or dissolution process 186. These processes may in turn produce calcium carbonate and/or calcium bicarbonate 190.

As illustrated in step I in FIG. 1A and FIG. 1B, the limestone is subjected to the calcination using fossil fuel alternative input resulting in the formation of a mixture comprising lime and a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity as provided herein). The mixture comprising lime and the gaseous stream comprising more than 25 vol % carbon dioxide (or the higher concentration) obtained from the cement plant using the fossil fuel alternative input are subjected to various processes and systems according to various embodiments.

The calcination or the calcining is a thermal treatment process used to bring about a thermal decomposition of the limestone. The "limestone" as used the present embodiments, has the chemical formula $CaCO_3$ and may further include other impurities typically present in the limestone. In some embodiments, the limestone further comprises magnesium or magnesium oxide. Limestone is a naturally occurring mineral. The chemical composition of limestone may vary from region to region as well as between different deposits in the same region. Therefore, the lime comprising calcium oxide and/or calcium hydroxide obtained from calcining limestone from each natural deposit may be different. The limestone may be composed of calcium carbonate ($CaCO_3$), magnesium, e.g., magnesium carbonate ($MgCO_3$), silica ($SiO_2$), alumina ($Al_2O_3$), iron (Fe), sulfur (S) or other trace elements and compositions.

The limestone deposits may be widely different. The limestone from the various deposits may vary in physical and chemical properties and may be classified according to its chemical composition, texture, and geological formation. The limestone may be classified into the following types: high calcium limestone where the carbonate content may be composed mainly of the calcium carbonate with a magnesium carbonate content not more than 5%; magnesium limestone containing a magnesium carbonate content of about 5-35%; or dolomitic limestone which may contain between 35-46% of magnesium carbonate, with the balance being calcium carbonate. The limestone from different sources may differ considerably in chemical compositions and physical structures. It is to be understood that the present embodiments apply to all cement plants calcining various limestone from and any of the sources listed above or commercially available. The quarries include, but are not limited to, quarries associated with cement kilns, quarries for lime rock for aggregate used in concrete, quarries for lime rock for other purposes (road base), and/or quarries associated with lime kilns.

The limestone calcination is a decomposition process where the chemical reaction for decomposition of the limestone is:

$$CaCO_3 \rightarrow CaO + CO_2(g)$$

This step is illustrated in FIG. 1A and FIG. 1B as step I of the calcination of the limestone to form the mixture comprising lime and more than 25 vol % carbon dioxide or more than 30 vol % carbon dioxide or more than 50 vol % carbon dioxide or more than 80 vol % carbon dioxide or more than 90 vol % carbon dioxide (or higher concentration or purity as provided herein).

In some embodiments, the limestone comprises between about 1-70% magnesium. Alternatively, or in addition, a magnesium bearing mineral is mixed with the limestone before the calcination with the magnesium bearing mineral comprising between about 1-70% magnesium. In some embodiments, upon calcination, the magnesium forms magnesium oxide. In some embodiments, the magnesium bearing mineral may contain magnesium carbonate, magnesium salt, magnesium hydroxide, magnesium silicate, magnesium sulfate, or combinations thereof. In some embodiments, the magnesium bearing mineral may include, but is not limited to, dolomite, magnesite, brucite, carnallite, talc, olivine, artinite, hydromagnesite, dypingite, barringonite, nesquehonite, lansfordite, kieserite, or a combination thereof.

The term "lime", as used in the various embodiments, refers to calcium oxide and/or calcium hydroxide. The presence and amount of the calcium oxide and/or the calcium hydroxide in the lime may vary depending on the conditions for the lime formation. The lime may be in dry form i.e., calcium oxide, and/or in wet form e.g., calcium hydroxide, depending on the conditions. The lime may be calcium oxide in the form of a solid from dry kilns/cement processes and/or may be a combination of calcium oxide and calcium hydroxide in the form of slurry in wet kilns/cement processes. When wet, the calcium oxide (may also be known as a base anhydride that converts to its hydroxide form in water) may be present in its hydrated form such as, but not limited to, calcium hydroxide. While calcium hydroxide (also called slaked lime) is a common hydrated form of calcium oxide, other intermediate hydrated and/or water complexes may also be present in a slurry and are all included within the scope of the present embodiments. It is to be understood that while the lime is illustrated as CaO in some of the figures of the present disclosure, it may be present as $Ca(OH)_2$ or a combination of CaO and $Ca(OH)_2$. The mixture comprising lime may further comprise calcium hydroxide formed by the solubilization of the calcium oxide in water. The calcium oxide and/or the calcium hydroxide may both act as a source of divalent cations ($Ca^{2+}$) as well as proton-removing agent and react with carbon dioxide to form calcium carbonate, calcium bicarbonate, or combination thereof.

The production of lime may depend upon the type of kiln, conditions of the calcination, and the nature of the raw material i.e., the limestone. At relatively low calcination temperatures, products formed in the kiln may contain both unburnt carbonate and lime and may be called underburnt lime. As the temperature increases, soft-burnt or high reactive lime may be produced. At still higher temperatures, dead-burnt or low reactive lime may be produced. Soft-burnt lime may be produced when the reaction front reaches the core of the charged limestone and converts all carbonate present to the lime. This highly reactive product may be relatively soft, may contain small lime crystallites and may have open porous structure with an easily assessable interior. Such lime may have the properties of high reactivity, high surface area and low bulk density.

Increasing the degree of calcination beyond this stage may make the lime crystallites grow larger, agglomerate, and sinter. This may result in a decrease in surface area, porosity, and reactivity as well as an increase in bulk density. This product is known as dead-burnt or low reactive lime. Without being limited by any theory, the present embodiments utilize any one or a combination of the aforementioned phases of lime. In some embodiments, the lime is dead-burnt lime. In some embodiments, the lime is soft-burnt lime. In some embodiments, the lime is under-burnt lime. In some embodiments, the lime is dead-burnt lime, soft-burnt lime, under-burnt lime, or a combination thereof.

In various embodiments, the calcination of the limestone, using fossil fuel alternative input, produces the mixture comprising more than 10 wt % or more than 20 wt % or more than 30 wt % lime. In some embodiments, the calcination of the limestone produces a mixture comprising more than 40 wt % lime or more than 50 wt % lime, or more than 60 wt % lime, or more than 70 wt % lime, or more than 80 wt % lime, or more than 90 wt % lime, or between 30-95 wt % lime, or between 40-95 wt % lime, or between 50-95 wt % lime, or between 60-95 wt % lime, or between 70-95 wt % lime, or between 80-95 wt % lime, or between 30-90 wt % lime, or between 40-90 wt % lime, or between 50-90 wt % lime, or between 60-90 wt % lime, or between 70-90 wt % lime, or between 80-90 wt % lime, or between 30-80 wt % lime, or between 40-80 wt % lime, or between 50-80 wt % lime, or between 60-80 wt % lime, or between 70-80 wt % lime, or between 40-50 wt % lime, or between 50-60 wt % lime. In some embodiments, the lime is dead-burnt lime. In some embodiments, the lime is soft-burnt lime. In some embodiments, the lime is under-burnt lime. In some embodiments, the lime is dead-burnt lime, soft-burnt lime, under-burnt lime, or a combination thereof. In some embodiments, the lime is soft burnt-lime, under-burnt lime, or combination thereof. In some embodiments, the lime is dead-burnt lime, soft-burnt lime, or combination thereof. In some embodiments, the lime is dead-burnt lime, under-burnt lime, or combination thereof.

Without being limited by any theory, the present embodiments may produce and/or utilize any one or a combination of the lime phases. The calcination, using the fossil fuel alternative input, provides an advantage of finer control over the calcination temperature which results in greater control over the production of the soft-burnt lime over the dead-burnt lime or over the under-burnt lime or vice versa.

In some embodiments, a mixture containing lime, obtained after the calcination of the limestone using fossil fuel alternative input, may further contain impurities of the limestone or the decomposed limestone. These impurities may be present as solids along with the mixture containing lime. For example, in some embodiments, the mixture containing lime. may further contain sulfur, depending on the source of the limestone. The sulfur compound may include any sulfur ion containing compound.

The term "fossil fuel alternative input" as used in some embodiments, may include any fuel input that can be an alternative source to fossil fuel. Examples include, without limitation, electric kiln, renewable electricity, hydrogen gas, biofuel, solar heating, indirect heating, and the like, or combination thereof. In some embodiments, the renewable electricity may include solar energy, wind energy, geothermal energy, and/or hydro energy. For example only, the biofuel may contain biomass. Examples of the biomass include, without limitation, torrefied biomass, lignin, and/or pulverized biomass. Upgraded biomass can be produced by a thermochemical process such as torrefaction, which may be a mild pyrolysis process occurring at atmospheric pressure in the absence of oxygen. Torrefaction may increase the energy density of the biomass, reduce its moisture content, and make it hydrophobic and brittle. The fossil fuel alternative input may be produced from available biomass residues, or may be produced using renewable electricity. The processing of wood typically creates biomass residues such as bark, sticks, and fines. The amount of residue depends on the process, the wood type, and local conditions.

In some embodiments, pretreatment of the biomass residue may be conducted whether the residue is gasified, torrefied, or pulverized for fuel use. Pretreatment may reduce problems in the fuel feeding systems and improve the efficiency of the conversion or combustion processes. Undesired elements such as sand and metals may be removed to prevent problems in the equipment during processing. In some embodiments, the biomass pretreatment includes, but not limited to, drying, chipping, and grinding, in order to achieve the desired moisture content and particle size, which may vary according to the chosen conversion process.

In some embodiments, the hydrogen gas may be produced from water by using water electrolysis. Alkaline electrolyzers are commercially available technology and may be used in the hydrogen gas production. In an electrolyzer, water may be split into hydrogen and oxygen as shown in the following reaction:

$$2H_2O(l) \rightarrow 2H_2(g) + O_2(g)$$

In some embodiments, water electrolysis may be integrated with the hydrogen gas combustion in the lime kiln according to some embodiments.

In some embodiments, the indirect heating comprises calcining limestone using a heat input where a gaseous stream from the heat input is separate from the gaseous stream comprising more than about 30 vol % carbon dioxide. FIG. 1B is an illustrative example of indirect heating as the fossil fuel alternative input.

As illustrated in FIG. 1B, the heat input (shown as X in FIG. 1B) for providing the indirect heating to the limestone, may be any system where the fuel emissions from the heat input (e.g., the fuel emissions containing less than 25 vol % carbon dioxide or even less and containing other pollutants) are not allowed to mix with the gaseous emission from the limestone heating (comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity as provided herein)) and the limestone is exposed only to the heating. The heat input may be obtained using any fuel, such as but not limited to, fossil fuel, or fossil fuel alternative input, such as the biomass or the hydrogen gas fuel.

For example in some embodiments, the heat input may be implemented using a double-walled tube or pipe (e.g., X in FIG. 1B) or an array of double-walled tubes or pipes, where the space between the outer wall and the inner wall of the tube may comprise the fuel or the source that heats the inner wall of the tube or pipe. The emissions from the fuel or the heat source are collected separately (shown as <25 vol % $CO_2$ in FIG. 1B). The limestone is subjected to indirect heating in the space within the inner walls of the tube(s), and the gaseous stream from the heated or the calcined limestone may be collected separately (shown as >30 vol % $CO_2$ in FIG. 1B). The mixture comprising the lime obtained from the calcined limestone may be subjected to various processes illustrated in FIG. 1A or FIG. 1B and as described herein.

In some embodiments, there is provided a carbon dioxide sequestration process, comprising:

burning a fuel to generate heat and a first gaseous stream; and indirectly heating and calcining limestone using the heat from the heat input to form a mixture comprising lime and a second gaseous stream comprising more than about 30 vol % carbon dioxide, or more than 50 vol % carbon dioxide, or more than 80 vol % carbon dioxide, or more than 90 vol % carbon dioxide, or 100 vol % carbon dioxide, (or any concentration or purity), wherein the first gaseous stream from the heat input is separated from the second gaseous stream.

In some embodiments, the heat input may be fossil fuel input or fossil fuel alternative input. In some embodiments, the fossil fuel input, or the fossil fuel alternative, may be switched for grid load balancing and/or economic reasons. For example, fossil fuel may be used at lower utility electricity pricing periods such as night time, and fossil fuel alternative input may be used at higher utility electricity pricing periods, such as day time. In some embodiments, the fossil fuel alternative input may contain biomass and/or hydrogen gas.

In some embodiments, the first gaseous stream contains less than about 25 vol % carbon dioxide. In some embodiments, the first gaseous stream contains more than about 1% or more than about 20% of elements or compounds such as SOx, thermal NOx, carbon monoxide, metal, volatile organic matter, particulate matter, or a combination thereof.

In some embodiments, the process may further include treating a slipstream or whole of the mixture containing the lime, with atmospheric air, and allowing carbon dioxide from the atmospheric air to react with the mixture and form a composition containing calcium carbonate, calcium bicarbonate, or a combination thereof.

In some embodiments, the process further comprises treating a slipstream or whole of the mixture containing the lime, with natural water and allowing the dissolved carbon dioxide in the natural water to react with the mixture to form a composition containing calcium carbonate, calcium bicarbonate, or a combination thereof.

In some embodiments, the process further comprises treating a slipstream or whole of the mixture containing the lime with an N-containing salt solution to produce an aqueous solution containing calcium salt; and contacting the aqueous solution containing the calcium salt with the first gaseous stream comprising less than about 25 vol % carbon dioxide to produce a precipitate containing calcium carbonate.

In some embodiments, the process may further include disposing the second gaseous stream containing more than about 30 vol % carbon dioxide or more than 50 vol % carbon dioxide or more than 80 vol % carbon dioxide or more than 90 vol % carbon dioxide or 100 vol % carbon dioxide (or any concentration or purity) where the disposing may include cooling, compressing, and/or storing.

In some embodiments, storing may include geologically sequestering the second gaseous stream.

In some embodiments, the second gaseous stream containing more than about 30 vol % carbon dioxide or more than 50 vol % carbon dioxide or more than 80 vol % carbon dioxide or more than 90 vol % carbon dioxide or 100 vol % carbon dioxide (or any concentration or purity), contains no gaseous or non-gaseous components which would be otherwise produced from the combustion of fossil fuel.

In some embodiments, the second gaseous stream comprises between about 90-100 vol % carbon dioxide.

In some embodiments, the gaseous stream comprises about 99 vol % carbon dioxide.

Any lime kiln used in cement production may be replaced with a kiln that runs on a fossil fuel alternative input according to some of the present embodiments. Production of the lime by calcining the limestone may be carried out using various types of kilns running on fossil fuel alternative input, such as, but not limited to, a shaft kiln or a rotary kiln. The use of the electric kiln in the calcination and the advantages associated with it, have been described in U.S. application Ser. No. 17/363,537, filed Jun. 30, 2021, which is fully incorporated herein by reference in its entirety. The applicability of each of the fossil fuel alternative inputs may depend on local conditions, the price of the fossil fuel, and the price of electricity.

Substituting the fossil fuel used in a limestone kiln with a fossil fuel alternative input at the cement plant, especially if the lime and the $CO_2$ streams are used according to some of the present embodiments, may make the cement production operations nearly fossil fuel-free. Apart from fossil fuel-free operation, the integration of fossil fuel alternative input according to the present embodiments offers additional benefits such as increasing kiln capacity and production of byproducts (such as vaterite, described in some embodiments below).

The present embodiment systems for the calcining limestone are suitable for calcining the limestone in the form of lumps having diameters of several to tens of millimeters. Cement plant waste streams may include waste streams from both wet processes and dry processes, and different plants may employ shaft kilns, rotary kilns, electric kilns, or a combination thereof. Cement plants may also include precalciners, and all these components may run on the fossil fuel alternative inputs according to the present embodiments. Different plants may each burn a single fossil fuel alternative input or may burn two or more, same or different, fossil fuel alternative inputs sequentially or simultaneously.

According to some embodiments, the calcination of the limestone using fossil fuel alternative input, provides several advantages associated with the high purity and high concentration of the emitted carbon dioxide. In some embodiments, the calcination of the limestone using fossil fuel alternative input produces a gaseous stream containing more than 25 vol % carbon dioxide or more than 30 vol % carbon dioxide or more than 50 vol % carbon dioxide or more than 80 vol % carbon dioxide or more than 90 vol % carbon dioxide (or higher concentration or purity). In some embodiments, the calcination of the limestone using a fossil fuel alternative input results in a gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity), where the gaseous stream includes no gaseous or non-gaseous components which would be otherwise produced from the combustion of fossil fuel. In some embodiments, the carbon dioxide comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity), includes the carbon dioxide gas devoid of pollutants present in the emitted gas from the combustion of the fossil fuel. The pollutants caused by the combustion of fossil fuel may be gaseous pollutants, such as, but not limited to, SOx, NOx, carbon monoxide and/or any other non-carbon dioxide gas. Additionally, these pollutants caused by the combustion of fossil fuel may be non-gaseous pollutants, such as, but not limited to, metals, volatile organic matter, particulate matter, and/or dust. While the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity) comprises no gaseous or non-gaseous components caused by the combustion of the fossil fuel, it is to be understood that some gaseous or non-gaseous components described above may be present in the gaseous stream from the fossil fuel alternative processes but not gaseous or non-gaseous components that are produced by the combustion of fossil fuel. For instance, the gaseous stream may comprise one or more of the gaseous or the non-gaseous components obtained from decomposition or calcination of the limestone. As stated above, limestone may contain several impurities such as magnesium carbonate ($MgCO_3$), silica ($SiO_2$), alumina ($Al_2O_3$), iron (Fe), sulfur (S) or other trace elements or compounds. The decomposition of limestone may result in the formation of one or more components (gaseous or non-gaseous components) including SOx, carbon monoxide, metal, volatile organic matter, particulate matter, and combinations thereof. Some of the thermal NOx may also be formed by the oxidation of the molecular nitrogen present in the combusted air. One or more of these gaseous or non-gaseous components obtained from the decomposition or calcination of the limestone may be present in the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity). While some of the non-gaseous components obtained from the decomposition of the limestone may remain in the mixture containing lime, some gaseous or the non-gaseous components may be present in the gaseous stream. However, such gaseous or the non-gaseous components present in the gaseous stream would be in much lower or insignificant quantities compared to the carbon dioxide obtained from calcining limestone in a regular kiln combusting fossil fuel.

In some embodiments, calcining the limestone, using fossil fuel alternative input, produces less than 20% of at least one of the components including Sox, thermal NOx, carbon monoxide, metal, volatile organic matter, particulate matter, or a combination thereof, which are otherwise created from the combustion of the fossil fuel. In some embodiments, the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity) contains less than 20% of any of Sox, thermal NOx, carbon monoxide, metal, volatile organic matter, particulate matter, or a combination thereof. In some embodiments, the gaseous stream comprising more than 25 vol % carbon dioxide or more than 30 vol % carbon dioxide or more than 50 vol % carbon dioxide or more than 80 vol % carbon dioxide or more than 90 vol % carbon dioxide (or higher concentration or purity) comprises less than 20% or less than 18% or less than 15%, or less than 12% or less than 10%, or less than 8%, or less than 6%, or less than 5%, or less than 3%, or less than 2%, or less than 1% or between about 0-20% or between about 1-19% or between about 1-18% or between about 1-5% or between about 1-2% of any of SOx, thermal NOx, carbon monoxide, metal, volatile organic matter, particulate matter, or a combination thereof.

Due to the absence of the gaseous or the non-gaseous components from the combustion of the fossil fuel in the present embodiments, the carbon dioxide in the gaseous stream is of high purity and high concentration. For example, compared to a regular kiln which produces around or less than 25 vol % the $CO_2$ or around or less than 20 vol % of the $CO_2$, the present embodiments using the fossil fuel alternative input produce a gaseous stream comprising between about 25-100 vol % of the $CO_2$. In some embodiments, the gaseous stream obtained using a fossil fuel alternative input contains high purity and/or high concentration of between about 25-100 vol % carbon dioxide, or between about 25-95 vol % carbon dioxide, or between about 25-90 vol % carbon dioxide, or between about 25-80 vol % carbon dioxide, or between about 25-70 vol % carbon dioxide, or between about 25-60 vol % carbon dioxide, or between about 25-50 vol % carbon dioxide, or between about 25-40 vol % carbon dioxide, or between about 25-30 vol % carbon dioxide, or between about 30-100 vol % carbon dioxide, or between about 30-95 vol % carbon dioxide, or between about 30-90 vol % carbon dioxide, or between about 30-80 vol % carbon dioxide, or between about 30-70 vol % carbon dioxide, or between about 30-60 vol % carbon dioxide, or between about 30-50 vol % carbon dioxide, or between about 30-40 vol % carbon dioxide, or between about 40-100 vol % carbon dioxide, or between about 40-95 vol % carbon dioxide, or between about 40-90 vol % carbon dioxide; or between about 40-80 vol % carbon dioxide, or between about 40-70 vol % carbon dioxide, or between about 40-60 vol % carbon dioxide, or between about 40-50 vol % carbon dioxide, or between about 50-100 vol % carbon dioxide, or between about 50-95 vol % carbon dioxide, or between about 50-90 vol % carbon dioxide, or between about 50-80 vol % carbon dioxide, or between about 50-70 vol % carbon dioxide, or between about 50-60 vol % carbon dioxide, or between about 60-100 vol % carbon dioxide, or between about 60-95 vol % carbon dioxide, or between about 60-90 vol % carbon dioxide, or between about 60-80 vol % carbon dioxide, or between about 60-70 vol % carbon dioxide, or between about 70-100 vol % carbon dioxide, or between about 70-95 vol % carbon dioxide, or between about 70-90 vol % carbon dioxide, or between about 70-80 vol % carbon dioxide, or between about 80-100 vol % carbon dioxide, or between about 80-95 vol % carbon dioxide, or between about 80-90 vol % carbon dioxide, or between about 90-100 vol % carbon dioxide, or between about 90-95 vol % carbon dioxide, or about 99 vol % carbon dioxide.

In some embodiments, the gaseous stream obtained using the fossil fuel alternative input contains between about 80-100 vol % carbon dioxide, or between about 80-95 vol % carbon dioxide, or between about 80-90 vol % carbon dioxide, or between about 90-100 vol % carbon dioxide, or between about 90-95 vol % carbon dioxide, or about 99 vol % carbon dioxide, or about 99.9 vol % carbon dioxide, or between about 90-99.9 vol % carbon dioxide, or about 100 vol % carbon dioxide.

eEmbodiments that use fossil fuel alternative input offer several advantages, including but not limited to, the gaseous stream comprising more than 30 vol % carbon dioxide or more than 50 vol % carbon dioxide or more than 80 vol % carbon dioxide or more than 90 vol % carbon dioxide with substantially no pollutants or less pollutants or less than 1% pollutants or less than 5% pollutants or less than 20% pollutants, and high concentration of the carbon dioxide with more than 30 vol % $CO_2$ or between 30-100 vol % $CO_2$ in the gaseous stream, compared to a process of calcination of limestone using the fossil fuel that may produce around 20 vol % or less than 25 vol % or less than 20 vol % $CO_2$ and a greater amount of pollutants. In addition, these embodiments produce no impurities or substantially no impurities in the $CO_2$ that are generally from burning of coal (such as regular kiln), and bring about improved economics by reducing capex on equipment (e.g., no gas scrubber needed), and/or less or no sulfur or less than 5%, or less than 2%, or less than 1%, or less than 0.1% sulfur in the lime and thereby providing purer lime to be disposed on land for $CO_2$ capture from air or disposed in natural water for reaction with the dissolved carbon dioxide.

In some embodiments, the gaseous stream, obtained from using a fossil fuel alternative input, contains more than about 25 vol % carbon dioxide, or more than about 30 vol % carbon dioxide, or more than about 40 vol % carbon dioxide, or more than about 50 vol % carbon dioxide, or more than about 60 vol % carbon dioxide, or more than about 70 vol % carbon dioxide, or more than about 80 vol % carbon dioxide, or more than about 90 vol % carbon dioxide, or more than about 99 vol % carbon dioxide, or between about 30-99 or 30-100 vol % carbon dioxide, may be disposed.

It is to be understood that, while the gaseous stream from the calcination is depicted as more than 30 vol % carbon dioxide in FIGS. 1A and 1B for illustration purposes, higher percentages including and up to 100 vol % carbon dioxide are achievable in the present embodiments, and are well within the scope of these embodiments.

In various embodiments, the carbon dioxide in the gaseous stream, obtained from calcining limestone, may be disposed or stored in a variety of ways to prevent the emission of the carbon dioxide into the atmosphere. In some embodiments, the carbon dioxide is stored for future use in other products. In some embodiments, the carbon dioxide is disposed via injection into specific underground geological location. In some embodiments, the carbon dioxide is deposited into an underwater storage such as a seabed. In some embodiments, the carbon dioxide is stored in a long-term storage site, which may be underground, above ground, or underwater. In different embodiments, the duration of the carbon dioxide storage may vary from hours to centuries depending on a given situation or use. In some embodiments, where the carbon dioxide is of high concentration, it may be sequestered under the ground. Certain aspects of some of these embodiments are shown in FIG. 1 indicated as CCS (Carbon Capture and Storage) or CCUS (Carbon Capture, Utilization, and Storage).

Due to the high concentration of the carbon dioxide in the gaseous stream obtained from the calcination using fossil fuel alternative input according to the present embodiments, the CCS may not require separation and purification of the carbon dioxide gas before disposal, which is a significant cost saving.

In some embodiments, the disposing process may include, without limitation, cooling, compressing, and/or storing. For example, in some embodiments, the carbon dioxide is compressed and transported via a sequestration systems, such as pipelines, road transport, or ships, to a storage site where the carbon dioxide may be injected into a deep underground geological site for permanent storage. In some embodiments, possible storage sites for carbon dioxide may include saline aquifers or depleted oil and gas reservoirs, which may be e.g., 0.62 miles (1 km) or deeper under the ground.

Costs and energy needs may vary according to the type of technology and whether the captured $CO_2$ is going to be geologically stored or used immediately at low pressure. In some embodiments, $CO_2$ may need to be compressed under high pressure for it to be injected into geological formations. This step may require equipment such as a compressor. The captured $CO_2$ may be disposed by being injected deep underground for sequestration in certain geologic formations or used in various products and applications as described in various embodiments.

In some embodiments, the carbon benefit of use in products, or the net quantity of carbon that is durably stored, may depend on the product. For example only, use in products like concrete or plastic, may provide long-term sequestration (decades or even centuries). Various embodiments relate to the capture of the gaseous stream comprising more than 30 vol % carbon dioxide, or higher concentration, in the dissolution process. In some embodiments, jet fuel, a synthetic fuel produced with pure $CO_2$ formed in the according to the present embodiments, may be a substitute for emissions-intensive fossil fuel.

The present embodiments provide several advantages including reduction in the carbon footprint, amount of energy used, and/or amount of the $CO_2$ produced for sequestering the gaseous stream comprising more than 25 vol % CO2 or more than 50 vol % carbon dioxide or more than 80 vol % carbon dioxide or more than 90 vol % carbon dioxide (or higher concentrations) from fossil fuel alternative.

$CO_2$ Capture from Air

In some embodiments, a slipstream of the mixture or whole mixture comprising lime (I in FIG. 1A or 1B) obtained from the limestone calcination, is used to capture $CO_2$ directly or indirectly from atmospheric or ambient air (II in FIG. 1A or 1B) to reduce the amount of $CO_2$ in the air, and thereby reduce the greenhouse effect. The reaction taking place between the lime and the $CO_2$ in the air can be shown as below:

$$CaO+CO_2(g)\text{-->}CaCO_3(s)$$

$$Ca(OH)_2+CO_2(g)\text{-->}CaCO_3(s)+H_2O$$

As it is seen from these formulas, in these reactions, according to the present embodiments, some calcium bicarbonate may be formed. The $CO_2$ capture from the atmospheric air as a carbon removal option, provides several benefits, including but not limited to, limited land and water footprint and the viability of locating plants on non-arable land close to suitable storage, eliminating the need for long-distance $CO_2$ transport. The choice of location may also be based on the energy source needed to run the plant. For example only, the fossil fuel alternative input used for the limestone calcination may provide lower cost per ton of $CO_2$ captured from the atmospheric air.

In some embodiments, there is provided a carbon dioxide sequestration process, including calcining limestone feed using a fossil fuel alternative input to form a mixture comprising lime and a gaseous stream comprising more than 25 vol % carbon dioxide, or more than 30 vol % carbon dioxide, or more than 50 vol % carbon dioxide, or more than 80 vol % carbon dioxide, or more than 90 vol % carbon dioxide (or higher concentrations); and treating the mixture with atmospheric air and allowing carbon dioxide in the atmospheric air to react with the mixture and form a composition containing calcium carbonate, calcium bicarbonate, or combination thereof. In some embodiments, the process may further include cooling, compressing, and/or storing the gaseous stream comprising more than 25 vol % or more than 30 vol % carbon dioxide or more than 50 vol % carbon dioxide or more than 80 vol % carbon dioxide or more than 90 vol % carbon dioxide (or higher concentrations). In some embodiments, after the reaction of the mixture with the $CO_2$ in the air, the rest of the air is partially or fully devoid of the $CO_2$, thereby mitigating climate change.

The step of treating the mixture with the atmospheric air and allowing the carbon dioxide in the atmospheric air to react with the mixture, can be carried out in various ways in different embodiments. For example, in some embodiments, the mixture comprising lime is disposed on a stretch of land where the mixture is exposed to the atmospheric air, allowing the carbon dioxide in the atmospheric air to react with the mixture. For example, in some embodiments, the mixture is spread out on a sequestration system, such as a conveyer belt, where the lime reacts with the $CO_2$ in the atmospheric air to form the composition containing calcium carbonate, calcium bicarbonate, or a combination thereof, which may set and harden. In some embodiments, the hardened material may be broken into rocks or aggregates and used in construction material.

In some embodiments, the $CO_2$ in the atmospheric air after reaction with the mixture can be permanently stored in or on deep geological formations.

In some embodiments, the $CO_2$ in the atmospheric air is passed through the mixture containing lime (optionally under pressure) to allow the carbon dioxide in the atmospheric air to react with the mixture and form a composition containing calcium carbonate, calcium bicarbonate, or a combination thereof. In some embodiments, the atmospheric air may be pushed through a filter to capture the $CO_2$, and then treated with the mixture. In some embodiments, the stored $CO_2$ in the composition containing calcium carbonate, calcium bicarbonate, or a combination thereof, may be regenerated by calcining the composition, and thereby regenerating a gaseous stream comprising more than 50 vol % or more than 90 vol % $CO_2$, and disposing the gaseous stream as described in various embodiments. This process in turn produces a mixture comprising lime which may then be used again to capture carbon dioxide from the air. This process may be repeated any number of times to capture the carbon dioxide in the air.

In some embodiments, there is provided a carbon dioxide sequestration process, including calcining limestone using a fossil fuel alternative input to form a mixture comprising lime and a gaseous stream containing more than 20 vol % carbon dioxide, or more than 25 vol % carbon dioxide, or more than 30 vol % carbon dioxide, or more than 50 vol % carbon dioxide, or more than 80 vol % carbon dioxide, or more than 90 vol % carbon dioxide (or the higher concentrations);

treating a slip stream or whole of the mixture with the atmospheric air and allowing the carbon dioxide in the atmospheric air to react with the mixture and form a composition containing calcium carbonate, calcium bicarbonate, or a combination thereof, and calcining or heating the composition using a fossil fuel alternative input to form a mixture containing lime and the gaseous stream with more than 20 vol % carbon dioxide, or more than 25 vol % carbon dioxide, or more than 30 vol % carbon dioxide, or more than 50 vol % carbon dioxide, or more than 80 vol % carbon dioxide, or more than 90 vol % carbon dioxide (or higher concentrations).

In some embodiments, the sequestration process further includes disposing the gaseous stream. In some embodiments, the sequestration process further includes reusing the mixture to capture the carbon dioxide in the atmospheric air.

$CO_2$ Capture from Natural Water

In some embodiments, a slipstream of the mixture or whole of the mixture that includes lime(I in FIG. 1A or 1B) obtained from the limestone calcination in the processes, is used to capture $CO_2$ directly or indirectly from natural water (III in FIG. 1A or 1B) to reduce the dissolved $CO_2$ in the natural water and thereby to mitigate the greenhouse effect. The term "natural water", as used in various embodiments, includes any natural body of water. Examples include, without limitation, ocean or ocean water, lake, river, rivulet, and the like. The "ocean water" or "ocean" or "sea water" all include water from the ocean or the sea. The reaction taking place between the lime and the dissolved $CO_2$ in natural water may be shown as below:

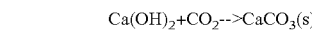

$$CaO+CO_2 \rightarrow CaCO_3(s)$$

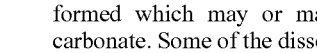

$$Ca(OH)_2+CO_2 \rightarrow CaCO_3(s)+H_2O$$

In these reactions, some calcium bicarbonate may be formed which may or may not transform into calcium carbonate. Some of the dissolved $CO_2$ may be in the form of carbonic acid.

The process of capturing $CO_2$, directly or indirectly from the natural water, as described in these embodiments, provide the potential for offshore deployments that offer a variety of useful benefits such as reducing competition for land, allowing access to oceanic $CO_2$ storage sites currently only reachable by pipeline, and a direct reversal of ocean acidification caused by anthropogenic $CO_2$ emissions.

Some embodiments provide a carbon dioxide sequestration process, including calcining limestone feed using a fossil fuel alternative input to form a mixture comprising lime and a gaseous stream comprising more than 25 vol % carbon dioxide, or more than 30 vol % carbon dioxide, or more than 50 vol % carbon dioxide, or more than 80 vol % carbon dioxide, or more than 90 vol % carbon dioxide (or higher concentrations), and treating the mixture with natural water and allowing carbon dioxide in the natural water to react with the mixture and form calcium carbonate, calcium bicarbonate, or a combination thereof. In some embodiments, the process further includes disposing the gaseous stream, such as, cooling, compressing, and/or storing the gaseous stream comprising more than 25 vol % carbon dioxide, or more than 30 vol % carbon dioxide, or more than 50 vol % carbon dioxide, or more than 80 vol % carbon dioxide, or more than 90 vol % carbon dioxide (or higher concentrations), as described in the present embodiments. In some embodiments, after the reaction of the mixture comprising lime with the $CO_2$ from the natural water, the rest of the natural water is partially or fully devoid of the $CO_2$, thereby mitigating climate change.

In some embodiments, treating the mixture in the natural water is done by sequestering the mixture directly in the natural water. In some embodiments, the mixture is transported using pipes, tanks, and/or ships to sequester the mixture in the natural water, such as, but not limited to, lakes, rivers, and oceans, where the mixture captures the $CO_2$ in the natural water and forms calcium carbonate, calcium bicarbonate, or a combination thereof. In some embodiments, the calcium carbonate, the calcium bicarbonate, or the combination thereof, settles at the bottom of the natural body of water. In some embodiments, the calcium carbonate, the calcium bicarbonate, or the combination thereof, forms coral reef in the natural water.

In some embodiments, the calcium carbonate, the calcium bicarbonate, or the combination thereof, formed according to the present embodiments, is pH neutral.

In some embodiments, treating the mixture with the natural water includes blending the mixture with cooling natural water at power plant and sequestering the blend back into natural water. In some embodiments, a calcining plant is integrated with a power plant such that the mixture from the calcining plant is blended with the natural water that is being used to cool the power plant. The natural water may be sequestered back in the body of water along with the mixture and form the calcium carbonate, the calcium bicarbonate, or a combination thereof in the body of water such as an ocean, thereby capturing the $CO_2$ from the natural water.

In some embodiments, the natural water is ocean water and treating the mixture with the ocean water involves blending the mixture with concentrated salt water from the ocean at a desalination plant and sequestering the blend back into the ocean. In some embodiments, a calcining plant is integrated with the desalination plant such that the mixture from the calcining plant is blended with the concentrated salt water from the ocean (obtained after the desalination of the ocean water) from the desalination plant. The concentrated salt water may be sequestered back in the ocean along with the mixture forming calcium carbonate, calcium bicarbonate, or a combination thereof in the ocean, thereby capturing the $CO_2$ from the ocean water.

Dissolution Process

In one aspect, a slipstream of the mixture or whole of the mixture that includes lime (I in FIG. 1A or 1B) obtained from the limestone calcination according to the present embodiments, is subjected to a dissolution process where the mixture is treated with an N-containing salt solution to produce an aqueous solution containing calcium salt, and the aqueous solution with the calcium salt is contacted with the gaseous stream of carbon dioxide or a slip stream thereof, to produce a precipitate containing calcium carbonate. In some embodiments, the carbon dioxide captured in the dissolution process can be clean or pure carbon dioxide having more than 25 vol % carbon dioxide, or more than 30 vol % carbon dioxide, or more than 50 vol % carbon dioxide, or more than 80 vol % carbon dioxide, or more than 90 vol % carbon dioxide, (or higher concentrations) obtained from the calcination process according to various embodiments (using fossil fuel alternative input) and/or in some embodiments, the carbon dioxide captured in the dissolution process is obtained from a cement plant using conventional calcining kiln (using fossil fuel) and producing impure or less than 25 vol % carbon dioxide, or less than 20 vol % carbon dioxide.

It is to be understood that the dissolution process (FIG. 1A or 1B and the processes illustrated in FIGS. 2-4) can be carried out on itself, or in combination with $CO_2$ capture from the air process (II in FIG. 1A or 1B), or $CO_2$ capture from the natural water (FIG. 1A or 1B), or a combination thereof. Any such combination can be carried out as shown in Table I below.

TABLE I

| | $CO_2$ capture from air | $CO_2$ capture from natural water | Dissolution process |
|---|---|---|---|
| A stream of mixture comprising lime | X | | |
| | | X | |
| | | | X |
| | X | | X |
| | X | X | |
| | | X | X |
| | X | X | X |

In some embodiments, a slip stream of the mixture containing lime (FIG. 1A or 1B) obtained from the limestone calcination, is subjected to a dissolution process where the mixture is treated with an N-containing salt solution to produce an aqueous solution containing calcium salt, and the aqueous solution containing calcium salt is contacted with the gaseous stream comprising more than 25 vol % carbon dioxide, or more than 30 vol % carbon dioxide, or more than 50 vol % carbon dioxide, or more than 80 vol % carbon dioxide, or more than 90 vol % carbon dioxide, (or higher concentrations as provided) or a slip stream thereof (using fossil fuel alternative input), to produce a precipitate containing calcium carbonate.

Figure 2:
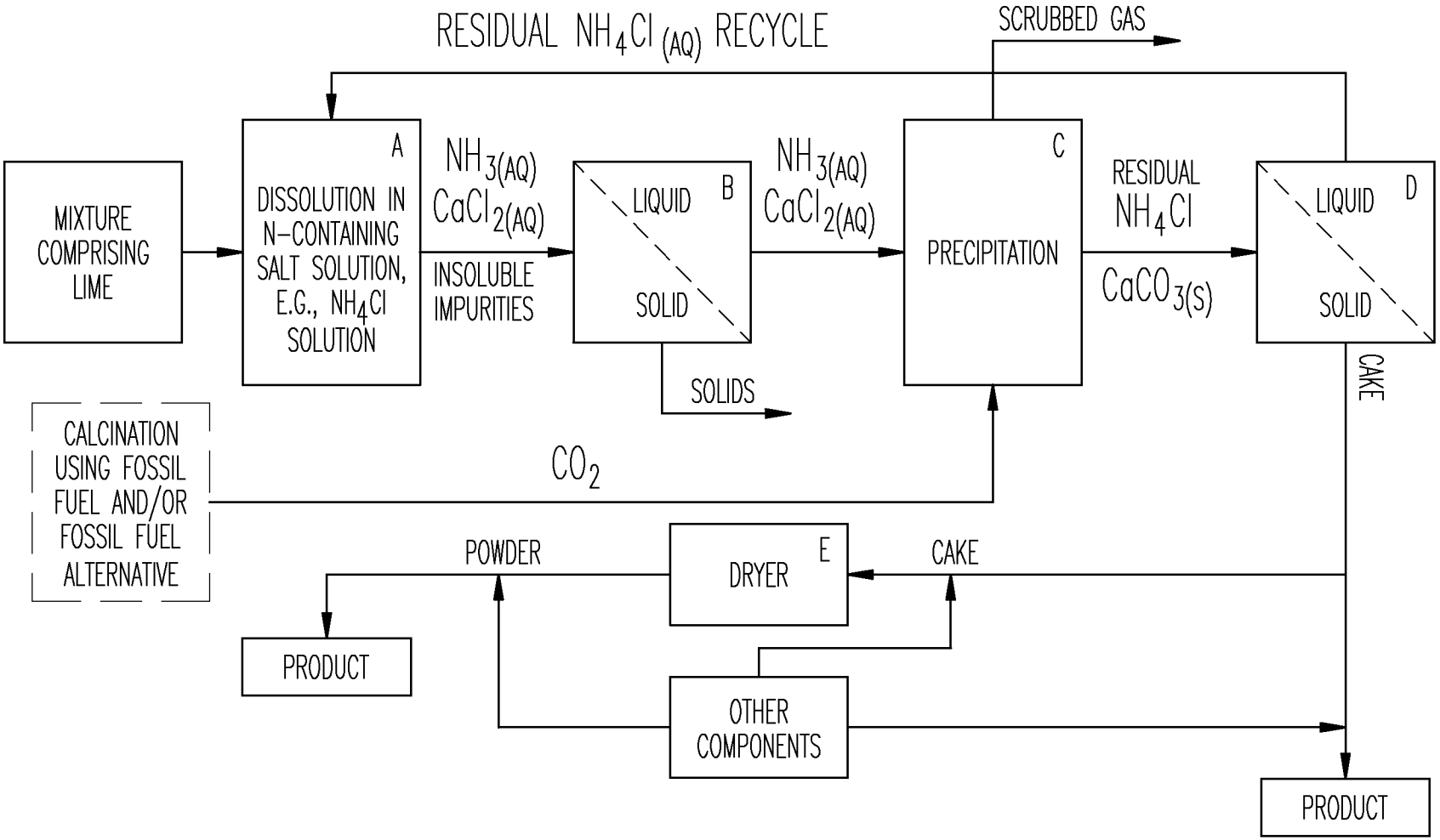
FIG. 2 illustrates some process and system embodiments provided herein.
Figure 3:
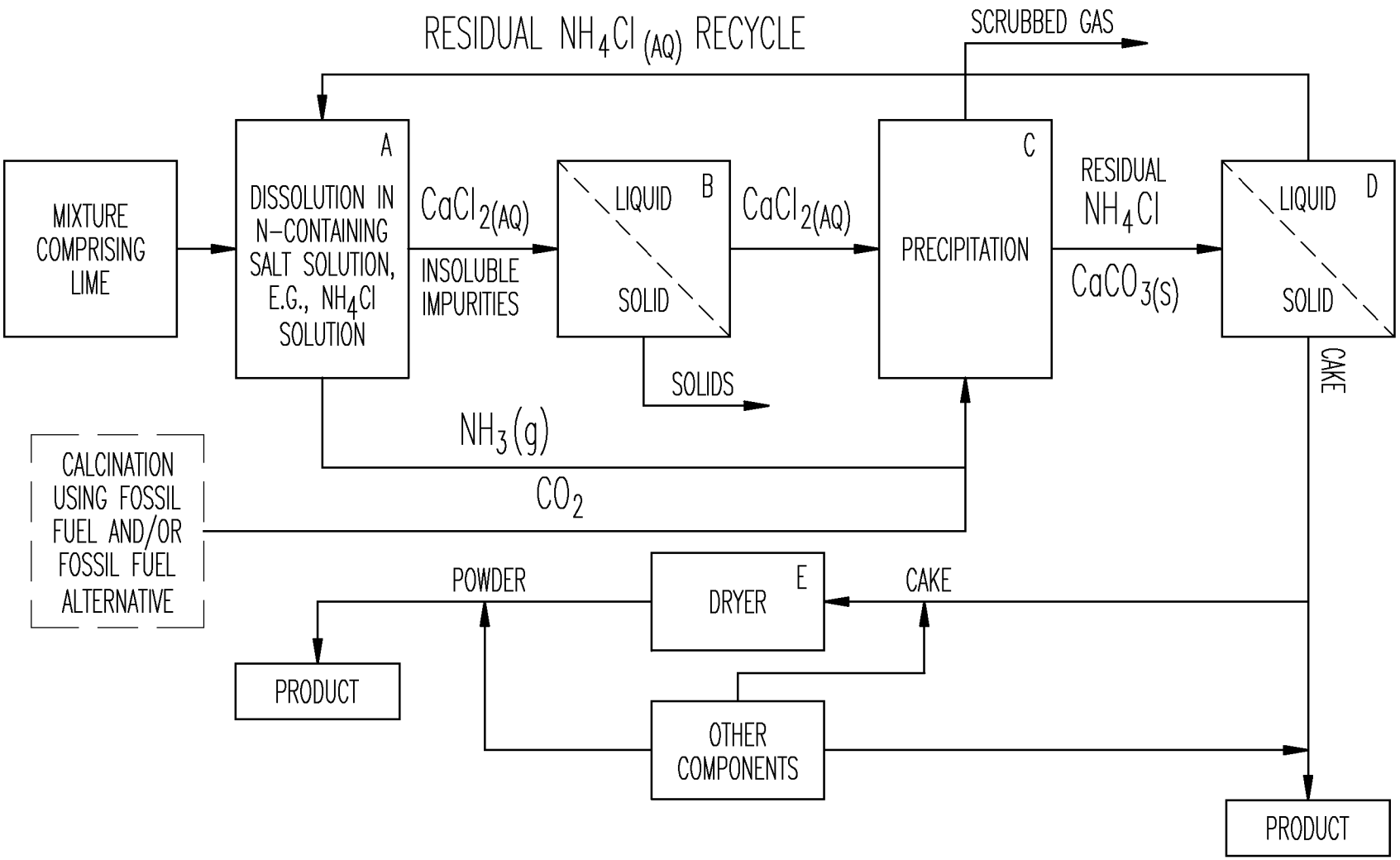
FIG. 3 illustrates some process and system embodiments provided herein.
Figure 4:
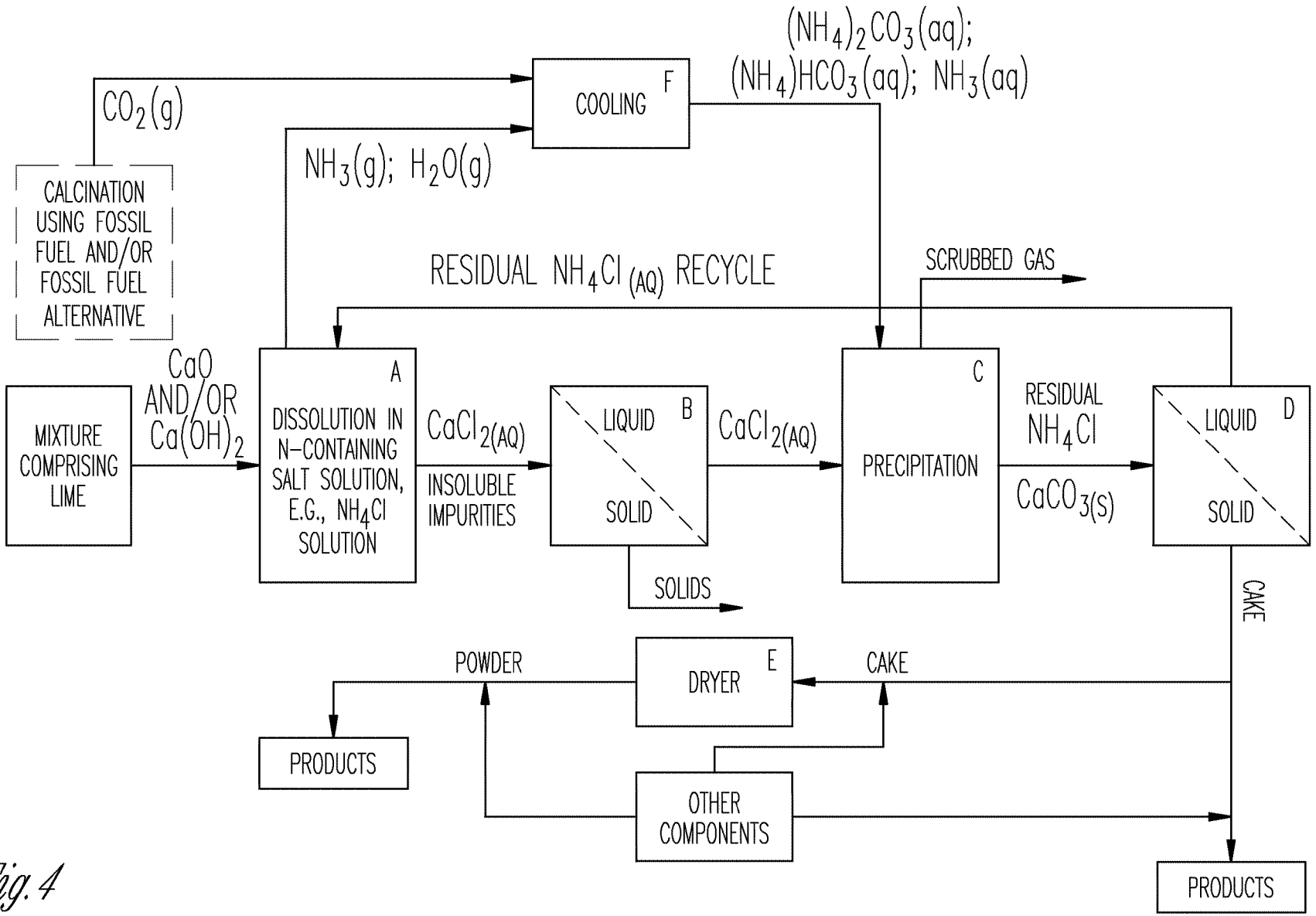
FIG. 4 illustrates some process and system embodiments provided herein.

In some embodiments, a slip stream of the mixture containing lime (FIG. 1A or 1B), is subjected to a dissolution process where the mixture is treated with an N-containing salt solution to produce an aqueous solution containing calcium salt, and the aqueous solution comprising calcium salt is contacted with a gaseous stream containing less than 25 vol % carbon dioxide or a slip stream thereof (from a fossil fuel), to produce a precipitate containing calcium carbonate. Some of these embodiments involving the dissolution process, are illustrated in FIGS. 2-4. FIG. 2 is an illustration of some embodiments. It indicates mixture 202 containing lime, dissolution 210 in an N-containing salt, solid/liquid separation 220, precipitation 230 along with calcination 204 products, and solid/liquid separation 240 where a cake may be used to build product 250 either directly, or product 280 after going through dryer 260 with additional components 270. FIG. 3 is an illustration of some embodiments in which indicates mixture 302 containing lime, dissolution 310 in an N-containing salt, solid/liquid separation 320, precipitation 330 along with calcination 304 products, and solid/liquid separation 340 where a cake may be used to build product 350 either directly, or product 380 after going through dryer 360 with additional components 370. FIG. 4 is an illustration of some embodiments in which indicates mixture 402 containing lime, dissolution 410 in an N-containing salt, either through cooling 480 or solid/liquid separation 420, onto precipitation 430 along with calcination 404 products after cooling 480, and solid/liquid separation 440 where a cake may be used to build product 452 either directly, or product 454 after going through dryer 460 with additional components 470.

Dissolution in N-Containing Salt Solution

In some embodiments, the mixture containing lime is treated with a solubilizer, such as an N-containing salt, to improve its solubility to produce an aqueous solution containing calcium salt 210, 310, and 410 in FIGS. 2-4. In some embodiments, the aqueous solution containing calcium salt further contains solids, as will be further described. In some embodiments, the aqueous solution containing calcium salt further contains ammonia and/or an N-containing salt. For example, in some embodiments, the aqueous solution containing calcium salt further contains ammonia and/or ammonium salt. For example, in some embodiments, the aqueous solution containing calcium chloride further contains ammonia and/or ammonium chloride (when the N-containing salt is ammonium chloride).

In some embodiments, a lime slurry obtained from a wet process cement plant may be optionally subjected to a dewatering step (not shown in the figures) where the residual water may be removed, and the dewatered residue may be subjected to further treatment such as dissolution with an N-containing salt. For illustration purposes only, the N-containing salt solution is illustrated in the figures as ammonium chloride ($NH_4Cl$) solution and the subsequent calcium salt is illustrated as calcium chloride ($CaCl_2$)). Various examples of N-containing salts have been provided in various embodiments and are all within the scope of the present embodiments.

In various embodiments, the N-containing salt is an N-containing inorganic salt, or an N-containing organic salt, or a combination thereof. The term "N-containing salt" as used in various embodiments, is a salt that partially, or fully, or substantially, solubilizes or dissolves the calcium compound from the mixture containing lime. The calcium compound may be calcium oxide, calcium hydroxide, any other derivative of calcium, or combinations thereof.

An "N-containing inorganic salt", as used in various embodiments, may include any inorganic salt containing nitrogen. Examples of an N-containing inorganic salt may include, but are not limited to, ammonium halide (halide is any halogen), ammonium acetate, ammonium sulfate, ammonium sulfite, ammonium nitrate, ammonium nitrite, and the like. In some embodiments, the ammonium halide is ammonium chloride or ammonium bromide. In some embodiments, the ammonium halide is ammonium chloride. Such chemicals may be commercially available.

An "N-containing organic salt" as used in various embodiments, may include any salt of an organic compound containing nitrogen. Examples of N-containing organic compounds may include, but are not limited to, aliphatic amine, alicyclic amine, heterocyclic amine, and combinations thereof. Such chemicals may be commercially available.

The "aliphatic amine" as used in various embodiments, ma include any alkyl amine of formula $(R)_n$—$NH_{3-n}$ where n is an integer from 1-3, and R is independently between C1-C8 linear or branched and substituted or unsubstituted alkyl. Examples of corresponding salt of the alkyl amine of formula $(R)_n$—$NH_{3-n}$ are $(R)_n$—$NH_{4-n}^+Cl^-$ and $(R)_n$—$NH_{4-n}^+Br^-$. In some embodiments, when R is a substituted alkyl, the substituted alkyl is independently substituted with halogen, hydroxyl, acid and/or ester.

In some embodiments, when R is an alkyl in $(R)_n$—$NH_{3-n}$, the alkyl amine may be a primary alkyl amine, such as, for example only, methylamine, ethylamine, butylamine, pentylamine, etc. The alkyl amine may be a secondary amine, such as for example only, dimethylamine, diethylamine, methylethylamine, etc. The alkyl amine may also be a tertiary amine, such as for example only, trimethylamine, triethylamine, etc.

In some embodiments, when R is substituted alkyl substituted with hydroxyl in $(R)_n$—$NH_{3-n}$, the substituted alkyl amine may be an alkanolamine including, but not limited to, monoalkanolamine, dialkanolamine, or trialkanolamine, such as monoethanolamine, diethanolamine, or triethanolamine, etc.

In some embodiments, when R is substituted alkyl substituted with halogen in $(R)_n$—$NH_{3-n}$, the substituted alkyl amine may be, for example, chloromethylamine, bromomethylamine, chloroethylamine, bromoethylamine, etc.

In some embodiments, when R is substituted alkyl substituted with acid in $(R)_n$—$NH_{3-n}$, the substituted alkyl amine may be, for example, an amino acid. In some embodiments, the aforementioned amino acid may have a polar uncharged alkyl chain, examples of which may include, without limitation, serine, threonine, asparagine, glutamine, or combinations thereof. In some embodiments, the aforementioned amino acid has a charged alkyl chain, examples of which may include, without limitation, arginine, histidine, lysine, aspartic acid, glutamic acid, or combinations thereof. In some embodiments, the aforementioned amino acid may be glycine, proline, or combination thereof.

The term "alicyclic amine", as used in various embodiments, may include any alicyclic amine of formula $(R)_n$—$NH_{3-n}$ where n is an integer from 1-3, where R is independently one or more all-carbon rings which may be either saturated or unsaturated, without having aromatic characters. Alicyclic compounds may have one or more aliphatic side chains attached.

An example of a corresponding salt of the alicyclic amine of formula $(R)_n$—$NH_{3-n}$ is $(R)_n$—$NH_{4-n}^+Cl^-$. Examples of alicyclic amine may include, without limitation, cycloalkylamine: cyclopropylamine, cyclobutylamine, cyclopentylamine, cyclohexylamine, cycloheptylamine, cyclooctylamine, and so on.

The term "heterocyclic amine", as used in various embodiments, includes at least one heterocyclic aromatic ring attached to at least one amine. Examples of heterocyclic rings may include, without limitation, pyrrole, pyrrolidine, pyridine, pyrimidine, etc. Such chemicals may be commercially available.

In various embodiments, the mixture containing lime, is treated or dissolved or solubilized with an N-containing salt, such as aqueous ammonium chloride solution (step A in FIGS. 2-4) under one or more dissolution conditions, to produce an aqueous solution containing calcium salt. The "treating" or "solvating" or "solubilizing" or any grammatical equivalents may be used interchangeably and include solubilization of the mixture containing lime in the aqueous medium.

As illustrated in step A of FIGS. 2-4, the N-containing salt is exemplified as ammonium chloride ($NH_4Cl$). It is to be understood that $NH_4Cl$ is for illustration purposes only and that any other N-containing salt including any other ammonium salt can be used in the present embodiments. One or more steps may be omitted or modified, or the order of the steps may be changed. The lime containing calcium oxide is solvated or solubilized by treatment with the N-containing inorganic salt, e.g., $NH_4Cl$ (new and recycled as further explained below) and the reaction that may occur is:

$$CaO(s)+2NH_4Cl(aq)\rightarrow NH_3(aq)+CaCl_2(aq)+H_2O(l)$$

Similarly, when the base is an N-containing organic salt, the reaction may be shown as below:

$$CaO(s)+2NH_3RCl\rightarrow CaCl_2(aq)+2NH_2R+H_2O(l)$$

In some embodiments, the N-containing salt such as, but not limited to, ammonium chloride solution may be supplemented with anhydrous ammonia, or an aqueous solution of ammonia, to maintain an optimum level of ammonium ions in the solution.

In some embodiments, the amount of the N-containing salt is in 20% excess, or 30% excess, to the mixture containing lime. In some embodiments, the N-containing salt is in a molar ratio of between 0.5:1 to 4:1 by weight (N-containing salt:mixture, or N-containing inorganic salt: mixture, or N-containing organic salt:mixture, or ammonium chloride:mixture) or 0.5:1 to 3:1, or 0.5:1 to 2:1, or 0.5:1 to 1.5:1, or 1:1 to 1.5:1, or 2:1 to 4:1, or 2:1 to 3:1, or 2.5:1 to 3:1, or 3:1 to 4:1, or 1.5:1, or 2:1, or 2.5:1, or 3:1, or 3.5:1, or 4:1 by weight with the mixture containing lime. In some embodiments, the aforementioned ratios are molar ratios or wt % ratios.

In some embodiments of the processes described herein, no polyhydroxy compounds are used to form the precipitation material and/or the products according to the embodiments.

In some embodiments, one or more dissolution conditions are selected including a temperature between about 20-200° C., or between about 20-150° C., or between about 20-100° C., or between about 20-75° C., or between about 20-50° C., or between about 20-30° C., or between about 30-200° C., or between about 30-150° C., or between about 30-100° C., or between about 30-75° C., or between about 30-50° C., or between about 30-40° C., or between about 40-200° C., or between about 40-150° C., or between about 40-100° C., or between about 40-75° C., or between about 40-50° C., or between about 50-200° C., or between about 50-150° C., or between about 50-100° C.; and a pressure between about 0.5-50 atm, or between about 0.5-10 atm, or between about 0.5-20 atm; and an N-containing inorganic or organic salt wt % in water between about 0.5-50%, or between about 0.5-25%, or between about 0.5-10%; or combinations thereof.

Agitation may be used in some embodiments to effect the treatment of the lime, for example, by eliminating hot and cold spots. In some embodiments, the concentration of the lime in water may be between 1 and 10 g/L, 10 and 20 g/L, 20 and 30 g/L, 30 and 40 g/L, 40 and 80 g/L, 80 and 160 g/L, 160 and 320 g/L, 320 and 640 g/L, or 640 and 1280 g/L. To optimize the purification/solvation of the calcium oxide, high shear mixing, wet milling, and/or sonication may be used to break open the calcium oxide according to some embodiments.

Processing of the Solid

In some embodiments, the solid in the mixture containing lime (obtained from the limestone impurities and/or from the decomposition of the limestone, as explained above) further gets processed and may be present as insoluble or partially soluble impurities in an aqueous solution containing calcium salt. In some embodiments, the solid may or may not be removed from the aqueous solution containing calcium salt before the aqueous solution is treated with the carbon dioxide in the process. The solid may optionally be removed from the aqueous solution by filtration and/or centrifugation techniques. In some embodiments, the solid may not be removed from the aqueous solution and the aqueous solution containing calcium salt as well as the solid is contacted with the carbon dioxide in step C to form the precipitate. In such embodiments, the precipitation material further contains solid.

In some embodiments, the solid (shown as solid in FIGS. 2-4) is a calcium depleted solid and may be used as a cement substitute (such as a substitute for Portland cement). In some embodiments, the solid may include impurities carried over from the limestone and/or the limestone decomposition and include, but not limited to, silicate, iron oxide, aluminum oxide, other particulate matter, and combinations thereof. In some embodiments, the solid in the precipitation material containing vaterite, aragonite, calcite, or combination thereof, when mixed with OPC provides pozzolanic phases and enhances binding with the cement.

In some embodiments, the solid is between about 1-80 wt %, or between about 1-70 wt %, or between about 1-60 wt %, or between about 1-50 wt %, or between about 1-40 wt %, or between about 1-30 wt %, or between about 1-20 wt %, or between about 1-10 wt % or between about 1-5 wt %, or between about 1-2 wt %, in the aqueous solution containing calcium salt, in the precipitation material, in the vaterite composition, or combination thereof.

Contacting the Aqueous Solution with the $CO_2$

The aqueous solution containing calcium salt may further be treated with carbon dioxide in various embodiments. In embodiments where the gaseous stream containing more than 25 vol % carbon dioxide, or more than 30 vol % carbon dioxide, or more than 50 vol % carbon dioxide, or more than 80 vol % carbon dioxide, or more than 90 vol % carbon dioxide, (or higher concentrations as provided) is sequestered for storage or for disposal (as described above). The aqueous solution containing calcium salt may be treated with the carbon dioxide (e.g., the gaseous stream containing less than 25 vol % carbon dioxide) from a power plant or from a cement plant or from any other commercial process.

The high purity (less pollutants) and the high concentration of the $CO_2$ (more than 50 vol % carbon dioxide, or more than 80 vol % carbon dioxide, or more than 90 vol % carbon dioxide or higher concentrations as provided, in the gas stream compared to the calcination of the limestone using a conventional kiln that produces less than 25 vol %, or around 20%, or less than 20% polluted $CO_2$) results in considerable savings due to the fact that less or no gas circulation is needed for absorption. In some embodiments, no scrubbing of the $CO_2$ is needed before absorbing the $CO_2$ in a contacting/absorption reactor. Some embodiments, provide for zero emission processes when all of the $CO_2$ emitted during calcination of the limestone using the fossil fuel alternative input is either sequestered for storage or disposal or is utilized in product manufacturing, with no $CO_2$ emitted into the atmosphere providing close to 95% to 100% $CO_2$ capture. In some embodiments, due to high purity and high concentration of the $CO_2$, the process is more than 40%, or more than 50%, or more than 60%, or more than 70%, or more than 80%, or more than 90%, or around 95%, or around 99%, effective in capturing $CO_2$ when compared to a process using a conventional kiln running on fossil fuel.

Some embodiments, due to providing high purity and the high concentration of the $CO_2$, have several advantages, such as, without limitation, reduced blower power needed resulting in reduced blower capex, reduced ductwork capex, greater absorber depth if desired, which translates into higher capacity per footprint, smaller absorber vessel resulting in capex savings, reduction in absorber stirring requirements (related to volume), and reduction in absorber vent scrubbing and ammonia loss where small purge may be required.

Due to the presence of more than 25 vol % $CO_2$, or more than 30 vol % $CO_2$, (or higher purity) in the gaseous stream, the present embodiments require less gas re-circulation, no scrubber, no absorber vents, less blower power, less blower capex, and/or less ductwork capex, etc. improving the economics and the efficiency of the system.

In some embodiments, the aqueous solution containing calcium salt is contacted with the gaseous stream containing carbon dioxide, under one or more precipitation conditions, to produce a precipitation product containing vaterite, aragonite, calcite, or a combination thereof.

In some embodiments a portion of the carbon dioxide is sequestered for storage or disposal, and the remaining portion of the carbon dioxide (e.g., a slip stream) is contacted with an aqueous solution containing a calcium salt, under one or more precipitation conditions, to produce a precipitation product containing vaterite, aragonite, calcite, or combination thereof.

As illustrated in step C in FIGS. 2-4, the following reaction may take place when an aqueous solution containing calcium salt (and optionally containing solids, ammonia, and/or an N-containing salt) is contacted with the carbon dioxide, obtained from the calcination using a fossil fuel alternative input and/or the calcination using the fossil fuel input, under one or more precipitation conditions, to produce the precipitation material containing calcium carbonate including vaterite, aragonite, calcite, or a combination thereof.

$$CaCl_2(aq)+2NH_3(aq)+CO_2(g)+H_2O \rightarrow CaCO_3(s)+2NH_4Cl(aq)$$

The term "contacting", may be used interchangeably with "absorption" or "precipitation"
in the present embodiments.

The absorption of the $CO_2$ in the aqueous solution containing calcium salt in the present embodiments, produces $CO_2$-charged water containing carbonic acid, a species in equilibrium with both bicarbonate and carbonate. The precipitation material is prepared under one or more precipitation conditions suitable to form calcium carbonate containing vaterite, aragonite, calcite, or a combination thereof or the PCC material.

In some embodiments, the process further contains removing and optionally recovering a gaseous stream containing ammonia during the dissolution process.

Certain aspects of various embodiments are illustrated in FIG. 3, where the gaseous stream containing $CO_2$ obtained from the calcination, and the gaseous stream containing $NH_3$, obtained from the dissolution, are recirculated to the contacting/absorption reactor for the formation of the precipitation material. The remaining steps of FIG. 3 are identical to the steps of FIG. 2. It is to be understood that the processes of both FIG. 2 and FIG. 3 may also take place simultaneously such that the N-containing salt, including an N-containing inorganic salt or an N-containing organic salt, and optionally the ammonia, may be partially present in the aqueous solution and partially present in the gaseous stream.

The reaction taking place in the contacting reactor in these embodiments may be shown as below:

$$CaCl_2(aq)+2NH_3(g)+CO_2(g)+H_2O \rightarrow CaCO_3(s)+2NH_4Cl(aq)$$

In some embodiments, the gaseous stream containing ammonia may have supplemental ammonia from an external source and/or is recovered and re-circulated only from the dissolution in an N-containing salt.

In some embodiments, the dissolution of the mixture containing lime with some of the N-containing organic salt in may not result in the formation of the ammonia gas, or the amount of ammonia gas formed may not be substantial. In these embodiments, the processes illustrated in FIG. 2 where the aqueous solution containing calcium salt is treated with the carbon dioxide gas are applicable. In such embodiments, the organic amine salt may remain in the aqueous solution in fully or partially dissolved state or may be separated as an organic amine layer, as shown in the reaction below:

$$CaO(s)+2NH_3R^+Cl^- \rightarrow CaCl_2)(aq)+2NH_2R+H_2O$$

The N-containing organic salt or the N-containing organic compound, remaining in the supernatant solution after the precipitation, may be referred to as residual N-containing organic salt or residual N-containing organic compound. Various embodiments describe how to recover these residual compounds from the precipitate as well as the supernatant solution.

Some embodiments further include recovering the gaseous stream containing carbon dioxide and the gaseous stream containing ammonia, and subjecting the gaseous streams to a cooling process under one or more cooling conditions, to condense a second aqueous solution containing ammonium bicarbonate, ammonium carbonate, ammonium carbamate, ammonia, or combination thereof. In some embodiments, the processes further includes treating the aqueous solution containing calcium salt with the second aqueous solution under one or more precipitation conditions, to form the precipitation material.

Some aspect of these embodiments are illustrated in FIG. 4, where the gaseous stream containing $CO_2$ from the calcination, and the gaseous stream containing $NH_3$ are recirculated to the cooling reactor for the formation of the carbonate and bicarbonate solutions as shown in the reactions below. The remaining steps of FIG. 4 may be identical to the steps of FIGS. 2 and 3.

In some embodiments, the gaseous stream containing $CO_2$ and/or the gaseous stream containing $NH_3$ further contains water vapor. In some embodiments, the gaseous stream containing $CO_2$ and/or the gaseous stream containing $NH_3$ further comprise between about 20-90%, or between about 20-80%, or between about 20-70%, or between about 20-60%, or between about 20-55%, or between about 20-50%, or between about 20-40%, or between about 20-30%, or between about 20-25%, or between about 30-90%, or between about 30-80%, or between about 30-70%, or between about 30-60%, or between about 30-50%, or between about 30-40%, or between about 40-90%, or between about 40-80%, or between about 40-70%, or between about 40-60%, or between about 40-50%, or between about 50-90%, or between about 50-80%, or between about 50-70%, or between about 50-60%, or between about 60-90%, or between about 60-80%, or between about 60-70%, or between about 70-90%, or between about 70-80%, or between about 80-90%, water vapor.

In some embodiments, no external water is added to the cooling process. It is to be understood that the cooling process may be similar to condensation of the gases (but may not be similar to the absorption of the gases) in the existing water vapors, such that the gases are not absorbed in the water but are, as such, cooled down together with the water vapors.

Condensation of the gases into a liquid stream may provide process control advantages compared to absorbing the vapors. For example only, condensation of the gases into the liquid stream may allow pumping of the liquid stream into the precipitation step. Pumping of the liquid stream may be lower in cost than compression of a vapor stream into the absorption process.

Intermediate steps in the cooling reaction/reactor may include the formation of ammonium carbonate and/or ammonium bicarbonate by reactions as below in some embodiments:

$$2NH_3+CO_2+H_2O\rightarrow(NH_4)_2CO_3$$

$$NH_3+CO_2+H_2O\rightarrow(NH_4)HCO_3$$

Similar reactions may be shown for the N-containing organic salt:

$$2NH_2R+CO_2+H_2O\rightarrow(NH_3R)_2CO_3$$

$$NH_2R+CO_2+H_2O\rightarrow(NH_3R)HCO_3$$

The second aqueous solution containing ammonium bicarbonate, ammonium carbonate, ammonium carbamate, ammonia, or a combination thereof (exiting the cooling reaction/reactor F in FIG. 4) is then treated with the aqueous solution containing calcium salt from the treatment reaction/reactor, in the contacting/absorption/precipitation reaction/reactor C to form the precipitation material containing vaterite, aragonite, calcite, or combination thereof:

$$(NH_4)_2CO_3+CaCl_2)\rightarrow CaCO_3+2NH_4Cl$$

$$(NH_4)HCO_3+NH_3+CaCl_2)\rightarrow CaCO_3+2NH_4Cl+H_2O2$$
$$(NH_4)HCO_3+CaCl_2)\rightarrow CaCO_3+2NH_4Cl+H_2O+CO_2$$

Independent of any intermediate steps, in some embodiments, the combination of the reactions leads to an overall process chemistry of:

$$CaCO_3\text{ (limestone)}\rightarrow CaCO_3\text{ (vaterite, aragonite, calcite, or combination thereof)}$$

In some embodiments, the one or more cooling conditions comprise temperature between about 0-100° C., or between about 0-80° C., or between about 0-60° C., or between about 0-50° C., or between about 0-40° C., or between about 0-30° C., or between about 0-20° C., or between about 0-10° C., or between about 10-100° C., or between about 10-80° C., or between about 10-60° C., or between about 10-50° C., or between about 10-40° C., or between about 10-30° C., or between about 20-100° C., or between about 20-80° C., or between about 20-60° C., or between about 20-50° C., or between about 20-40° C., or between about 20-30° C., or between about 30-100° C., or between about 30-80° C., or between about 30-60° C., or between about 30-50° C., or between about 30-40° C., or between about 40-100° C., or between about 40-80° C., or between about 40-60° C., or between about 50-100° C., or between about 50-80° C., or between about 60-100° C., or between about 60-80° C., or between about 70-100° C., or between about 70-80° C.

In some embodiments of the aspects and embodiments provided herein, the one or more cooling conditions comprise pressure between about 0.5-50 atm, or between about 0.5-25 atm, or between about 0.5-10 atm.

It is to be understood that while FIG. 4 illustrates a separate cooling reaction/reactor 480, the treatment/dissolution reaction/reactor 410 may be integrated with the cooling reaction/reactor. For example, the treatment/dissolution reactor may be integrated with a condenser. Various examples of the integrated dissolution and the cooling reactor have been described in U.S. application Ser. No. 17/184,933, filed Feb. 25, 2021, which is incorporated herein by reference in its entirety. Both mixtures, containing the lime and the N-containing salt solution, (illustrated as $NH_4Cl$ in the figures) are fed to the treatment/dissolution reaction/reactor, when the aqueous solution containing calcium salt is formed. The solution may optionally contain solid impurities that may stay at the bottom of the treatment/dissolution reactor 410. The aqueous solution containing calcium salt is withdrawn from the treatment/dissolution reaction/reactor to be processed further for precipitation. The gaseous stream containing the carbon dioxide, ammonia, and water vapor passes to the upper section of the treatment/dissolution reactor where it is cooled to condense into the second aqueous solution. The second aqueous solution is collected using one or more trays.

As illustrated in step C in FIGS. 2-4, the aqueous solution containing calcium salt, from treatment of the mixture containing lime with an N-containing salt in the present embodiments, such as e.g. an ammonium salt or an ammonium halide, is contacted with the $CO_2$ and optionally $NH_3$ at any time before, during, or after the aqueous solution containing calcium salt is subjected to one or more precipitation conditions (i.e., conditions allowing for precipitation of the precipitation material). Similarly, as illustrated in step C in FIG. 4, the aqueous solution containing calcium salt is contacted with the second aqueous solution containing ammonium bicarbonate, ammonium carbonate, ammonium carbamate, ammonia, or a combination thereof, from the cooling reaction/reactor at any time before, during, or after the aqueous solution containing calcium salt is subjected to one or more precipitation conditions (i.e., conditions allowing for precipitation).

Accordingly, in some embodiments, the aqueous solution containing calcium salt is contacted with the $CO_2$ (and optionally $NH_3$ as seen in FIG. 3, or the second aqueous solution as in FIG. 4) prior to subjecting the aqueous solution to the one or more precipitation conditions that favor formation of the precipitation material containing calcium carbonate including stable vaterite, reactive vaterite, aragonite, calcite, or a combination thereof, or PCC. In some embodiments, the aqueous solution containing calcium salt is contacted with the $CO_2$ (and optionally $NH_3$ as seen in FIG. 3 or the second aqueous solution as seen in FIG. 4) while the aqueous solution is being subjected to the one or more precipitation conditions that favor formation of the precipitation material containing calcium carbonate including stable vaterite, reactive vaterite, aragonite, calcite, or combination thereof or PCC. In some embodiments, the aqueous solution containing calcium salt is contacted with the $CO_2$ (and optionally $NH_3$ as seen in FIG. 3 or the second aqueous solution as seen in FIG. 4) prior to and while subjecting the aqueous solution to the one or more precipitation conditions that favor formation of the precipitation material containing calcium carbonate containing stable vaterite, reactive vaterite, aragonite, calcite, or combination thereof or PCC. In some embodiments, the aqueous solution containing calcium salt is contacted with the $CO_2$ (and optionally $NH_3$ as seen in FIG. 3 or the second aqueous solution as seen in FIG. 4) after subjecting the aqueous solution to the one or more precipitation conditions that favor formation of the precipitation material containing calcium carbonate including stable vaterite, reactive vaterite, aragonite, calcite, or combination thereof or PCC.

In some embodiments, the contacting of the aqueous solution containing calcium salt with the carbon dioxide and optionally the ammonia or the second aqueous solution is achieved by contacting the aqueous solution to achieve and maintain a desired pH range, a desired temperature range, and/or desired divalent cation concentration using a convenient protocol as described herein (precipitation conditions).

In some embodiments, the aqueous solution containing calcium salt may take place in a contacting/precipitation reactor, wherein the amount of the aqueous solution containing calcium salt added, is sufficient to raise the pH to a desired level (e.g., a pH that induces precipitation of the precipitation material) such as pH 7-8.5, pH 7-8, pH 7.5-8, pH 8-8.5, pH 9-14, pH 10-14, pH 11-14, pH 12-14, or pH 13-14. In some embodiments, the pH of the aqueous solution containing calcium salt, when contacted with the carbon dioxide, and optionally the $NH_3$ or the second aqueous solution, is maintained at a pH between 7-8.5, or between 7.5-8.5, or between 7-8, or between 7.6-8.5, or between 8-8.5, or between 7.5-9.5, in order to form the precipitation material containing calcium carbonate containing stable vaterite, reactive vaterite, aragonite, calcite, or combination thereof or PCC.

In some embodiments, the aqueous solution may be cycled more than once, where a first cycle of precipitation removes vaterite, aragonite, calcite, or a combination thereof, and leaves an alkaline solution to which additional aqueous solution containing calcium salt may be added. The carbon dioxide, when contacted with the recycled aqueous solution, enables precipitation of more vaterite, aragonite, calcite, or a combination thereof. It will be appreciated that, in these embodiments, the aqueous solution, following the first cycle of precipitation, may be contacted with the $CO_2$ before, during, and/or after the aqueous solution containing calcium salt has been added. In these embodiments, the water may be recycled or freshly introduced. As such, the order of addition of the $CO_2$ and the aqueous solution containing calcium salt may vary. For example, the aqueous solution containing calcium salt may be added to, for example, brine, seawater, or freshwater, followed by the addition of the $CO_2$. In another example, the $CO_2$ may be added to, for example, brine, seawater, or freshwater, followed by the addition of the aqueous solution containing calcium salt.

The aqueous solution containing calcium salt may be contacted with the $CO_2$ in the contacting reactor using any convenient protocol according to the present embodiments. The contact protocols of interest may include, without limitation, direct contacting (e.g., bubbling the $CO_2$ gas through the aqueous solution), concurrent contacting (i.e., contact between unidirectional flowing gaseous and liquid phase streams), countercurrent contacting (i.e., contact between oppositely flowing gaseous and liquid phase streams), among others. As such, in various embodiments, contacting may be accomplished through use of infusers, bubblers, fluidic Venturi reactors, spargers, gas filters, sprays, trays, or packed column reactors, and the like, in the precipitation reactor. In some embodiments, gas-liquid contacting is accomplished by forming a liquid sheet of solution with a flat jet nozzle, wherein the $CO_2$ gas and the liquid sheet move in countercurrent, co-current, or crosscurrent directions, or in any other suitable manner. In some embodiments, gas-liquid contacting is accomplished by contacting liquid droplets of the solution having an average diameter of 500 micrometers or less, such as 100 micrometers or less, with the $CO_2$ gas.

In some embodiments, substantially (e.g., 80% or more or 90% or 99.9% or 100%) the entire $CO_2$, and optionally $NH_3$ stream produced in the process illustrated in the figures, is employed in the precipitation of the precipitation material. In some embodiments, a portion of the $CO_2$, and optionally $NH_3$ stream, is employed in the precipitation of the precipitation material, and may be 75% or less, such as 60% or less, and including 50% and less of the gaseous stream.

Any combination of the methods of the gas-liquid contacting protocols described in these embodiments may be utilized. Gas-liquid contacting is continued until the pH of the precipitation reaction mixture is optimum. Various optimum pH values have been described in the present embodiments to form the precipitation precipitating material containing e.g., reactive vaterite, aragonite, calcite, or combination thereof, after which the precipitation reaction mixture is allowed to stir. The rate at which the pH drops may be controlled by addition of more of the aqueous solution containing calcium salt during gas-liquid contacting. Additional aqueous solution may be added after sparging to raise the pH back to basic levels for precipitation of a portion or all of the precipitation material. In any case, the precipitation material may be formed upon removing protons from certain species (e.g., carbonic acid, bicarbonate, hydronium) in the precipitation reaction mixture. The precipitation material containing carbonates may then be separated and optionally, further processed.

In some embodiments, the rate at which the pH drops may be controlled by addition of additional supernatant or the aqueous solution containing calcium salt during gas-liquid contacting. Additional supernatant or the aqueous solution containing calcium salt may be added after gas-liquid contacting to raise the pH back to basic levels (e.g., between 7-9 or between 7-8.5 or between 7-8) for precipitation of a portion or all the precipitation material.

In various embodiments, the aqueous solution containing calcium salt when contacted with the gaseous stream containing $CO_2$ gas, results in the precipitation of the calcium carbonate containing vaterite, aragonite, calcite, or combination thereof, which are polymorphs of the calcium carbonate. The precipitation conditions that result in the formation of the stable or the reactive vaterite or the PCC in this process, are described in different embodiments. In some embodiments, the precipitating material contains stable vaterite and/or reactive vaterite or PCC. The "stable vaterite" or its grammatical equivalent, as used in the present embodiments, includes vaterite that does not transform to aragonite or calcite during and/or after a dissolution-reprecipitation process in water. The "reactive vaterite" or "activated vaterite" or its grammatical equivalent as used in the present embodiments, includes vaterite that results in aragonite and/or calcite formation during and/or after dissolution-reprecipitation process in water. The "precipitated calcium carbonate" or "PCC" as used in the present embodiments includes conventional PCC with high purity having one micron or lesser size particles. The PCC can be in any polymorphic form of calcium carbonate including but not limited to vaterite, aragonite, calcite, or a combination thereof. In some embodiments, the PCC has a particle size measuring in nanometers, or between 0.001 micron to 5 micron.

In the present embodiments, the aqueous solution containing $CO_2$ charged water, produced by contacting the aqueous solution containing calcium salt with the gaseous stream containing $CO_2$ (and optionally the second gaseous stream containing ammonia) is subjected to one or more of precipitation conditions (step C) sufficient to produce the precipitation material containing calcium carbonate containing stable vaterite, reactive vaterite, aragonite, calcite, or combination thereof or PCC and the supernatant (i.e., the part of the precipitation reaction solution that is left over after precipitation of the precipitation material). In some embodiments, the one or more precipitation conditions favor production of the precipitation material containing stable or reactive vaterite or PCC.

The precipitation conditions include those that modulate the environment of the $CO_2$ charged precipitation reaction mixture to produce the desired precipitation material containing calcium carbonate containing stable vaterite, reactive vaterite, aragonite, calcite, or a combination thereof or PCC. Such one or more precipitation conditions, that can be used in the present embodiments, suitable to form stable vaterite, reactive vaterite, aragonite, calcite, or a combination thereof or PCC containing precipitation material include, without limitation, temperature, pH, pressure, ion ratio, precipitation rate, presence of additive, presence of ionic species, concentration of additive and ionic species, stirring, residence time, mixing rate, forms of agitation such as ultrasonics, presence of seed crystals, catalysts, membranes, substrates, dewatering, drying, ball milling, etc. In some embodiments, the average particle size of the stable or reactive vaterite or PCC may also depend on the one or more precipitation conditions used in the precipitation of the precipitation material. In some embodiments, the percentage of the stable or reactive vaterite in the precipitation material may also depend on the one or more precipitation conditions used in the precipitation process.

For example, the temperature of the $CO_2$-charged precipitation reaction mixture may be raised to a point at which an amount suitable for precipitation of the desired precipitation material occurs. In such embodiments, the temperature of the $CO_2$ charged precipitation reaction mixture may be raised to a value, such as from 20° C. to 80° C., or 20° C. to 50° C., or 30° C. to 50° C., or 40° C. to 50° C., or 50° C. to 60° C., and including from 25° C. to 45° C. While a given set of precipitation conditions may have a temperature ranging from 0° C. to 100° C., the temperature may be raised in certain embodiments to produce the desired precipitation material. In certain embodiments, the temperature of the precipitation reaction mixture is raised using energy generated from low or zero carbon dioxide emission sources such as solar energy source, wind energy source, hydroelectric energy source, waste heat from the flue gases of the carbon emitter, etc.

In some embodiments, the pH of the $CO_2$-charged precipitation reaction mixture may also be raised to an amount suitable for precipitation of the desired precipitation material. In such embodiments, the pH of the $CO_2$-charged precipitation reaction mixture is raised to alkaline levels for precipitation, where carbonate is favored over bicarbonate. In some embodiments, the pH of the aqueous solution containing calcium salt that is contacted with the carbon dioxide gas has an effect on the formation of the reactive vaterite, aragonite, calcite, or combination thereof or PCC. In some embodiments, the precipitation conditions required to form the precipitation material containing reactive vaterite or PCC, include conducting the contacting step of the carbon dioxide with the aqueous solution containing calcium salt at pH higher than 7, or pH of 8, or pH of between 7.1-8.5, or pH of between 7.5-8, or between 7.5-8.5, or between 8-8.5, or between 7.6-8.4, in order to form the reactive vaterite or PCC. In some embodiments, the pH may be raised to pH 9 or higher, such as pH 10 or higher, including pH 11 or higher or pH 12.5 or higher.

Adjusting major ion ratios during precipitation may influence the nature of the precipitation material. Major ion ratios may have considerable influence on polymorph formation. For example, as the magnesium:calcium ratio in the water increases, aragonite may become the major polymorph of calcium carbonate in the precipitation material over low-magnesium vaterite. At low magnesium:calcium ratios, low-magnesium calcite may become the major polymorph. In some embodiments, where $Ca^{2+}$ and $Mg^{2+}$ are both present, the ratio of $Ca^{2+}$ to $Mg^{2+}$ (i.e., $Ca^{2+}$:$Mg^{2+}$) in the precipitation material is 1:1 to 1:2.5, 1:2.5 to 1:5, 1:5 to 1:10, 1:10 to 1:25, 1:25 to 1:50, 1:50 to 1:100, 1:100 to 1:150, 1:150 to 1:200, 1:200 to 1:250, 1:250 to 1:500, or 1:500 to 1:1000. In some embodiments, the ratio of $Mg^{2+}$ to $Ca^{2+}$ (i.e., $Mg^{2+}$:$Ca^{2+}$) in the precipitation material is 1:1 to 1:2.5, 1:2.5 to 1:5, 1:5 to 1:10, 1:10 to 1:25, 1:25 to 1:50, 1:50 to 1:100, 1:100 to 1:150, 1:150 to 1:200, 1:200 to 1:250, 1:250 to 1:500, or 1:500 to 1:1000.

Precipitation rate may also have an effect on compound phase formation, with the most rapid precipitation rate achieved by seeding the solution with a desired phase. Without seeding, rapid precipitation may be achieved by rapidly increasing the pH of the precipitation reaction mixture, which may result in more amorphous constituents. The higher the pH, the more rapid the precipitation, which may result in a more amorphous precipitation material.

Residence time of the reaction mixture after contacting the aqueous solution with the $CO_2$ may also have an effect on compound phase formation. For example, in some embodiments, a longer residence time may result in transformation of the reactive vaterite to aragonite/calcite within the reaction mixture. A residence time which is too short may result in an incomplete formation of the reactive vaterite in the reaction mixture. Therefore, the residence time may be critical to the precipitation of the reactive vaterite. Further, the residence time may also affect the particle size of the precipitate. For example, too long of a residence time may result in the agglomeration of the particles forming large size particles which is undesirable for PCC formation. Therefore, in some embodiments, the residence time of the reaction is between about 10 min to 1 hour, or between about 15 min-60 min, or between about 15 min-45 min, or between about 15 min-30 min, or between about 30 min-60 min.

In some embodiments, a set of precipitation conditions to produce a desired precipitation material from a precipitation reaction mixture may include, the temperature and pH, as well as, in some instances, the concentrations of additives and ionic species in the water. The presence of the additives and the concentration of the additives may also favor formation of stable vaterite, reactive vaterite, aragonite, calcite, or combination thereof or PCC. In some embodiments, a middle chain or long chain fatty acid ester may be added to the aqueous solution during the precipitation to form PCC. Examples of fatty acid esters include, without limitation, cellulose such as carboxymethyl cellulose, sorbitol, citrate such as sodium or potassium citrate, stearate such as sodium or potassium stearate, phosphate such as sodium or potassium phosphate, sodium tripolyphosphate, hexametaphosphate, EDTA, or combination thereof. In some embodiments, a combination of stearate and citrate may be added during the contacting step of the process to from PCC.

Precipitation conditions may also include factors such as mixing rate, form of agitation such as ultrasonics, presence of seed crystal, catalyst, membrane, or substrate. In some embodiments, precipitation conditions include supersaturation, temperature, pH, and/or concentration gradient, as well as cycling or changing any of these parameters. The protocols employed to prepare precipitation material according to the present embodiments, may be batch, semi-batch, or continuous. in various embodiments, the precipitation conditions may be different to produce a given precipitation material in a continuous flow system compared to a semi-batch or batch system.

In some embodiments, the gas leaving the contacting/absorber/precipitation reaction/reactor, shown as "scrubbed gas" in FIGS. 2-4, passes to a gas treatment unit for a scrubbing process. Although not shown in the figures, the treatment unit may be used in any of the processes and systems described according to the present embodiments. The mass balance and equipment design for the gas treatment unit may depend on the properties of the gases. In some embodiments, the gas treatment unit may incorporate an HCl scrubber for recovering small amounts of $NH_3$ in the gas exhaust stream that may be carried from the $CO_2$ absorption, precipitation step by the gas. $NH_3$ may be captured by the HCl solution through:

$$NH_3(g)+HCl(aq)\rightarrow NH_4Cl(aq)$$

The $NH_4Cl$ (aq) from the HCl scrubber may be recycled back to the solvation step A.

In some embodiments, the gas exhaust stream containing ammonia (shown as "scrubbed gas") may be subjected to a scrubbing process where the gas exhaust stream containing ammonia is scrubbed with the carbon dioxide from the industrial process and water to produce a solution of ammonia. The inlets for the scrubber may be carbon dioxide ($CO_{2(g)}$), the reactor gas exhaust containing ammonia ($NH_{3(g)}$), and fresh makeup water (or some other dilute water stream). The outlet may be a slipstream of the scrubber's recirculating fluid (e.g. $H_3N—CO_{2(aq)}$ or carbamate), which may optionally be returned back to the main reactor for contacting with carbon dioxide and precipitation. The pH of the system may be controlled by regulating the flow rate of $CO_{2(g)}$ into the scrubber. The conductivity of the system may be controlled by addition of dilute makeup water to the scrubber. Volume may be maintained constant by using a level detector in the scrubber or it's reservoir. While ammonia is a basic gas, the carbon dioxide gas is acidic. In some embodiments, the acidic and basic gases may ionize each other to increase their solubilities.

Accordingly in some embodiments, and without being limited by any theory, the following reaction may take place:

$$NH_3(aq)+CO_2(aq)+H_2O\text{-->}HCO_3^-+NH_4^+$$

In some embodiments, the system includes a source of the aqueous solution containing the calcium salt from the cement plant and a structure having an inlet for the aqueous solution. For example, the systems may include a pipeline or feed for the aqueous solution. The aqueous solution may be brine, seawater, or freshwater. The system may further include an inlet for the $CO_2$ from the cement plant as well as components for combining these sources with water (optionally an aqueous solution such as water, brine or seawater) either before the contacting/precipitation reactor or in the contacting/precipitation reactor. In some embodiments, a gas-liquid contactor is configured to contact enough of the $CO_2$ to produce the precipitation material in excess of 1, 10, 100, 1,000, or 10,000 tons per day.

In some embodiments, the system further includes a contacting/precipitation reactor that subjects the water introduced to the contacting/precipitation reactor to one or more of the precipitation conditions (as described herein) and produces precipitation material and supernatant. In some embodiments, the contacting/precipitation reactor is configured to hold sufficient water to produce precipitation material in excess of 1, 10, 100, 1,000, or 10,000 tons per day. The contacting/precipitation reactor may also be configured to include any of a number of different components such as temperature modulation components, configured to heat the water to a desired temperature, chemical addition components configured for introducing additives etc. into the precipitation reaction mixture, automation components, and the like.

In various embodiments, the gaseous stream containing $CO_2$ may be provided from the cement plant to the site of precipitation in different manners. In some embodiments, the gaseous stream is provided with a gas conveyer (e.g., a duct) that runs from a site of the cement plant to one or more locations of the precipitation site. The source of the gaseous stream may be a distal location relative to the site of precipitation such that the source of the gaseous stream is a location that is 1 mile or more, such as 10 miles or more, including 100 miles or more, from the precipitation location. For example, the gaseous stream containing $CO_2$ may have been transported to the site of precipitation from a remote cement plant via a $CO_2$ gas conveyance system (e.g., a pipeline). The gas may or may not be processed (e.g., remove other components) before it reaches the precipitation site (i.e., the site in which precipitation and/or production of products takes place). In yet other embodiments, the gaseous stream containing $CO_2$ is proximal to the precipitation site. For example, the precipitation site may be integrated with the gaseous stream containing $CO_2$, such as the cement plant that integrates a contacting/precipitation reactor for the precipitation of precipitation material that may be used to produce the product.

In embodiments where the saltwater source that is processed by the system to produce the precipitate is seawater, the input is in fluid communication with a source of sea water, such as where the input is a pipeline or a feed from ocean water to a land-based system or inlet port in the hull of ship, e.g., where the system is part of a ship, e.g., in an ocean-based system.

Some embodiments include one or more detectors configured for monitoring the source of water or the source of the aqueous solution or the source of the carbon dioxide (not illustrated in figures). Monitoring may include, without limitation, collecting data about the pressure, temperature and composition of the water or the carbon dioxide gas. The detectors may be devices configured to monitor different physical or chemical quantities, for example, pressure sensors such as electromagnetic pressure sensors, potentiometric pressure sensors, etc., temperature sensors, such as resistance temperature detectors, thermocouples, gas thermometers, thermistors, pyrometers, infrared radiation sensors, etc., volume sensors, such as geophysical diffraction tomography sensors, X-ray tomography sensors, hydroacoustic surveyors, etc., and devices for determining chemical makeup of the water or the carbon dioxide gas, such as IR spectrometers, NMR spectrometers, UV-vis spectrophotometers, high performance liquid chromatographs, inductively coupled plasma emission spectrometers, inductively coupled plasma mass spectrometers, ion chromatographs, X-ray diffractometers, gas chromatographs, gas chromatography-mass spectrometers, flow-injection analysis, scintillation counters, acidimetric titration, and flame emission spectrometers, etc.

In some embodiments, the detectors may be integrated with a computer interface which is configured to provide a user with the collected data about the aqueous medium, the mixture containing lime, the aqueous solution containing calcium salt, the carbon dioxide gas, the second aqueous solution, and/or the ammonia gas. In some embodiments, a summary may be stored as a computer readable data file or may be printed out as a user readable document.

In some embodiments, the detector may be a monitoring device such that it can collect real-time data (e.g., internal pressure, temperature, etc.). In some embodiments, the detector may be one or more detectors configured to determine the parameters at regular intervals, e.g., determining the composition every 1 minute, every 5 minutes, every 10 minutes, every 30 minutes, every 60 minutes, every 100 minutes, every 200 minutes, every 500 minutes, or some other interval.

Separation of the Precipitation Material

Some embodiments further include separating the precipitation material (e.g., dewatering) from the aqueous solution, thereby forming calcium carbonate cake, as shown in step 240, 340, and 440 in FIGS. 2-4, by dewatering, optionally rinsing, and optionally drying. The precipitated material may then be used to make cementitious or non-cementitious product shown as product 250, 350, 380, 452, and 454 in FIGS. 2-4).

The precipitation material, following production from the precipitation reaction mixture, is separated from the reaction mixture to produce separated precipitation material (e.g., wet cake) and a supernatant, as illustrated in step D in FIGS. 2-4. In some embodiments, the separation step may be carried out in a separation station. The precipitation material may be stored in the supernatant for a period of time following precipitation and prior to separation (e.g., by drying). For example, the precipitation material may be stored in the supernatant for a period of time ranging from few min to hours to 1 to 1000 days or longer, such as 1 to 10 days or longer, at a temperature ranging from 1° C. to 40° C., such as 20° C. to 25° C. The separation of the precipitation material from the precipitation reaction mixture is achieved using any of a number of convenient approaches, including draining (e.g., gravitational sedimentation of the precipitation material followed by draining), decanting, filtering (e.g., gravity filtration, vacuum filtration, filtration using forced air), centrifuging, pressing, or any combination thereof. Separation of bulk water from the precipitation material produces a wet cake of precipitation material, or a dewatered precipitation material. Liquid-solid separators such as Epuramat's Extrem-Separator ("ExSep") liquid-solid separator, Xerox PARC's spiral concentrator, or a modification of either of Epuramat's ExSep or Xerox PARC's spiral concentrator, may be used for the separation of the precipitation material from the precipitation reaction mixture.

In some embodiments, the precipitation material, once separated from the precipitation reaction mixture, is washed with fresh water, then placed into a filter press to produce a filter cake with 30-60% solid. This filter cake is then mechanically pressed in a mold, using any convenient means, e.g., a hydraulic press, at adequate pressures, e.g., ranging from 5 to 5000 psi, such as 1000 to 5000 psi, to produce a formed solid, e.g., a rectangular brick. This resultant solid is then cured, e.g., by placing in open air and storing, by placing in a chamber where it is subjected to high levels of humidity and heat, etc. This resultant cured solid is then used as building materials or crushed to produce aggregate (shown as "product" in the figures).

In some embodiments related to processes involving the use of temperature and pressure, the dewatered precipitate cake may be dried. The cake is then exposed to a combination of re-watering, and elevated temperature and/or pressure for a certain time. The combination of the amount of water added back, the temperature, the pressure, and the time of exposure, as well as the thickness of the cake, may be varied according to composition of the starting material and the desired results.

A number of different ways of exposing the material to temperature and pressure are described according to some embodiments; it will be appreciated that any convenient process may be used. Thickness and size of the cake may be adjusted as desired; the thickness can vary in some embodiment from 0.05 inch to 5 inches, e.g., 0.1-2 inches, or 0.3-1 inch. In some embodiments the cake may be 0.5 inch to 6 feet or even thicker. The cake is then exposed to elevated temperature and/or pressure for a given time, by any convenient process, for example, in a platen press using heated platens. The heat to elevate the temperature, e.g., for the platens, may be provided, e.g., by heat from an industrial waste gas stream such as a flue gas stream. The temperature may be any suitable temperature; in general, for a thicker cake a higher temperature is desired. Examples of temperature ranges are 40-150° C., e.g., 60-120° C., such as 70-110° C., or 80-100° C. Similarly, the pressure may be any suitable pressure to produce the desired results; exemplary pressures include 1000-100,000 pounds per square inch (psi), including 2000-50,000 psi, or 2000-25,000 psi, or 2000-20,000 psi, or 3000-5000 psi. The time that the cake is pressed may be any suitable time, e.g., 1-100 seconds, or 1-100 minute, or 1-50 minutes, or 2-25 minutes, or 1-10,000 days. The resulting hard tablet may then optionally cure, e.g., by placing in open air and storing, by placing in a chamber wherein they are subjected to high levels of humidity and heat, etc. These hard tablets, optionally cured, may then be used as building material or crushed to produce aggregate.

Another process of providing temperature and pressure is the use of a press. A suitable press, e.g., a platen press, may be used to provide pressure at the desired temperature (using heat supplied, e.g., by a flue gas or by other steps of the process to produce a precipitate, e.g., from an electrochemical process) for a desired time. A set of rollers may be used in a similar fashion.

Another way to expose the cake to elevated temperature and pressure is by means of an extruder, e.g., a screw-type extruder. The barrel of the extruder may be outfitted to achieve an elevated temperature, e.g., by jacketing; this elevated temperature can be supplied by, e.g., flue gases or the like. Extrusion may be used as a means of pre-heating and drying the feedstock prior to a pressing operation. Such pressing can be performed by means of a compression mold, via rollers, via rollers with shaped indentations (which can provide virtually any shape of aggregate desired), between a belt which provides compression as it travels, or any other convenient process.

Alternatively, the extruder may be used to extrude material through a die, exposing the material to pressure as it is forced through the die, and giving any desired shape. In some embodiments, the carbonate precipitate is mixed with fresh water and then placed into the feed section of a rotating screw extruder. The extruder and/or the exit die may be heated to further assist in the process. The turning of the screw conveys the material along its length and compresses it as the flite depth of the screw decreases. The screw and barrel of the extruder may further include vents in the barrel with decompression zones in the screw coincident with the barrel vent openings. Particularly in the case of a heated extruder, these vented areas allow for the release of steam from the conveyed mass, removing water from the material.

The screw conveyed material may then be forced through a die section, which further compresses the material and shapes it. Typical openings in the die can be circular, oval, square, rectangular, trapezoidal, etc., although any shape which the final aggregate is desired in could be made by adjusting the shape of the opening. The material exiting the die may be cut to any desired length by any convenient process, such as by a fly knife. Use of a heated die section may further assist in the formation of the product by accelerating the transition of the carbonate mineral to a hard, stable form. Heated dies may also be used in the case of binders to harden or set the binder. Temperatures of 100° C. to 600° C. are commonly used in the heated die section.

In some embodiments, the precipitate may be employed for in situ or form-in-place structure fabrication. For example, roads, paved areas, or other structures may be fabricated from the precipitate by applying a layer of precipitate, e.g., as described above, to a substrate, e.g., ground, roadbed, etc., and then hydrating the precipitate, e.g., by allowing it to be exposed to naturally applied water, such as in the form of rain, or by irrigation. Hydration solidifies the precipitate into a desired in situ or form-in-place structure, e.g., road, paved over area, etc. (other examples of product as in figures). The process may be repeated, e.g., where thicker layers of in-situ formed structures are desired.

In some embodiments, the resulting dewatered precipitation material, such as the wet cake material, is directly used to make the products (shown as "product" in the figures). For example, the wet cake of the dewatered precipitation material is mixed with one or more additives, described herein, and is spread out on the conveyer belt where the reactive vaterite or PCC in the precipitation material transforms to the aragonite and/or the calcite and sets and hardens (and ammonium salt gets thermally removed). The hardened material is then cut into desired shapes such as boards or panels described herein. In some embodiments, the wet cake is poured onto a sheet of paper on top of the conveyer belt. Another sheet of paper may be put on top of the wet cake which is then pressed to remove excess water. After the setting and hardening of the precipitation material (e.g., the reactive vaterite transformation to the aragonite and/or the calcite), the material is cut into desired shapes, such as, cement siding boards and drywall etc. In some embodiments, the amount of the one or more additives may be optimized depending on the desired time required for the transformation of the reactive vaterite to the aragonite and/or the calcite (described below). For example, for some applications, it may be desired that the material transforms rapidly and in other instances, a slow transformation may be desired. In some embodiments, the wet cake may be heated on the conveyer belt to hasten the transformation of the reactive vaterite to the aragonite and/or the calcite. In some embodiments, the wet cake may be poured in the molds of desired shape and the molds are then heated in the autoclave to hasten the transformation of the reactive vaterite to the aragonite and/or the calcite (and to remove residual ammonium salt). Accordingly, the continuous flow process, batch process or semi-batch process, all are well within the scope of the invention.

In some embodiments, the calcium carbonate cake, as described above, may contain impurities (e.g., 1-2% by weight or more) of ammonium ($NH_4^+$) ions, sulfur ions, and/or chloride ($Cl^-$) ions. While rinsing of the filter cake of the precipitated $CaCO_3$, as described above, may remove some or all of the ammonium salts and/or sulfur compounds, it may result in a dilute concentration of ammonium salts (in the supernatant) which may need concentrating before recycling it back to the process.

In some embodiments, the resulting supernatant of the precipitation process, or a slurry of precipitation material may also be processed as desired. For example, the supernatant or slurry may be returned to step 410 of the process, or to another stage. In some embodiments, the supernatant may be contacted with the $CO_2$, as described above, to sequester additional $CO_2$. For example, in embodiments in which the supernatant is to be returned to the contacting/precipitation reactor, the supernatant may be contacted with the stream of $CO_2$ in a manner sufficient to increase the concentration of carbonate ion present in the supernatant. As described above, contact may be conducted using any convenient protocol. In some embodiments, the supernatant has an alkaline pH, and contact with the stream of $CO_2$ is carried out in a manner sufficient to reduce the pH to a range between pH 5 and 9, pH 6 and 8.5, or pH 7.5 to 8.2.

In some embodiments, the calcium carbonate slurry may be subjected to dewatering and optionally rinsed to form calcium carbonate slurry (with reduced water) or calcium carbonate cake (as illustrated in FIGS. 2-4) and the water or the supernatant containing residual ammonium salt solution. The residual ammonium chloride solution obtained from the dewatering as well as the rinsing stream may optionally be concentrated before being recycled back for the treatment with the mixture containing lime (shown in FIGS. 2-4). Additional ammonium chloride and/or ammonia (anhydrous or aqueous solution) may be added to the recycled solution to make up for the loss of the ammonium chloride during the process and bring the concentration of ammonium chloride to the optimum level.

In some embodiments, the residual ammonium salt such as the ammonium chloride solution illustrated in FIGS. 2-4, may be recovered from the supernatant aqueous solution and concentrated using recovery process, such as, but not limited to, thermal decomposition, pH adjustment, reverse osmosis, multi-stage flash, multi-effect distillation, vapor recompression, distillation, or combinations thereof. The systems configured to carry out these processes are available commercially. For example, the pH of the solution may be raised (e.g., with a strong base like NaOH). This may shift the equilibrium towards volatile ammonia ($NH_3(aq)/NH_3(g)$). Rates and total removal could both be improved by heating the solution.

In some embodiments, the residual ammonium salts may be separated and recovered from the calcium carbonate precipitate by thermal decomposition process. This process may be incorporated in the processes illustrated in FIGS. 2-4 at the separation of the CaCO3 precipitate (step D) and/or after the step of the dried CaCO3 precipitate or powder (step E).

Typically, at 338° C., solid $NH_4Cl$ may decompose into ammonia ($NH_3$) and hydrogen chloride (HCl) gases. While at 840° C., solid $CaCO_3$ decomposes to calcium oxide (CaO) solid and carbon dioxide ($CO_2$) gas.

$$NH_4Cl_{(s)} \longleftrightarrow NH_{3(g)} + HCl_{(g)} CaCO_{3(s)} \longleftrightarrow CaO_{(s)} + CO_{2(g)}$$

In some embodiments, the residual ammonium salt in the $CaCO_3$ precipitate and/or dried $CaCO_3$ precipitate such as, but not limited to, ammonium chloride, ammonium sulfate, ammonium sulfite, ammonium hydrosulfide, ammonium thiosulfate, or combinations thereof may be removed by thermal decomposition at a temperature between 338-840° C. This may be done either during the normal filter cake drying process and/or as a second post-drying heat treatment. A temperature range is desirable that decomposes residual ammonium salts in the precipitation while preserving the cementitious properties of the reactive vaterite in the precipitation material such that the reactive vaterite stays as reactive vaterite after heating, and after combination with water, successfully transforms to aragonite to form cementitious products. In some embodiments of the foregoing aspect and embodiments, the step of removing and optionally recovering the residual ammonium salt from the precipitation material comprises heating the precipitation material between about 100-360° C. or between about 150-360° C. or between about 200-360° C. or between about 250-360° C. or between about 300-360° C. or between about 150-200° C. or between about 100-200° C. or between about 200-300° C. or between about 290-375° C. or between about 300-350° C. or between about 310-345° C. or between about 320-345° C. or between about 330-345° C. or between about 300-345° C., to evaporate the ammonium salt from the precipitation material with optional recovery by condensation of the ammonium salt. In some embodiments of the foregoing aspect and embodiments, the step of removing and optionally recovering the residual ammonium salt from the precipitation material comprises heating the precipitation material, for a duration of more than about 10 min or of more than about 15 min or for than about 5 min or of between about 10 min to about 1 hour or of between about 10 min to about 1.5 hour or of between about 10 min to about 2 hours or of between about 10 min to about 5 hours or of between about 10 min to about 10 hours.

Step E: Drying of the Precipitate

In some embodiments, the resultant dewatered precipitation material obtained from the separation station is dried at the drying station to produce a powder form of the precipitation material containing calcium carbonate containing vaterite (stable or reactive), aragonite, calcite, or combination thereof or PCC (Step E in figures). Drying may be achieved by air-drying the precipitation material. In certain embodiments, drying is achieved by freeze-drying (i.e., lyophilization), wherein the precipitation material is frozen, the surrounding pressure is reduced, and enough heat is added to allow the frozen water in the precipitation material to sublime directly into gas. In yet another embodiment, the precipitation material is spray-dried to dry the precipitation material, wherein the liquid containing the precipitation material is dried by feeding it through a hot gas (such as the gaseous waste stream from the power plant), and wherein the liquid feed is pumped through an atomizer into a main drying chamber and a hot gas is passed as a co-current or counter-current to the atomizer direction.

Calcium carbonate slurry may be pumped via pump to drying system, which in some embodiments includes a filtration step followed by spray drying. The water separated from the drying system may be discharged or may be recirculated to the reactor. The resultant solid or powder from drying system is utilized as cement or aggregate to produce building material, effectively sequestering the clean $CO_2$. The solid or powder may also be used as a PCC filler in non-cementitious product such as paper, plastic, paint etc. The solid or powder may also be used in forming formed building materials, such as drywall, cement board, etc.

Depending on the particular drying protocol of the system, the drying station may include a filtration element, freeze-drying structure, spray-drying structure, etc. In some embodiments, the precipitate may be dried by fluid bed dryer. In certain embodiments, waste heat from a power plant or similar operation may be used to perform the drying step when appropriate. For example, in some embodiments, dry product is produced by the use of elevated temperature (e.g., from power plant waste heat), pressure, or a combination thereof. Following the drying of the precipitation material, the material may be then subjected to heating at elevated temperatures to remove ammonium salts as described herein reactive vaterite after heating. In some embodiments of the foregoing embodiments, it is desirable that the reactive vaterite in the precipitation material stays as reactive vaterite such that the cementitious properties of the material are conserved. In some embodiments, the ammonium salt evaporates from the precipitation material in a form containing ammonia gas, hydrogen chloride gas, chlorine gas, or combination thereof.

In some embodiments, maintaining a combination of the amount of temperature and duration of heating may be critical to removing ammonium salt from the precipitation material yet preserving the cementitious properties of the reactive vaterite material. Traditionally, reactive vaterite is highly unstable and transforms readily to the aragonite and/or the calcite. The temperature ranges coupled optionally with duration of heating may minimize the transformation of the reactive vaterite yet removes residual ammonium salt from the material. In some embodiments of the foregoing embodiments, the vaterite in the precipitation material, after removal of the ammonium salt, stays as reactive vaterite which when combined with water transforms to the aragonite and/or the calcite (dissolution-reprecipitation process) which sets and cements to form cementitious product. The cementitious product, thus formed, possesses minimal or no chloride content and has no foul smell of ammonia or sulfur. In some embodiments, the chloride content is around or below acceptable ASTM standard for the cementitious product.

In some embodiments, the above recited temperature conditions optionally coupled with duration of heating, may be combined with pressure conditions that provide a driving force to improve the thermodynamics of the decomposition of the residual ammonium salt. For example, the heating of the precipitation material may be carried out in a system in which the headspace is at a pressure lower than atmospheric pressure. The pressure lower than the atm pressure may create a driving force for heating reaction that involves gas phase products (such as, but not limited to, ammonia gas, hydrogen chloride gas, chlorine gas, or combination thereof), by reducing the partial pressure of the reactant in the vapor phase. Another advantage of operating under reduced pressure or vacuum may be that at lower pressure some sublimation reaction may occur at lower temperatures thereby improving the energy requirements of the heating reaction.

In some embodiments of the above-described thermal decomposition process, the separated ammonium chloride in the form of ammonia and HCl gases, may be recovered for reuse by either recrystallization of the combined thermally evolved gases or by absorbing the gases into an aqueous medium. Both mechanisms may result in the $NH_4Cl$ product that may be concentrated enough for reuse in the processes as shown in FIGS. 2-4.

In some embodiments, the ammonium salt may be separated and recovered in the processes described herein (or as illustrated in FIGS. 2-4) by pH adjusted evolution of $NH_3$ gas from the ammonium salt. This process may be incorporated in the processes herein illustrated in FIGS. 2-4 at the separation and/or drying of the $CaCO_3$ cake. The final pH of the water in the filter cake may typically be about 7.5. At this pH, $NH_4^+$ (pKa=9.25) may be the predominant species. Increasing the pH of this water may drive the acid base equilibrium toward $NH_3$ gas, as described in the following equation:

$$NH_4^+ \longleftrightarrow H^+ + NH_{3(g)}$$

Any source of alkalinity may be used to increase the pH of the filter cake water. In some embodiments, the aqueous solution of the calcium oxide and/or the hydroxide or the limestone slurry may provide the source of high alkalinity. In some embodiments, the aqueous fraction of the calcium oxide may be integrated into the rinsing stage of the dewatering process (e.g., filter cake step) to raise the pH of the system and drive the evolution of $NH_3$ gas. As ammonia has substantial solubility in water, heat and/or vacuum pressure may be applied to drive the equilibrium further toward the gaseous phase. The ammonia may be recovered for reuse by either recrystallization of ammonia with chloride or by absorbing the ammonia into an aqueous medium. Both mechanisms may result in the ammonia solution or $NH_4Cl$ product that may be concentrated enough for reuse in the processes described herein.

In one aspect, the systems provided herein further comprise a recovering system to recover the residual ammonium salt from the aqueous solution to recycle back to the contacting reactor. The recovering system is the system configured to carry out thermal decomposition, reverse osmosis, multi-stage flash, multi-effect distillation, vapor recompression, distillation, and combinations thereof.

The calcium carbonate cake (e.g., vaterite or PCC) may be sent to the dryer (step E in FIGS. 2-4) to form the calcium carbonate powder containing stable vaterite, reactive vaterite, aragonite, calcite, or combination thereof or PCC. The powder form of the precipitation material containing stable vaterite, reactive vaterite, aragonite, calcite, or combination thereof or the PCC may be used further in applications to form product, as described herein. The cake may be dried using any drying techniques known in the art such as, but not limited to fluid bed dryer or swirl fluidizer. The resulting solid powder may be then mixed with additives to make different products described herein. In some embodiments, the slurry form with reduced water or the cake form of the precipitation material is directly used to form product, such as construction panel, as described herein.

In some embodiments, the production of the precipitation material and the product is carried out in the same facility. In some embodiments, the precipitation material is produced in one facility and is transported to another facility to make the end product. The precipitation material may be transported in the slurry form, wet cake form, or dry powder form.

In some embodiments of the foregoing aspects and embodiments, the vaterite composition or the precipitation material containing vaterite (after precipitation in step C, after separation in step D and/or after drying in step E) includes at least 10% w/w vaterite, or at least 20% w/w vaterite, or at least 30% w/w vaterite, or at least 40% w/w vaterite, or at least 50% w/w vaterite, or at least 60% w/w vaterite, or at least 70% w/w vaterite, or at least 80% w/w vaterite, or at least 90% w/w vaterite, or at least 95% w/w vaterite, or at least 99% w/w vaterite, or from 10% w/w to 99% w/w vaterite, or from 10% w/w to 90% w/w vaterite, or from 10% w/w to 80% w/w vaterite, or from 10% w/w to 70% w/w vaterite, or from 10% w/w to 60% w/w vaterite, or from 10% w/w to 50% w/w vaterite, or from 10% w/w to 40% w/w vaterite, or from 10% w/w to 30% w/w vaterite, or from 10% w/w to 20% w/w vaterite, or from 20% w/w to 99% w/w vaterite, or from 20% w/w to 95% w/w vaterite, or from 20% w/w to 90% w/w vaterite, or from 20% w/w to 75% w/w vaterite, or from 20% w/w to 50% w/w vaterite, or from 30% w/w to 99% w/w vaterite, or from 30% w/w to 95% w/w vaterite, or from 30% w/w to 90% w/w vaterite, or from 30% w/w to 75% w/w vaterite, or from 30% w/w to 50% w/w vaterite, or from 40% w/w to 99% w/w vaterite, or from 40% w/w to 95% w/w vaterite, or from 40% w/w to 90% w/w vaterite, or from 40% w/w to 75% w/w vaterite, or from 50% w/w to 99% w/w vaterite, or from 50% w/w to 95% w/w vaterite, or from 50% w/w to 90% w/w vaterite, or from 50% w/w to 75% w/w vaterite, or from 60% w/w to 99% w/w vaterite, or from 60% w/w to 95% w/w vaterite, or from 60% w/w to 90% w/w vaterite, or from 70% w/w to 99% w/w vaterite, or from 70% w/w to 95% w/w vaterite, or from 70% w/w to 90% w/w vaterite, or from 80% w/w to 99% w/w vaterite, or from 80% w/w to 95% w/w vaterite, or from 80% w/w to 90% w/w vaterite, or from 90% w/w to 99% w/w vaterite, or 10% w/w vaterite, or 20% w/w vaterite, or 30% w/w vaterite, or 40% w/w vaterite, or 50% w/w vaterite, or 60% w/w vaterite, or 70% w/w vaterite, or 75% w/w vaterite, or 80% w/w vaterite, or 85% w/w vaterite, or 90% w/w vaterite, or 95% w/w vaterite, or 99% w/w vaterite. The above vaterite may be stable vaterite or reactive vaterite and/or PCC. In some embodiments, the remaining amount may be aragonite, calcite, or combination thereof.

In some embodiments, the precipitation material containing vaterite (after precipitation in step C, after separation in step D and/or after drying in step E) is a particulate composition with an average particle size of 0.1-100 micron. The average particle size (or average particle diameter) may be determined using any conventional particle size determination process, such as, but not limited to, multi-detector laser scattering or laser diffraction or sieving. In certain embodiments, unimodel or multimodal, e.g., bimodal or other, distributions are present. Bimodal distribution may allow the surface area to be minimized, thus allowing a lower liquids/solids mass ratio when vaterite composition is mixed with water yet providing smaller reactive particles for early reaction. In some embodiments, the vaterite composition or the precipitation material provided herein is a particulate composition with an average particle size of 0.1-1000 micron, or 0.1-500 micron, or 0.1-100 micron, or 0.1-50 micron, or 0.1-20 micron, or 0.1-10 micron, or 0.1-5 micron, or 1-50 micron, or 1-25 micron, or 1-20 micron, or 1-10 micron, or 1-5 micron, or 5-70 micron, or 5-50 micron, or 5-20 micron, or 5-10 micron, or 10-100 micron, or 10-50 micron, or 10-20 micron, or 10-15 micron, or 15-50 micron, or 15-30 micron, or 15-20 micron, or 20-50 micron, or 20-30 micron, or 30-50 micron, or 40-50 micron, or 50-100 micron, or 50-60 micron, or 60-100 micron, or 60-70 micron, or 70-100 micron, or 70-80 micron, or 80-100 micron, or 80-90 micron, or 0.1 micron, or 0.5 micron, or 1 micron, or 2 micron, or 3 micron, or 4 micron, or 5 micron, or 8 micron, or 10 micron, or 15 micron, or 20 micron, or 30 micron, or 40 micron, or 50 micron, or 60 micron, or 70 micron, or 80 micron, or 100 micron. For example, in some embodiments, the vaterite composition or the precipitation material provided herein is a particulate composition with an average particle size of 0.1-20 micron, or 0.1-15 micron, or 0.1-10 micron, or 0.1-8 micron, or 0.1-5 micron, or 1-25 micron, or 1-20 micron, or 1-15 micron, or 1-10 micron, or 1-5 micron, or 5-20 micron, or 5-10 micron. In some embodiments, the vaterite composition or the precipitation material includes two or more, or three or more, or four or more, or five or more, or ten or more, or 20 or more, or 3-20, or 4-10 different sizes of the particles in the composition or the precipitation material. For example, the vaterite composition or the precipitation material may include two or more, or three or more, or between 3-20 particles ranging from 0.1-10 micron, 10-50 micron, 50-100 micron, 100-200 micron, 200-500 micron, 500-1000 micron, and/or sub-micron sizes of the particles. In some embodiments, the PCC in the precipitation material may have average particle size below 0.1 micron, such as between 0.001 micron to 1 micron or more. In some embodiments, the PCC may be in nanometer particle size. Transformation of the reactive vaterite to the aragonite and/or calcite As illustrated in FIGS. 2-4, the processes produce the precipitation material (in wet, slurry or dry form) containing stable vaterite, reactive vaterite, aragonite, calcite, or combination thereof or PCC. The "composition," "precipitate," and "precipitation material," are used interchangeably herein. The precipitation material formed in the processes and systems after the optional removal of the residual ammonium salt, as described herein, contains vaterite, aragonite, calcite, or combination thereof or the PCC. The "stable vaterite" includes vaterite that does not transform to the aragonite and/or the calcite during and/or after dissolution-re-precipitation process. The "reactive vaterite" or "activated vaterite" includes vaterite that results in the aragonite and/or the calcite formation during and/or after dissolution-re-precipitation process. In some embodiments, the PCC formed is in vaterite form. In some embodiments, the precipitation material contains vaterite and further contains aragonite, calcite, or combination thereof. In some embodiments, the precipitation material contains aragonite and further contains vaterite, calcite, or combination thereof. In some embodiments, the precipitation material contains calcite and further contains vaterite, aragonite, or combination thereof. In some embodiments, the precipitation material contains vaterite wherein the vaterite is stable vaterite and/or reactive vaterite. In some embodiments, the precipitation material contains aragonite. In some embodiments, the precipitation material contains calcite.

In some embodiments, the processes described herein further include contacting the precipitation material (in dried or wet form) with water and transforming the reactive vaterite to aragonite and/or calcite. In some embodiments, the stable vaterite when contacted with water does not transform to aragonite and stays either in the vaterite form or transforms over a long period of time to calcite.

In some embodiments, the precipitation material containing reactive vaterite (optionally including solid) upon contact with water undergoes transformation (dissolution-reprecipitation) to the aragonite and/or the calcite and sets and hardens into cementitious product (shown as "product" in FIGS. 2-4).

In some embodiments, the solid (as described herein) may get incorporated in the calcite. In some embodiments, the solid impurities do not adversely affect the strength (such as compressive strength or flexural strength) of the cementitious product. In fact, it has been contemplated that the impurities from limestone such as silica which constitutes the solid may facilitate pozzolanic properties during cementation process.

The precipitation material containing aragonite or the transformation of the reactive vaterite to the aragonite may impart one or more unique characteristics to the product including, but not limited to, high compressive strength, complex microstructure network, neutral pH etc. In some embodiments, the vaterite in the precipitation material may be formed under suitable conditions so that the vaterite is stable and is used as filler in various applications. In some embodiments, the PCC in the precipitation material may be formed under suitable conditions so that the PCC is highly pure and is of a very small size particle.

Typically, upon precipitation of the calcium carbonate, amorphous calcium carbonate (ACC) may initially precipitate and transform into one or more of its three more stable phases (vaterite, aragonite, or calcite). A thermodynamic driving force may exist for the transformation from unstable phases to more stable phases. For this reason, calcium carbonate phases transform in the order: ACC to vaterite, aragonite, and calcite where intermediate phases may or may not be present. This intrinsic energy may be harnessed to create a strong aggregation tendency and surface interactions that may lead to agglomeration and setting or cementing.

The processes and systems provided herein produce or isolate the precipitation material containing vaterite, aragonite, calcite, or combination thereof or in the form of PCC which may be present in vaterite, aragonite, or calcite form. The precipitation material may be in a wet form, slurry form, or a dry powder form. This precipitation material may have a stable vaterite form that does not transform readily to any other polymorph or may have a reactive vaterite form that transforms to the aragonite and/or the calcite form. The aragonite form may not convert further to more stable calcite form. The product containing the aragonite form of the precipitate shows one or more unexpected properties, including but not limited to, high compressive strength, high porosity (low density or light weight), neutral pH (useful as artificial reef described below), microstructure network, etc.

Other minor polymorph forms of calcium carbonate that may be present in the precipitation material include, but not limited to, amorphous calcium carbonate, a precursor phase of vaterite, a precursor phase of aragonite, an intermediary phase that is less stable than calcite, polymorphic forms in between these polymorphs or combination thereof.

Vaterite may be present in monodisperse or agglomerated form, and may be in spherical, ellipsoidal, plate like shape, or hexagonal system. Vaterite typically has a hexagonal crystal structure and forms polycrystalline spherical particles upon growth. The precursor form of vaterite contains nanoclusters of vaterite and the precursor form of aragonite contains sub-micron to nanoclusters of aragonite needles. Aragonite, if present in the composition may be needle shaped, columnar, or crystals of the rhombic system. Calcite, if present in the composition may be cubic, spindle, or crystals of hexagonal system. An intermediary phase that is less stable than calcite may be a phase that is between vaterite and calcite, a phase between precursor of vaterite and calcite, a phase between aragonite and calcite, and/or a phase between precursor of aragonite and calcite.

The transformation between calcium carbonate polymorphs may occur via solid-state transition, may be solution mediated, or both. In some embodiments, the transformation is solution-mediated as it may require less energy than the thermally activated solid-state transition. Vaterite is metastable and the difference in thermodynamic stability of calcium carbonate polymorphs may be manifested as a difference in solubility, where the least stable phases are the most soluble (Ostwald, supra). Therefore, vaterite may dissolve readily in solution and transform favorably towards a more stable polymorph, such as aragonite. In a polymorphic system like calcium carbonate, two kinetic processes may exist simultaneously in solution: dissolution of the metastable phase and growth of the stable phase. In some embodiments, the aragonite crystals may be growing while vaterite is undergoing dissolution in the aqueous medium.

In some embodiments, the precipitation material containing vaterite, as prepared by the processes described above, transforms to aragonite and sets and hardens after treatment with the aqueous medium under one or more suitable conditions. The aqueous medium includes, but is not limited to, fresh water optionally containing additives or brine. In some embodiments, the one or more suitable conditions include, but are not limited to, temperature, pressure, time period for setting, a ratio of the aqueous medium to the composition, and combination thereof. The temperature may be related to the temperature of the aqueous medium. In some embodiments, the temperature is in a range of 0-110° C., or 0-80° C., or 0-60° C., or 0-40° C., or 25-100° C., or 25-75° C., or 25-50° C., or 37-100° C., or 37-60° C., or 40-100° C., or 40-60° C., or 50-100° C., or 50-80° C., or 60-100° C., or 60-80° C., or 80-100° C. In some embodiments, the pressure is atmospheric pressure or above atm. pressure. In some embodiments, the time period for setting the cement product is 30 min. to 48 hrs, or 30 min. to 24 hrs, or 30 min. to 12 hrs, or 30 min. to 8 hrs, or 30 min. to 4 hrs, or 30 min. to 2 hrs, 2 to 48 hrs, or 2 to 24 hrs, or 2 to 12 hrs, or 2 to 8 hrs, or 2 to 4 hrs, 5 to 48 hrs, or 5 to 24 hrs, or 5 to 12 hrs, or 5 to 8 hrs, or 5 to 4 hrs, or 5 to 2 hrs, 10 to 48 hrs, or 10 to 24 hrs, or 24 to 48 hrs.

In one aspect, the reactive vaterite may be activated such that the reactive vaterite leads to aragonitic pathway and not calcite pathway during dissolution-reprecipitation process. In some embodiments, the reactive vaterite containing composition is activated in such a way that after the dissolution-reprecipitation process, aragonite formation is enhanced and calcite formation is suppressed. The activation of the reactive vaterite containing composition may result in control over the aragonite formation and crystal growth. The activation of the vaterite containing composition may be achieved by various processes. Various examples of the activation of vaterite, such as, but not limited to, nuclei activation, thermal activation, mechanical activation, chemical activation, or combination thereof, are described herein. In some embodiments, the vaterite is activated through various processes such that aragonite formation and its morphology and/or crystal growth can be controlled upon reaction of vaterite containing composition with water. The aragonite formed results in higher tensile strength and fracture tolerance to the products formed from the reactive vaterite.

In some embodiments, the reactive vaterite may be activated by mechanical means, as described herein. For example, the reactive vaterite containing compositions may be activated by creating surface defects on the vaterite composition such that the aragonite formation is accelerated. In some embodiments, the activated vaterite is a ball-milled reactive vaterite or is a reactive vaterite with surface defects such that aragonite formation pathway is facilitated.

The reactive vaterite containing compositions may also be activated by providing chemical or nuclei activation to the vaterite composition. Such chemical or nuclei activation may be provided by one or more of aragonite seeds, inorganic additive, or organic additive. The aragonite seed present in the compositions provided herein may be obtained from natural or synthetic sources. The natural sources include, but not limited to, reef sand, limestone, hard skeletal material of certain fresh-water and marine invertebrate organisms, including pelecypods, gastropods, mollusk shell, and calcareous endoskeleton of warm- and cold-water corals, pearls, rocks, sediments, ore minerals (e.g., serpentine), and the like. The synthetic sources include, but not limited to, precipitated aragonite, such as formed from sodium carbonate and calcium chloride, or aragonite formed by the transformation of vaterite to aragonite, such as transformed vaterite described herein.

In some embodiments, the inorganic additive or the organic additive in the inorganic additive or organic additive in the compositions provided herein, include, but not limited to, sodium decyl sulfate, lauric acid, sodium salt of lauric acid, urea, citric acid, sodium salt of citric acid, phthalic acid, sodium salt of phthalic acid, taurine, creatine, dextrose, poly(n-vinyl-1-pyrrolidone), aspartic acid, sodium salt of aspartic acid, magnesium chloride, acetic acid, sodium salt of acetic acid, glutamic acid, sodium salt of glutamic acid, strontium chloride, gypsum, lithium chloride, sodium chloride, glycine, sodium citrate dehydrate, sodium bicarbonate, magnesium sulfate, magnesium acetate, sodium polystyrene, sodium dodecylsulfonate, poly-vinyl alcohol, or combination thereof. In some embodiments, inorganic additive or organic additive in the compositions provided herein, include, but not limited to, taurine, creatine, poly(n-vinyl-1-pyrrolidone), lauric acid, sodium salt of lauric acid, urea, magnesium chloride, acetic acid, sodium salt of acetic acid, strontium chloride, magnesium sulfate, magnesium acetate, or combination thereof. In some embodiments, inorganic additive or organic additive in the compositions provided herein, include, but not limited to, magnesium chloride, magnesium sulfate, magnesium acetate, or combination thereof.

Without being limited by any theory, it is contemplated that the activation of the vaterite by ball-milling or by addition of aragonite seed, inorganic additive or organic additive or combination thereof may result in the control of the formation of the aragonite during dissolution-reprecipitation process of the activated reactive vaterite including control of properties, such as, but not limited to, polymorph, morphology, particle size, cross-linking, agglomeration, coagulation, aggregation, sedimentation, crystallography, inhibiting growth along a certain face of a crystal, allowing growth along a certain face of a crystal, or combination thereof. For example, the aragonite seed, inorganic additive or organic additive may selectively target the morphology of aragonite, inhibit calcite growth and promote the formation of aragonite that may generally not be favorable kinetically.

In some embodiments, one or more inorganic additives may be added to facilitate transformation of the vaterite to the aragonite. The one or more additives may be added during any step of the process. For example, the one or more additives may be added during contact of the first aqueous solution with the stream containing clean carbon dioxide, after contact of the first aqueous solution with the stream containing clean carbon dioxide, during precipitation of the precipitation material, after precipitation of the precipitation material in the slurry, in the slurry after the dewatering of the precipitation material, in the powder after the drying of the slurry, in the aqueous solution to be mixed with the powder precipitation material, or in the slurry made from the powdered precipitation material with water, or any combination thereof. In some embodiments, the water used in the process of making the precipitation material may already contain the one or more additives or the one or more additive ions. For example, if sea water is used in the process, then the additive ion may already be present in the sea water.

In some embodiments, in the foregoing processes, the amount of the one or more additives added during the process is more than 0.1% by weight, or more than 0.5% by weight, or more than 1% by weight, or more than 1.5% by weight, or more than 1.6% by weight, or more than 1.7% by weight, or more than 1.8% by weight, or more than 1.9% by weight, or more than 2% by weight, or more than 2.1% by weight, or more than 2.2% by weight, or more than 2.3% by weight, or more than 2.4% by weight, or more than 2.5% by weight, or more than 2.6% by weight, or more than 2.7% by weight, or more than 2.8% by weight, or more than 2.9% by weight, or more than 3% by weight, or more than 3.5% by weight, or more than 4% by weight, or more than 4.5% by weight, or more than 5% by weight, or between 0.5-5% by weight, or between 0.5-4% by weight, or between 0.5-3% by weight, or 0.5-2% by weight, or 0.5-1% by weight, or 1-3% by weight, or 1-2.5% by weight, or 1-2% by weight, or 1.5-2.5% by weight, or 2-3% by weight, or 2.5-3% by weight, or 0.5% by weight, or 1% by weight, or 1.5% by weight, or 2% by weight, or 2.5% by weight, or 3% by weight, or 3.5% by weight, or 4% by weight, or 4.5% by weight, or 5% by weight. In some embodiments, in the foregoing processes, the amount of the one or more additives added during the process is between 0.5-3% by weight or between 1.5-2.5% by weight.

In some embodiments, the precipitation material or the vaterite composition is in a powder form. In some embodiments, the precipitation material or the vaterite composition is in a dry powder form. In some embodiments, the precipitation material or the vaterite composition is disordered or is not in an ordered array or is in the powdered form. In still some embodiments, the precipitation material or the vaterite composition is in a partially or wholly hydrated form. In still some embodiments, the precipitation material or the vaterite composition is in saltwater or fresh water. In still some embodiments, the precipitation material or the vaterite composition is in water containing sodium chloride. In still some embodiments, the precipitation material or the vaterite composition is in water containing alkaline earth metal ions, such as, but are not limited to, calcium, magnesium, etc. In some embodiments, the precipitation material or the vaterite compositions are non-medical or are not for medical procedures.

Formation of the Product from the Precipitation Material

The precipitation material containing calcium carbonate containing vaterite, aragonite, calcite, or combination thereof (in wet cake form or the dry form) may be combined with other materials to form compositions that may be used in the formation of the product. The product (also shown in the figures) made from the composition or the precipitation material provided herein shows one or more properties, such as, high compressive strength, high durability, high porosity (light weight), high flexural strength, and less maintenance cost. In some embodiments, the composition or the precipitation material upon combination with water, setting, and hardening (e.g., the reactive vaterite transformation to the aragonite and/or the calcite), have a compressive strength of at least 3 MPa (megapascal), or at least 7 MPa, or at least 10 MPa or in some embodiments, between 3-30 MPa, or between 14-80 MPa or 14-35 MPa.

The product produced by the processes described herein may be an aggregate or building material or a pre-cast material or a formed building material. In some embodiments, the product produced by the processes described herein includes non-cementitious material such as paper, paint, PVC etc. In some embodiments, the product produced by the methods described herein includes artificial reef. These products have been described herein.

In some embodiments of the foregoing aspects and the foregoing embodiments, the precipitation material containing calcium carbonate containing vaterite, aragonite, calcite, or combination thereof after combination with water, setting, and hardening (e.g. the reactive vaterite transformation to the aragonite and/or the calcite) or the stable vaterite mixed with cement and water and after setting and hardening to form product, has a compressive strength of at least 3 MPa, at least 7 MPa, at least 14 MPa, or at least 16 MPa, or at least 18 MPa, or at least 20 MPa, or at least 25 MPa, or at least 30 MPa, or at least 35 MPa, or at least 40 MPa, or at least 45 MPa, or at least 50 MPa, or at least 55 MPa, or at least 60 MPa, or at least 65 MPa, or at least 70 MPa, or at least 75 MPa, or at least 80 MPa, or at least 85 MPa, or at least 90 MPa, or at least 95 MPa, or at least 100 MPa, or from 3-50 MPa, or from 3-25 MPa, or from 3-15 MPa, or from 3-10 MPa, or from 14-25 MPa, or from 14-100 MPa, or from 14-80 MPa, or from 14-75 MPa, or from 14-50 MPa, or from 14-25 MPa, or from 17-35 MPa, or from 17-25 MPa, or from 20-100 MPa, or from 20-75 MPa, or from 20-50 MPa, or from 20-40 MPa, or from 30-90 MPa, or from 30-75 MPa, or from 30-60 MPa, or from 40-90 MPa, or from 40-75 MPa, or from 50-90 MPa, or from 50-75 MPa, or from 60-90 MPa, or from 60-75 MPa, or from 70-90 MPa, or from 70-80 MPa, or from 70-75 MPa, or from 80-100 MPa, or from 90-100 MPa, or from 90-95 MPa, or 14 MPa, or 3 MPa, or 7 MPa, or 16 MPa, or 18 MPa, or 20 MPa, or 25 MPa, or 30 MPa, or 35 MPa, or 40 MPa, or 45 MPa. For example, in some embodiments of the foregoing aspects and the foregoing embodiments, the composition after setting, and hardening to form product has a compressive strength of 3 MPa to 25 MPa, or 14 MPa to 40 MPa, or 17 MPa to 40 MPa, or 20 MPa to 40 MPa, or 30 MPa to 40 MPa, or 35 MPa to 40 MPa. In some embodiments, the compressive strengths described herein are the compressive strengths after 1 day, or 3 days, or 7 days, or 28 days, or 56 days, or longer.

In some embodiments, the precipitation material produced by the processes described herein is employed as a building material (e.g., a construction material for some type of man-made structure such as building, road, bridge, dam, and the like), such that the $CO_2$ is effectively sequestered in the built environment. Any man-made structure, such as foundation, parking structure, house, office building, commercial office, governmental building, infrastructure (e.g., pavement, road, bridge, overpass, wall, footing for gate, fence and pole, and the like) is considered a part of the built environment. Mortars find use in binding construction blocks (e.g., brick) together and filling gaps between construction blocks. Mortar can also be used to fix existing structure (e.g., to replace sections where the original mortar has become compromised or eroded), among other uses.

In some embodiments, an aggregate is produced from the resultant precipitation material. In such embodiments, where the drying process produces particles of the desired size, little if any additional processing is required to produce the aggregate. In yet other embodiments, further processing of the precipitation material is performed in order to produce the desired aggregate. For example, the dried form of the vaterite may be combined with fresh water in a manner sufficient to cause the vaterite to form a solid product, where the reactive vaterite converts to the aragonite and/or the calcite. By controlling the water content of the wet material, the porosity, and eventual strength and density of the final aggregate may be controlled. Typically a wet cake may be 40-60 volume % water. For denser aggregates, the wet cake may be <50% water, for less dense cakes, the wet cake may be >50% water. After hardening, the resultant solid product may then be mechanically processed, e.g., crushed or otherwise broken up and sorted to produce aggregate of the desired characteristics, e.g., size, particular shape, etc.

In these processes the setting and mechanical processing steps may be performed in a substantially continuous fashion or at separate times. In certain embodiments, large volumes of the composition containing vaterite, aragonite, calcite, or combination thereof may be stored in the open environment where the composition is exposed to the atmosphere. For the setting step, the vaterite may be irrigated in a convenient fashion with fresh water or allowed to be rained on naturally in order to produce the set product. The set product may then be mechanically processed as described above. Following production of the vaterite, the vaterite is processed to produce the desired aggregate. In some embodiment the vaterite may be left outdoors, where rainwater can be used as the freshwater source, to cause the meteoric water stabilization reaction to occur, hardening the precipitate to form aggregate.

In some embodiments, the composition provided herein comprises the precipitation material containing calcium carbonate containing vaterite, aragonite, calcite, or combination thereof and Ordinary Portland Cement (OPC) or Portland cement clinker. The amount of Portland cement component may vary and range from 10 to 95% w/w, or 10 to 90% w/w, or 10 to 80% w/w, or 10 to 70% w/w, or 10 to 60% w/w, or 10 to 50% w/w, or 10 to 40% w/w, or 10 to 30% w/w, or 10 to 20% w/w, or 20 to 90% w/w, or 20 to 80% w/w, or 20 to 70% w/w, or 20 to 60% w/w, or 20 to 50% w/w, or 20 to 40% w/w, or 20 to 30% w/w, or 30 to 90% w/w, or 30 to 80% w/w, or 30 to 70% w/w, or 30 to 60% w/w, or 30 to 50% w/w, or 30 to 40% w/w, or 40 to 90% w/w, or 40 to 80% w/w, or 40 to 70% w/w, or 40 to 60% w/w, or 40 to 50% w/w, or 50 to 90% w/w, or 50 to 80% w/w, or 50 to 70% w/w, or 50 to 60% w/w, or 60 to 90% w/w, or 60 to 80% w/w, or 60 to 70% w/w, or 70 to 90% w/w, or 70 to 80% w/w. For example, the vaterite composition contains a blend of 75% OPC and 25% vaterite, or 80% OPC and 20% vaterite, or 85% OPC and 15% vaterite, or 90% OPC and 10% vaterite, or 95% OPC and 5% vaterite.

In certain embodiments, the composition contains the precipitation material containing calcium carbonate containing vaterite, aragonite, calcite, or combination thereof and an aggregate. Aggregate may be included in the composition or the precipitation material to provide for mortar which includes fine aggregate and concrete which also include coarse aggregate. The fine aggregates are materials that almost entirely pass through a Number 4 sieve (ASTM C 125 and ASTM C 33), such as silica sand. The coarse aggregate are materials that are predominantly retained on a Number 4 sieve (ASTM C 125 and ASTM C 33), such as silica, quartz, crushed round marble, glass spheres, granite, limestone, calcite, feldspar, alluvial sand, sand or any other durable aggregate, and mixture thereof. As such, the term "aggregate" is used broadly to refer to a number of different types of both coarse and fine particulate material, including, but are not limited to, sand, gravel, crushed stone, slag, and recycled concrete. The amount and nature of the aggregate may vary widely. In some embodiments, the amount of aggregate may range from 25 to 80%, such as 40 to 70% and including 50 to 70% w/w of the total composition made up of both the composition and the aggregate.

During the mixing of the composition or the precipitation material containing calcium carbonate containing vaterite, aragonite, calcite, or combination thereof with the aqueous medium (e.g., for transformation of the reactive vaterite to the aragonite and/or the calcite), the precipitate may be subjected to high shear mixer. After mixing, the precipitate may be dewatered again and placed in pre-formed molds to make formed building material or may be used to make formed building material using the processes well known in the art or as described herein. Alternatively, the precipitate may be mixed with water and may be allowed to set. The precipitate may set over a period of days and may be then placed in the oven for drying, e.g., at 40° C., or from 40° C.-60° C., or from 40° C.-50° C., or from 40° C.-100° C., or from 50° C.-60° C., or from 50° C.-80° C., or from 50° C.-100° C., or from 60° C.-80° C., or from 60° C.-100° C. The precipitate may be subjected to curing at high temperature, such as, from 50° C.-60° C., or from 50° C.-80° C., or from 50° C.-100° C., or from 60° C.-80° C., or from 60° C.-100° C., or 60° C., or 80° C.-100° C., in high humidity, such as, in 30%, or 40%, or 50%, or 60% humidity.

In some embodiments, the composition contains the precipitation material in wet or dried form, mixed with one or more admixtures to impart one or more properties to the product including, but not limited to, strength, flexural strength, compressive strength, porosity, thermal conductivity, etc. The amount of admixture that is employed may vary depending on the nature of the admixture. In some embodiments, the amount of the one or more admixtures ranges from 1 to 50% w/w, such as 1-30% w/w, or 1-25% w/w, or 1-20% w/w/, or 2 to 10% w/w. Examples of the admixture include, but not limited to, set accelerator, set retarder, air-entraining agent, foaming agent, defoamer, alkali-reactivity reducer, bonding admixture, dispersant, coloring admixture, corrosion inhibitor, damp-proofing admixture, gas former, permeability reducer, pumping aid, shrinkage compensation admixture, fungicidal admixture, germicidal admixture, insecticidal admixture, rheology modifying agent, finely divided mineral admixture, pozzolan, aggregate, wetting agent, strength enhancing agent, water repellent, reinforced material such as fiber, and any other admixture. When using an admixture, the composition or the precipitation material, to which the admixture raw materials are introduced, is mixed for sufficient time to cause the admixture raw materials to be dispersed relatively uniformly throughout the composition.

Set accelerators may be used to accelerate the setting and early strength development of cement. Examples of set accelerators that may be used include, but are not limited to, POZZOLITH®NC534, non-chloride type set accelerator and/or RHEOCRETE®CNI calcium nitrite-based corrosion inhibitor, both sold under the above trademarks by BASF Admixtures Inc. of Cleveland, Ohio. Set retarding, also known as delayed-setting or hydration control, admixtures are used to retard, delay, or slow the rate of setting of cement. Most set retarders may also act as low level water reducers and can also be used to entrain some air into product. An example of a retarder is DELVO® by BASF Admixtures Inc. of Cleveland, Ohio. The air entrainer includes any substance that will entrain air in the compositions. Some air entrainers can also reduce the surface tension of a composition at low concentration. Air-entraining admixtures are used to purposely entrain microscopic air bubbles into cement. Air entrainment may increase the workability of the mix while eliminating or reducing segregation and bleeding. Materials used to achieve these desired effects can be selected from wood resin, natural resin, synthetic resin, sulfonated lignin, petroleum acids, proteinaceous material, fatty acids, resinous acids, alkylbenzene sulfonates, sulfonated hydrocarbons, vinsol resin, anionic surfactants, cationic surfactants, nonionic surfactants, natural rosin, synthetic rosin, an inorganic air entrainer, synthetic detergents, and their corresponding salts, and mixtures thereof. Air entrainers are added in an amount to yield a desired level of air in a cementitious composition. Examples of air entrainers that can be utilized in the admixture system include, but are not limited to MB AE 90, MB VR and MICRO AIR®, all available from BASF Admixtures Inc. of Cleveland, Ohio.

In some embodiments, the precipitation material is mixed with foaming agent. The foaming agents incorporate large quantities of air voids/porosity and facilitate reduction of the material's density. Examples of foaming agents include, but not limited to, soap, detergent (alkyl ether sulfate), Millifoam™ (alkyl ether sulfate), Cedepal™ (ammonium alkyl ethoxy sulfate), Witcolate™ 12760, and the like.

Also of interest as admixtures are defoamers. Defoamers are used to decrease the air content in the cementitious composition. Also of interest as admixtures are dispersants. The dispersant includes, but is not limited to, polycarboxylate dispersants, with or without polyether units. The term dispersant is also meant to include those chemicals that also function as a plasticizer, water reducer such as a high range water reducer, fluidizer, antiflocculating agent, or superplasticizer for compositions, such as lignosulfonates, salts of sulfonated naphthalene sulfonate condensates, salts of sulfonated melamine sulfonate condensates, beta naphthalene sulfonates, sulfonated melamine formaldehyde condensates, naphthalene sulfonate formaldehyde condensate resins for example LOMAR D® dispersant (Cognis Inc., Cincinnati, Ohio), polyaspartates, or oligomeric dispersants. Polycarboxylate dispersants can be used, by which is meant a dispersant having a carbon backbone with pendant side chains, wherein at least a portion of the side chains are attached to the backbone through a carboxyl group or an ether group.

Natural and synthetic admixtures may be used to color the product for aesthetic and safety reasons. These coloring admixtures may be composed of pigments and include carbon black, iron oxide, phthalocyanine, umber, chromium oxide, titanium oxide, cobalt blue, and organic coloring agents. Also of interest as admixtures are corrosion inhibitors. Corrosion inhibitors may serve to protect embedded reinforcing steel from corrosion. The materials commonly used to inhibit corrosion are calcium nitrite, sodium nitrite, sodium benzoate, certain phosphates or fluorosilicates, fluoroaluminites, amines and related chemicals. Also of interest are damp-proofing admixtures. Damp-proofing admixtures reduce the permeability of the product that has low cement contents, high water-cement ratios, or a deficiency of fines in the aggregate. These admixtures retard moisture penetration into dry products and include certain soaps, stearates, and petroleum products. Also of interest are gas former admixtures. Gas formers, or gas-forming agents, are sometimes added to the mix to cause a slight expansion prior to hardening. The amount of expansion is dependent upon the amount of gas-forming material used and the temperature of the fresh mixture. Aluminum powder, resin soap and vegetable or animal glue, saponin or hydrolyzed protein can be used as gas formers. Also of interest are permeability reducers. Permeability reducers may be used to reduce the rate at which water under pressure is transmitted through the mix. Silica fume, fly ash, ground slag, natural pozzolans, water reducers, and latex may be employed to decrease the permeability of the mix.

Also of interest are rheology modifying agent admixtures. Rheology modifying agents may be used to increase the viscosity of the compositions. Suitable examples of rheology modifier include firmed silica, colloidal silica, hydroxyethyl cellulose, starch, hydroxypropyl cellulose, fly ash (as defined in ASTM C618), mineral oils (such as light naphthenic), clay such as hectorite clay, polyoxyalkylenes, polysaccharides, natural gums, or mixtures thereof. Some of the mineral extenders such as, but not limited to, sepiolite clay are rheology modifying agents.

Also of interest are shrinkage compensation admixtures. TETRAGUARD® is an example of a shrinkage reducing agent and is available from BASF Admixtures Inc. of Cleveland, Ohio. Bacterial and fungal growth on or in hardened product may be partially controlled through the use of fungicidal and germicidal admixtures. The materials for these purposes include, but are not limited to, polyhalogenated phenols, dialdrin emulsions, and copper compounds. Also of interest in some embodiments is workability improving admixtures. Entrained air, which acts like a lubricant can be used as a workability improving agent. Other workability agents are water reducers and certain finely divided admixtures.

In some embodiments, the composition contains the precipitation material containing vaterite, aragonite, calcite, or combinations thereof and reinforced material such as fibers, e.g., where fiber-reinforced product is desirable. Fibers can be made of zirconia containing materials, aluminum, glass, steel, carbon, ceramic, grass, bamboo, wood, fiberglass, or synthetic materials, e.g., polypropylene, polycarbonate, polyvinyl chloride, polyvinyl alcohol, nylon, polyethylene, polyester, rayon, high-strength aramid, (e.g., Kevlar®), or mixtures thereof. The reinforced material is described in U.S. patent application Ser. No. 13/560,246, filed Jul. 27, 2012, which is incorporated herein in its entirety in the present disclosure.

The components of the composition can be combined using any suitable protocol. Each material may be mixed at the time of work, or part of or all of the materials may be mixed in advance. Alternatively, some of the materials are mixed with water with or without admixtures, such as high-range water-reducing admixtures, and then the remaining materials may be mixed therewith. As a mixing apparatus, any conventional apparatus can be used. For example, Hobart mixer, slant cylinder mixer, Omni Mixer, Henschel mixer, V-type mixer, and Nauta mixer can be employed.

The processes and systems provided herein may be carried out at land (e.g., at a location where the cement plant calcining the limestone is present, or is easily and economically transported in), at sea, or in the ocean. In some embodiments, the cement plants calcining the limestone may be retro-fitted with the systems described herein to form the precipitation material and further to form products from the precipitation material.

Aspects include systems, including processing plants or factories, for practicing the processes as described herein. Systems may have any configuration that enables practice of the particular production method of interest.

As indicated above, the system may be present on land or sea. For example, the system may be land-based system that is in a coastal region, e.g., close to a source of seawater, or even an interior location, where water is piped into the system from a salt-water source, e.g., ocean. Alternatively, the system is a water-based system, i.e., a system that is present on or in water. Such a system may be present on a boat, ocean-based platform etc., as desired.

In some embodiments, the systems may include a control station, configured to the precipitator or the charger; the amount of the precipitate conveyed to the separator; the amount of the precipitate conveyed to the drying station, and/or the amount of the precipitate conveyed to the refining station. A control station may include a set of valves or multi-valve systems which are manually, mechanically or digitally controlled, or may employ any other convenient flow regulator protocol. In some instances, the control station may include a computer interface, (where regulation is computer-assisted or is entirely controlled by computer) configured to provide a user with input and output parameters to control the amount, as described above.

Product Formed from the Dissolution Process

Provided herein, are processes and systems to form various cementitious and non-cementitious products from the precipitation material containing calcium carbonate containing stable vaterite, reactive vaterite, aragonite, calcite, or combinations thereof, which is formed from the dissolution process described herein. In some embodiments, the reactive vaterite transforms to aragonite and forms cement. The product includes storage-stable forms, e.g., materials for the construction of structures such as buildings and infrastructure, as well as the structures themselves or formed building materials such as drywall, or non-cementitious materials such as paper, paint, plastic, etc. or artificial reefs.

In some embodiments of the aspects provided herein, there is provided a dissolution process, containing treating the slip stream of the mixture containing lime with N-containing salt solution to produce the aqueous solution containing calcium salt, contacting the aqueous solution containing calcium salt with the gaseous stream containing more than 30 vol % carbon dioxide (using the fossil fuel alternative input) to produce the precipitate containing calcium carbonate, and adding water to the precipitation material, setting and hardening to form cement, cementitious product, and/or non-cementitious product.

In some embodiments of the aspects provided herein, there is provided a dissolution process, containing treating the slip stream of the mixture containing lime with N-containing salt solution to produce the aqueous solution containing calcium salt, contacting the aqueous solution containing calcium salt with the gaseous stream containing less than 25 vol % carbon dioxide (using the fossil fuel) to produce the precipitate containing calcium carbonate, and adding water to the precipitation material, setting and hardening to form cement, cementitious product, and/or non-cementitious product.

The cement or the cementitious product may be a building material, or a formed building material as described herein below.

The "building material" used herein includes cementitious material used in construction. In one aspect, there is provided a structure or a building material containing the set and hardened form of the precipitation material e.g., the vaterite composition e.g., where the reactive vaterite has converted to aragonite and/or calcite or PCC that sets and hardens. The product containing the aragonite and/or the calcite form of the transformed precipitate shows one or more unexpected properties, including but not limited to, high compressive strength, high porosity (low density or light weight), neutral pH (e.g., useful as artificial reef), microstructure network, etc.

Examples of such structures or the building materials include, but are not limited to, building, driveway, foundation, kitchen slab, furniture, pavement, road, bridges, motorway, overpass, parking structure, brick, block, wall, footing for a gate, fence, or pole, and combination thereof.

The "formed building material" used herein includes materials shaped (e.g., molded, cast, cut, or otherwise produced) into structures with defined physical shape. The formed building material may be a pre-cast building material, such as, a pre-cast cement or concrete product. The formed building materials and the methods of making and using the formed building materials are described in U.S. application Ser. No. 12/571,398, filed Sep. 30, 2009, which is incorporated herein by reference in its entirety. Various examples of the formed building material have been described herein below.

The formed building materials may vary greatly and include materials shaped (e.g., molded, cast, cut, or otherwise produced) into structures with defined physical shape, i.e., configuration. Formed building materials are distinct from amorphous building materials (e.g., powder, paste, slurry, etc.) that do not have a defined and stable shape, but instead conform to the container in which they are held, e.g., a bag or other container. Formed building materials are also distinct from irregularly or imprecisely formed materials (e.g., aggregate, bulk forms for disposal, etc.) in that formed building materials are produced according to specifications that allow for use of formed building materials in, for example, buildings. Formed building materials may be prepared in accordance with traditional manufacturing protocols for such structures, provided the precipitation material provided herein is employed in making such materials.

In some embodiments, the processes provided herein further include setting and hardening the precipitation material containing reactive vaterite where the reactive vaterite has converted to aragonite and/or the calcite, or the PCC that has set and hardened and forming the formed building material.

In some embodiments, the formed building materials made from the precipitation material have a compressive strength or the flexural strength of at least 3 MPa, at least 10 MPa, or at least 14 MPa, or between 3-30 MPa, or between about 14-100 MPa, or between about 14-45 MPa, or the compressive strength of the precipitation material after setting, and hardening, as described herein.

Examples of the formed building materials that can be produced by the foregoing processes, include, but not limited to, masonry units, for example only, bricks, blocks, and tiles including, but not limited to, ceiling tiles; construction panels, for example only, cement board (boards traditionally made from cement such as fiber cement board) and/or drywall (boards traditionally made from gypsum), conduits, basins, beam, column, slab, acoustic barrier, insulation material, or combinations thereof. Construction panels are formed building materials employed in a broad sense to refer to any non-load-bearing structural element that are characterized such that their length and width are substantially greater than their thickness. As such the panel may be a plank, a board, shingles, and/or tiles. Exemplary construction panels formed from the precipitation material containing the vaterite include cement boards and/or drywall. Construction panels are polygonal structures with dimensions that vary greatly depending on their intended use. The dimensions of construction panels may range from 50 to 500 cm in length, including 100 to 300 cm, such as 250 cm, width ranging from 25 to 200 cm, including 75 to 150 cm, such as 100 cm, thickness ranging from 5 to 25 mm, including 7 to 20 mm, including 10 to 15 mm.

In some embodiments, the cement board and/or the drywall may be used in making different types of boards such as, but not limited to, paper-faced board (e.g. surface reinforcement with cellulose fiber), fiberglass-faced or glass mat-faced board (e.g. surface reinforcement with glass fiber mat), fiberglass mesh reinforced board (e.g. surface reinforcement with glass mesh), and/or fiber-reinforced board (e.g. cement reinforcement with cellulose, glass, fiber etc.). These boards may be used in various applications including, but not limited to, sidings such as, fiber-cement sidings, roofing, soffit, sheathing, cladding, decking, ceiling, shaft liner, wall board, backer, trim, frieze, shingle, and fascia, and/or underlayment.

The cement boards traditionally are made from cement such as Ordinary Portland cement (OPC), magnesium oxide cement and/or calcium silicate cement. The cement boards made by the methods provided herein are made from the precipitation material that partially or wholly when reactive vaterite transforms to aragonite) and fiber and/or fiberglass and may possess additional fiber and/or fiberglass reinforcement at both faces of the board.

The cement boards are formed building materials which in some embodiments, are used as backer boards for ceramics that may be employed behind bathroom tiles, kitchen counters, backsplashes, etc. and may have lengths ranging from 100 to 200 cm. Cement boards may vary in physical and mechanical properties. In some embodiments, the flexural strength may vary, ranging between 1 to 7.5 MPa, including 2 to 6 MPa, such as 5 MPa. The compressive strengths may also vary, ranging from 5 to 50 MPa, including 10 to 30 MPa, such as 15 to 20 MPa. In some embodiments, cement boards may be employed in environments having extensive exposure to moisture (e.g., commercial saunas). The composition or the precipitation material described herein may be used to produce the desired shape and size to form a cement board. In addition, a variety of further components may be added to the cement boards which include, but are not limited to, plasticizers, clay, foaming agents, accelerators, retarders and air entrainment additives. The composition is then poured out into sheet molds or a roller may be used to form sheets of a desired thickness. The shaped composition may be further compacted by roller compaction, hydraulic pressure, vibrational compaction, or resonant shock compaction. The sheets are then cut to the desired dimensions of the cement boards.

Another type of construction panel formed from the composition or the precipitation material described herein is backer board. The backer board may be used for the construction of interior, and/or exterior floors, walls and ceilings. In the embodiments, the backer board is made partially or wholly from the precipitation material.

Another type of construction panel formed from the compositions or the precipitation material is drywall. The "drywall" as used herein, includes board that is used for construction of interior, and/or exterior floors, walls and ceilings. Traditionally, drywall is made from gypsum (called paper-faced board). In the embodiments, the drywall is made partially or wholly from the carbonate precipitation material thereby replacing gypsum from the drywall product. In some embodiments, the drywall may comprise construction panels prepared as a combination of aragonitic cement (setting and hardening when reactive vaterite transforms to aragonite) and cellulose, fiber and/or fiberglass and may possess additional paper, fiber, fiberglass mesh and/or fiberglass mat reinforcement at both faces of the board. Various processes for making the drywall product are well known in the art and are well within the scope of the invention. Some examples include, but not limited to, wet process, semi dry process, extrusion process, Wonderborad® process, etc., that have been described herein.

In some embodiments, the drywall is panel made of a paper liner wrapped around an inner core. For example, in some embodiments, during the process of making the drywall product from the precipitation material, the slurry of the precipitation material containing reactive vaterite is poured over a sheet of paper. Another sheet of paper is then put on top of the precipitation material such that the precipitation material is flanked by the paper on both sides (the resultant composition sandwiched between two sheets of outer material, e.g., heavy paper or fiberglass mats). The reactive vaterite in the precipitation material is then transformed to aragonite (using additives and/or heat) which then sets and hardens. When the core sets and is dried in a large drying chamber, the sandwich becomes rigid and strong enough for use as a building material. The drywall sheets are then cut and separated.

The flexural and compressive strengths of the drywall formed from the precipitation material are equal to or higher than conventional drywall prepared with gypsum plaster, which is known to be a soft construction material. In some embodiments, the flexural strength may range between 0.1 to 3 MPa, including 0.5 to 2 MPa, such as 1.5 MPa. The compressive strengths may also vary, in some instances ranging from 1 to 20 MPa, including 5 to 15 MPa, such as 8 to 10 MPa. In some embodiments, the formed building materials such as, the construction panels such as, but not limited to, cement boards and drywall produced by the methods described herein, have low density and high porosity making them suitable for lightweight and insulation applications.

The high porosity and light weight of the formed building materials, for example only, construction panels may be due to the development of the aragonitic microstructure when the reactive vaterite transforms to the aragonite. The transformation of the reactive vaterite during dissolution/re-precipitation process may lead to micro porosity generation while at the same time the voids created between the aragonitic crystals formed may provide nano porosity thereby leading to highly porous and light weight structure. Certain admixtures may be added during the transformation process such as, but not limited to, foaming agents, rheology modifiers and mineral extenders, such as, but not limited to, clay, starch, etc. which may add to the porosity in the product as the foaming agent may entrain air in the mixture and lower the overall density and mineral extender such as sepiolite clay may increase the viscosity of the mixture thereby preventing segregation of the precipitation material and water.

One of the applications of the cement board or drywall is fiber cement siding. Fiber-cement sidings formed by the processes provided herein comprise construction panels prepared as a combination of aragonitic cement, aggregate, interwoven cellulose, and/or polymeric fibers and may possess a texture and flexibility that resembles wood.

In some embodiments, the formed building materials are masonry units. Masonry units are formed building materials used in the construction of load-bearing and non-load-bearing structures that are generally assembled using mortar, grout, and the like. Exemplary masonry units formed from the compositions include bricks, blocks, and tiles.

Another formed building material formed from the precipitation material described herein is a conduit. Conduits are tubes or analogous structures configured to convey a gas or liquid, from one location to another. Conduits can include any of a number of different structures used in the conveyance of a liquid or gas that include, but are not limited to, pipes, culverts, box culverts, drainage channels and portals, inlet structures, intake towers, gate wells, outlet structures, and the like.

Another formed building material formed from the precipitation material described herein is basins. The term basin may include any configured container used to hold a liquid, such as water. As such, a basin may include, but is not limited to structures such as wells, collection boxes, sanitary manholes, septic tanks, catch basins, grease traps/separators, storm drain collection reservoirs, etc.

Another formed building material formed from the precipitation material described herein is a beam, which, in a broad sense, refers to a horizontal load-bearing structure possessing large flexural and compressive strengths. Beams may be rectangular cross-shaped, C-channel, L-section edge beams, I-beams, spandrel beams, H-beams, possess an inverted T-design, etc. Beams may also be horizontal load-bearing units, which include, but are not limited to joists, lintels, archways and cantilevers.

Another formed building material formed from the precipitation material described herein is a column, which, in a broad sense, refers to a vertical load-bearing structure that carries loads chiefly through axial compression and includes structural elements such as compression members. Other vertical compression members may include, but are not limited to pillars, piers, pedestals, or posts.

Another formed building material formed from the precipitation material described herein is a concrete slab. Concrete slabs are those building materials used in the construction of prefabricated foundations, floors and wall panels. In some instances, a concrete slab may be employed as a floor unit (e.g., hollow plank unit or double tee design).

Another formed building material formed from the precipitation material described herein is an acoustic barrier, which refers to a structure used as a barrier for the attenuation or absorption of sound. As such, an acoustic barrier may include, but is not limited to, structures such as acoustical panels, reflective barriers, absorptive barriers, reactive barriers, etc.

Another formed building material formed from the precipitation material described herein is an insulation material, which refers to a material used to attenuate or inhibit the conduction of heat. Insulation may also include those materials that reduce or inhibit radiant transmission of heat.

In some embodiments, the other formed building materials such as pre-cast concrete products include, but not limited to, bunker silo, cattle feed bunk, cattle grid, agricultural fencing, H-bunks, J-bunks, livestock slats, livestock watering troughs, architectural panel walls, cladding (brick), building trim, foundation, floors, including slab on grade, walls, double wall precast sandwich panel, aqueducts, mechanically stabilized earth panels, box culverts, 3-sided culverts, bridge systems, RR crossings, RR ties, sound walls/barriers, Jersey barriers, tunnel segments, reinforced concrete box, utility protection structure, hand holes, hollow core product, light pole base, meter box, panel vault, pull box, telecom structure, transformer pad, transformer vault, trench, utility vault, utility pole, controlled environment vaults, underground vault, mausoleum, grave stone, coffin, haz mat storage container, detention vaults, catch basins, manholes, aeration system, distribution box, dosing tank, dry well, grease interceptor, leaching pit, sand-oil/oil-water interceptor, septic tank, water/sewage storage tank, wet wells, fire cisterns, floating dock, underwater infrastructure, decking, railing, sea walls, roofing tiles, pavers, community retaining wall, res. retaining wall, modular block systems, and segmental retaining walls.

In some embodiments, the processes described herein include making other products from the precipitation material described herein including, but not limited to, non-cementitious compositions including paper, polymer product, lubricant, adhesive, rubber product, chalk, asphalt product, paint, abrasive for paint removal, personal care product, cosmetic, cleaning product, personal hygiene product, ingestible product, agricultural product, soil amendment product, pesticide, environmental remediation product, and combination thereof. Such compositions have been described in U.S. Pat. No. 7,829,053, issued Nov. 9, 2010, which is incorporated herein by reference in its entirety.

In some embodiments, the non-cementitious compositions are produced from the precipitation material containing stable vaterite where the stable vaterite acts as a filler.

In some embodiments, the processes described herein include making artificial marine structures from the precipitation material described herein including, but not limited to, artificial corals and reefs. In some embodiments, the artificial structures can be used in the aquariums or sea. In some embodiments, these products are made from the precipitated material containing reactive vaterite that transforms to aragonite after setting and hardening. The aragonitic cement provides neutral or close to neutral pH which may be conducive for maintenance and growth of marine life. The aragonitic reefs may provide suitable habitat for marine species.

Throughout the description, where compositions are described as having, including, or comprising, containing specific components, or where processes and methods are described as having, including, or comprising, containing specific steps, it is contemplated that, additionally, there are compositions of the present invention that consist essentially of, or consist of, the recited components, and that there are processes and methods according to the present invention that consist essentially of, or consist of, the recited processing steps.

In the application, where an element or component is said to be included in and/or selected from a list of recited elements or components, it should be understood that the element or component can be any one of the recited elements or components, or the element or component can be selected from a group consisting of two or more of the recited elements or components.

Further, it should be understood that elements and/or features of a composition or a process described herein can be combined in a variety of ways without departing from the spirit and scope of the present invention, whether explicit or implicit herein. For example, where reference is made to a particular composition, that composition can be used in various embodiments of compositions of the present invention and/or in processes of the present invention, unless otherwise understood from the context. In other words, within this application, embodiments have been described and depicted in a way that enables a clear and concise application to be written and drawn, but it is intended and will be appreciated that embodiments may be variously combined or separated without parting from the present teachings and invention(s). For example, it will be appreciated that all features described and depicted herein can be applicable to all aspects of the invention(s) described and depicted herein.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

The use of the term "include," "includes," "including," "have," "has," "having," "contain," "contains," or "containing," including grammatical equivalents thereof, should be understood generally as open-ended and non-limiting, for example, not excluding additional unrecited elements or steps, unless otherwise specifically stated or understood from the context.

The use of any and all examples, or exemplary language herein, for example, "such as" or "including," is intended merely to illustrate better the present invention and does not pose a limitation on the scope of the invention unless claimed. No language in the specification should be construed as indicating any non-claimed element as essential to the practice of the present invention.

Certain ranges are presented herein with numerical values being preceded by the term "about." The term "about" is used herein to provide literal support for the exact number that it precedes, as well as a number that is near to or approximately the number that the term precedes. As used herein, the term "about" refers to a ±10% variation from the nominal value unless otherwise indicated or inferred.

Unless defined otherwise, all technical and scientific terms used herein have the same meaning as commonly understood by one of ordinary skill in the art to which this invention belongs. Although any processes and materials similar or equivalent to those described herein can also be used in the practice or testing of the invention, representative illustrative processes and materials are described herein of prior invention. Further, the dates of publication provided may be different from the actual publication dates, which may need to be independently confirmed.

It should be understood that the expression "at least one of" includes individually each of the recited objects after the expression and the various combinations of two or more of the recited objects unless otherwise understood from the context and use. The expression "and/or" in connection with three or more recited objects should be understood to have the same meaning unless otherwise understood from the context.

It is noted that, as used herein and in the appended claims, the singular forms "a", "an", and "the" include plural references unless the context clearly dictates otherwise. For example, where the plural form is used for compounds, salts, and the like, this is taken to mean also a single compound, salt, or the like. It is further noted that the claims may be drafted to exclude any optional element.

As will be apparent to those of skill in the art upon reading this disclosure, each of the individual embodiments described and illustrated herein has discrete components and features which may be readily separated from or combined with the features of any of the other several embodiments without departing from the scope or spirit of the invention. Any recited process can be carried out in the order of events recited or in any other order, which is logically possible. It should be understood that the order of steps or order for performing certain actions is immaterial so long as the present invention remain operable. Moreover, two or more steps or actions may be conducted simultaneously.

The following examples are put forth to provide those of ordinary skill in the art with a complete disclosure and description of how to make and use the invention and are not intended to limit the scope of what the inventors regard as their invention nor are they intended to represent that the experiments below are all or the only experiments performed. Efforts have been made to ensure accuracy with respect to numbers used (e.g., amounts, temperature, etc.) but some experimental errors and deviations should be accounted for.

Formation and Transformation of the Precipitation Material from Calcined Limestone $NH_4Cl$ is dissolved into water. Limestone is calcined in an electric kiln at 950° C., cooled to room temperature and added to the aqueous solution of $NH_4Cl$ and mixed for a few hours. The resultant mixture is decanted to remove any impurities. The filtered solution is transferred to an airtight vessel. The solution is fed through a heat-exchanger which preheats the solution to 40° C. The carbonation reactor is an acrylic cylinder, equipped with baffles, gas diffuser, pH electrode, thermocouple, turbine impeller, and inlet and outlet ports for liquid, gases, and slurry. Mass flow controllers proportion a clean $CO_2$ (no pollutants from fossil fuel) inlet gas. During startup, the solution in the vessel is pumped into the reactor through the heat exchanger. The mixer is stirred while the clean $CO_2$ gas is introduced through the gas diffuser. The continuous inlet flow of the fresh reactant solution is controlled by maintaining the reactor pH at 8. The resultant reactive vaterite slurry is continuously collected into a holding container. The slurry is vacuum filtered. The reactive vaterite filter cake is oven dried at 100° C. The cake shows 100% vaterite with a mean particle size of 9 um. The clear filtrate containing regenerated $NH_4Cl$ is recycled in subsequent experiments.

The dried reactive vaterite solid is mixed into a paste. The X-ray diffraction (XRD) of the paste after 1 day shows 99.9% aragonite (the reactive vaterite fully converted to the aragonite). The pastes are cast into 2"×2"×2" cubes, which set and harden in a humidity chamber set to 60° C. and 80% of relative humidity for 7 days. The cemented cubes are dried in a 100° C. oven.

Destructive Testing Determines the Compressive Strength of the Cubes to be 4600 Psi (~31 MPa).

Although the foregoing invention has been described in some detail by way of illustration and example for purposes of clarity of understanding, it should be readily apparent to those of ordinary skill in the art in light of the teachings of this invention that certain changes and modifications may be made thereto without departing from the spirit or scope of the appended claims. Accordingly, the preceding merely illustrates the principles of the invention. It will be appreciated that those skilled in the art will be able to devise various arrangements, which, although not explicitly described or shown herein, embody the principles of the invention, and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the invention, therefore, is not intended to be limited to the exemplary embodiments shown and described herein. It is intended that the following claims define the scope of the invention and that processes and structures within the scope of these claims and their equivalents be covered thereby.

What is claimed is:

1. A carbon dioxide sequestration process, comprising:

calcining limestone using a fossil fuel alternative to form a mixture comprising lime and a gaseous stream comprising more than about 30 vol % carbon dioxide;

treating a slip stream of the mixture with an N-containing salt solution to produce an aqueous solution comprising calcium salt; and treating the aqueous solution with one of atmospheric air and natural water and allowing carbon dioxide from the aqueous solution to form a composition comprising calcium carbonate, calcium bicarbonate, or a combination thereof.

2. The process of claim 1, further comprising disposing the gaseous stream wherein the disposing comprises at least one of cooling, compressing, and storing.

3. The process of claim 2, wherein the storing comprises geologically sequestering the gaseous stream.

4. The process of claim 1, wherein the gaseous stream comprises between about 80-100 vol % carbon dioxide.

5. The process of claim 1, wherein the fossil fuel alternative comprises at least one of renewable electricity, hydrogen gas, biofuel, solar energy, wind energy, geothermal energy, and hydro energy.

6. The process of claim 5, wherein the biofuel comprises biomass comprising at least one of torrefied biomass, lignin, and pulverized biomass.

7. The process of claim 5, wherein gases generated by heating are separated from the gaseous stream.

8. The process of claim 1, wherein the mixture comprises at least one of underburnt lime, soft-burnt lime, and dead-burnt lime.

9. The process of claim 1, further comprising contacting the aqueous solution with the gaseous stream to produce a precipitate comprising calcium carbonate.

10. The process of claim 1, wherein treating the aqueous solution with the atmospheric air comprises spreading the aqueous solution on land and allowing the carbon dioxide from the atmospheric air to react with the aqueous solution and form a composition comprising calcium carbonate, calcium bicarbonate, or a combination thereof.

11. A carbon dioxide sequestration process, comprising:

calcining limestone using a fossil fuel alternative to form a mixture comprising lime and a gaseous stream comprising more than about 30 vol % carbon dioxide; and treating the mixture with one of atmospheric air and natural water and allowing carbon dioxide from the mixture to form a composition comprising calcium carbonate, calcium bicarbonate, or a combination thereof;

wherein treating the mixture in natural water comprises blending the mixture with cooling natural water at a power plant and sequestering the blend back in the natural water.

12. The process of claim 11, wherein the natural water is ocean water and treating the mixture comprises blending the mixture with concentrated salt ocean water at a desalination plant and sequestering the blend back in the ocean water.

13. The process of claim 11, wherein the gaseous stream comprises less than about 20% of at least one component selected from the group consisting of SOx, thermal NOx, carbon monoxide, metal, volatile organic matter, and particulate matter.

14. The process of claim 11, wherein the composition comprising calcium carbonate, calcium bicarbonate, or a combination thereof, is formed in ocean water is pH neutral.

15. A system for carbon dioxide sequestration, comprising:

a calcining module configured to calcine a limestone feed using fossil fuel alternative to form a mixture comprising lime and a gaseous stream comprising carbon dioxide, a reactor configured for treating a slip stream of the mixture with an N-containing salt solution to produce an aqueous solution comprising calcium salt, and a sequestration module operably connected to the reactor and configured to treat the aqueous solution with natural water and allow dissolved carbon dioxide in the natural water to react with the aqueous solution to form a composition comprising at least one of carbonate, calcium bicarbonate.

16. A system for carbon dioxide sequestration, comprising:

a calcining module configured to calcine a limestone feed using fossil fuel alternative to form a mixture comprising lime and a gaseous stream comprising carbon dioxide, and a sequestration module operably connected to the first calcining module and configured to treat the mixture with natural water by blending the mixture with cooling natural water and sequestering the blend back in the natural water, and allow dissolved carbon dioxide in the natural water to react with the mixture to form a composition comprising calcium at least one of carbonate, calcium bicarbonate.

* * * * *